US007854488B2

(12) United States Patent
Yamazaki

(10) Patent No.: US 7,854,488 B2
(45) Date of Patent: Dec. 21, 2010

(54) DOT MEASUREMENT METHOD AND APPARATUS

(75) Inventor: Yoshirou Yamazaki, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 376 days.

(21) Appl. No.: 12/138,211

(22) Filed: Jun. 12, 2008

(65) Prior Publication Data

US 2008/0309703 A1 Dec. 18, 2008

(30) Foreign Application Priority Data

Jun. 14, 2007 (JP) ..... 2007-157689

(51) Int. Cl.
*B41J 29/393* (2006.01)

(52) U.S. Cl. ..... 347/19

(58) Field of Classification Search ..... None
See application file for complete search history.

(56) References Cited

U.S. PATENT DOCUMENTS 6,270,178 B1 8/2001 Wada et al.
7,645,010 B2 * 1/2010 Otsuka ..... 347/15

FOREIGN PATENT DOCUMENTS

JP 10-230593 A 9/1998
JP 2006-284406 A 10/2006

* cited by examiner

*Primary Examiner*—Omar Rojas
(74) *Attorney, Agent, or Firm*—Birch, Stewart, Kolasch & Birch, LLP

(57) ABSTRACT

A dot measurement method includes: a line pattern forming step of forming line patterns on the ejection receiving medium; a pattern reading step of capturing an image of the line patterns; a profile graph acquiring step of acquiring profile graphs for each of the line patterns; a characteristic position calculating step of calculating extreme value positions, first edge positions and second edge positions for each of the line patterns; an approximation line calculating step of calculating a line-center approximation line, a first edge approximation line and a second edge approximation line; a line width calculating step of calculating a line width; a correlation information acquiring step of beforehand acquiring at least one of a first relationship between the line width and the dot diameter, and a second relationship between the line width and the ejection volume; and a measurement value calculating step of calculating at least one of the dot diameter and the ejection volume in accordance with the line width and the at least one of the first and second relationships.

11 Claims, 40 Drawing Sheets

DOT MEASUREMENT METHOD AND APPARATUS

BACKGROUND OF THE INVENTION

1. Field of the Invention

The present invention relates to a dot measurement method and apparatus, and more particularly to technology for measuring positions and diameters of deposited dots formed by droplets ejected from a liquid ejection head, typically, an inkjet head, or for measuring the volume of the ejected liquid droplets.

2. Description of the Related Art

Japanese Patent Application Publication No. 2006-284406 proposes technology for determining deposition position displacement of dots formed by droplets ejected from a liquid ejection head. According to Japanese Patent Application Publication No. 2006-284406, the positions of isolated dots are measured by ejecting droplets to form isolated dots from the nozzles of a head, capturing an image of the droplet ejection result, calculating the straight line (path) traced by the respective dots, and then comparing with a reference straight line.

Japanese Patent Application Publication No. 10-230593 discloses technology for determining the ejection volume from nozzles, by forming a line pattern by means of ink and reading in the whole of the line pattern by means of an imaging element, and consequently calculating the density (integrated density) on a certain surface area and determining the ejection volume of the ink used in the line pattern on the basis of the density thus calculated.

However, the technology described in Japanese Patent Application Publication No. 2006-284406 is aimed at measuring the positions of isolated dots that are formed by droplets ejected from respective nozzles and are not connected with the other dots, and therefore the imaging apparatus (image reading apparatus) which reads in the isolated dots is required to have extremely high resolution corresponding to the dot diameter. More specifically, an imaging resolution which is approximately the same as the measurement accuracy of the isolated dots (for example, an accuracy of the order of 1 μm or less) is required, or alternatively, imaging has to be carried out at a high resolution which allows the edge of one dot to be captured clearly. Furthermore, the technology described in Japanese Patent Application Publication No. 2006-284406 principally calculates the dot deposition positions (dot positions), and cannot simultaneously calculate the dot diameter.

On the other hand, the technology described in Japanese Patent Application Publication No. 10-230593 is aimed at measuring the ink ejection volume, and cannot simultaneously measure the deposition positions of the dots formed by droplets ejected from the nozzles.

SUMMARY OF THE INVENTION

The present invention has been contrived in view of these circumstances, an object thereof being to provide a dot measurement method and apparatus, and a computer readable medium used in same, whereby dot positions and dot diameters can be measured simultaneously with an accuracy (for example, an accuracy of the order of 1 μm) which is approximately the same as the accuracy of measuring isolated dots, even when using an imaging apparatus having a resolution (for example, approximately 5 μm per pixel) which is lower than the high resolution required for the imaging of isolated dots (for example, 1 μm per pixel).

In order to attain the aforementioned object, the present invention is directed to a dot measurement method of measuring at least one of a diameter of dots and an ejection volume of droplets of liquid ejected through nozzles arranged in a liquid ejection head, the ejected droplets being deposited on an ejection receiving medium to form the dots on the ejection receiving medium, the method comprising: a line pattern forming step of forming line patterns on the ejection receiving medium by ejecting and depositing the droplets on the ejection receiving medium through the nozzles while the liquid ejection head and the ejection receiving medium are being moved relatively to each other, each of the line patterns being parallel with a line direction and constituted of a row of the dots corresponding to one of the nozzles; a pattern reading step of capturing an image of the line patterns by means of an imaging apparatus including photoreceptors to acquire electronic image data representing the image of the line patterns, the photoreceptors of the imaging apparatus being aligned in a row that obliquely intersects with the line direction of the line patterns at a prescribed angle, the electronic image data being constituted of a plurality of pixels arranged in a two-dimensional lattice of which a lattice direction obliquely intersects with the line direction of the line patterns; a profile graph acquiring step of acquiring a plurality of profile graphs for each of the line patterns from the electronic image data, each of the profile graphs representing variations in an image signal value on a one-dimensional pixel row including pixels of the plurality of pixels aligned in a one-dimensional row, the one-dimensional pixel row being parallel with the lattice direction that obliquely intersects with the line direction of the line patterns; a characteristic position calculating step of calculating extreme value positions, first edge positions and second edge positions for each of the line patterns in accordance with the plurality of profile graphs acquired for said each of the line patterns, the extreme value positions indicating density centers of said each of the line patterns, the first edge positions indicating left-hand edges of said each of the line patterns, the second edge positions indicating right-hand edges of said each of the line patterns; an approximation line calculating step of calculating a line-center approximation line, a first edge approximation line and a second edge approximation line for each of the line patterns by applying a least-square method on the extreme value positions, the first edge positions and the second edge positions calculated for each of the line patterns in the characteristic position calculating step, the line-center approximation line corresponding to the extreme value positions, the first edge approximation line corresponding to the first edge positions, the second edge approximation line corresponding to the second edge positions; a deposition position calculating step of calculating positions of the dots deposited on the ejection receiving medium in accordance with a perpendicular distance between two of the line-center approximation lines corresponding to adjacent two of the line patterns; a line width calculating step of calculating a line width of each of the line patterns by calculating a perpendicular distance between the first edge approximation line and the second edge approximation line corresponding to said each of the line patterns; a correlation information acquiring step of beforehand acquiring at least one of a first relationship between the line width of the line pattern and the diameter of the dots on the ejection receiving medium, and a second relationship between the line width of the line pattern and the ejection volume of the droplets, the at least one of the first and second relationships being acquired beforehand for a combination of the liquid and the ejection receiving medium; and a measurement value calculating step of calculating at least one of the diameter of the dots and the ejection volume of the droplets of the liquid in accordance with the line width of each of the line patterns acquired in the line width calculation step and the at least one of the first and second relationships acquired in the correlation information acquiring step.

In order to attain the aforementioned object, the present invention is also directed to a dot measurement apparatus which measures at least one of a diameter of dots and an ejection volume of droplets of liquid ejected through nozzles arranged in a liquid ejection head, the ejected droplets being deposited on an ejection receiving medium to form the dots on the ejection receiving medium, the dot measurement apparatus comprising: a pattern reading device which includes an imaging apparatus capturing an image of line patterns on the ejection receiving medium to acquire electronic image data representing the image of the line patterns, the line patterns being formed by ejecting and depositing the droplets on the ejection receiving medium through the nozzles while the liquid ejection head and the ejection receiving medium are being moved relatively to each other, each of the line patterns being parallel with a line direction and constituted of a row of the dots corresponding to one of the nozzles, the imaging apparatus including photoreceptors that are aligned in a row that obliquely intersects with the line direction of the line patterns at a prescribed angle, the electronic image data being constituted of a plurality of pixels arranged in a two-dimensional lattice of which a lattice direction obliquely intersects with the line direction of the line patterns; a profile graph acquiring device which acquires a plurality of profile graphs for each of the line patterns from the electronic image data, each of the profile graphs representing variations in an image signal value on a one-dimensional pixel row including pixels of the plurality of pixels aligned in a one-dimensional row, the one-dimensional pixel row being parallel with the lattice direction that obliquely intersects with the line direction of the line patterns; a characteristic position calculating device which calculates extreme value positions, first edge positions and second edge positions for each of the line patterns in accordance with the plurality of profile graphs acquired for said each of the line patterns, the extreme value positions indicating density centers of said each of the line patterns, the first edge positions indicating left-hand edges of said each of the line patterns, the second edge positions indicating right-hand edges of said each of the line patterns; an approximation line calculating device which calculates a line-center approximation line, a first edge approximation line and a second edge approximation line for each of the line patterns by applying a least-square method on the extreme value positions, the first edge positions and the second edge positions that are calculated for each of the line patterns by the characteristic position calculating device, the line-center approximation line corresponding to the extreme value positions, the first edge approximation line corresponding to the first edge positions, the second edge approximation line corresponding to the second edge positions; a deposition position calculating device which calculates positions of the dots deposited on the ejection receiving medium in accordance with a perpendicular distance between two of the line-center approximation lines corresponding to adjacent two of the line patterns; a line width calculating device which calculates a line width of each of the line patterns by calculating a perpendicular distance between the first edge approximation line and the second edge approximation line corresponding to said each of the line patterns; a correlation information storing device which beforehand stores at least one of a first relationship between the line width of the line pattern and the diameter of the dots on the ejection receiving medium, and a second relationship between the line width of the line pattern and the ejection volume of the droplets, the at least one of the first and second relationships being stored beforehand for a combination of the liquid and the ejection receiving medium; and a measurement value calculating device which calculates at least one of the diameter of the dots and the ejection volume of the droplets of the liquid in accordance with the line width of each of the line patterns acquired by the line width calculating device and the at least one of the first and second relationships stored in the correlation information storing device.

In order to attain the aforementioned object, the present invention is also directed to a computer readable medium storing instructions causing a computer to function as the profile graph acquiring device, the characteristic position calculating device, the approximation line calculating device, the deposition position calculating device, the line width calculating device, the correlation information storing device, and the measurement value calculating device in the above-described dot measurement apparatus.

According to the present invention, it is possible to determine the dot deposition positions and the dot diameter simultaneously (from the same captured image). Therefore, it is possible to minimize (reduce to one time) the formation of line patterns (a sample chart) for measurement and the imaging of same. Furthermore, in comparison with a method used in the related art, it is possible to achieve measurement of higher accuracy with an imaging apparatus of low resolution, and therefore the data size of the captured image can be reduced, the processing time can be shortened, and the reading time can also be shortened.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Here, an application example is described with respect to the measurement of the dot deposition positions and dot diameters of the ink dots formed by an inkjet recording apparatus. Firstly, the overall composition of an inkjet recording apparatus will be described.

Description of Inkjet Recording Apparatus

Figure 1:
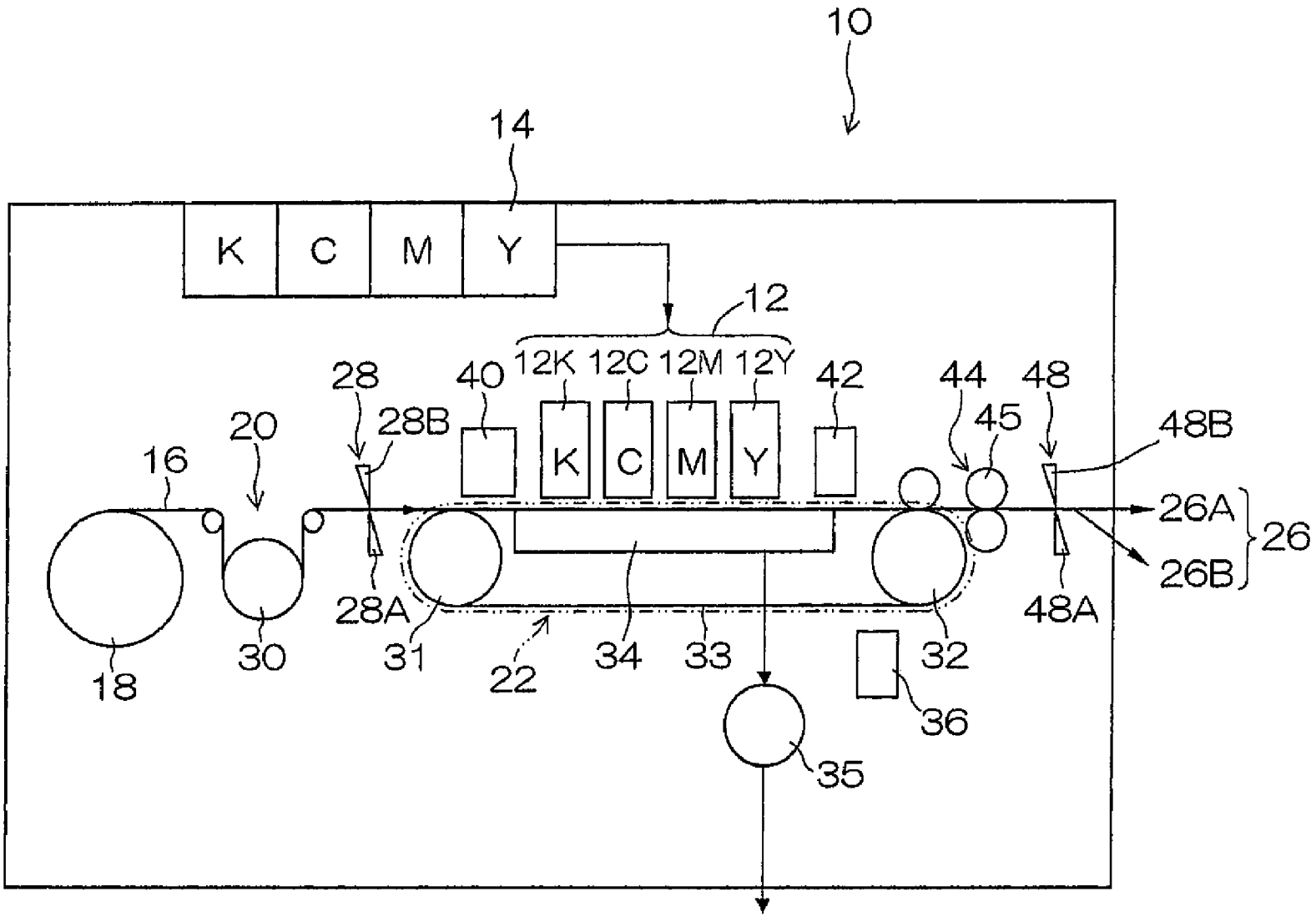
FIG. 1 is a general schematic drawing of an inkjet recording apparatus.

FIG. 1 is a general schematic drawing of an inkjet recording apparatus. As shown in FIG. 1, the inkjet recording apparatus 10 comprises: a print unit 12 having a plurality of inkjet recording heads (corresponding to "liquid ejection heads", hereinafter, called "heads") 12K, 12C, 12M and 12Y provided for ink colors of black (K), cyan (C), magenta (M), and yellow (Y), respectively; an ink storing and loading unit 14 for storing inks to be supplied to the heads 12K, 12C, 12M and 12Y; a paper supply unit 18 for supplying recording paper 16 forming a recording medium; a decurling unit 20 for removing curl in the recording paper 16; a belt conveyance unit 22, disposed facing the nozzle face (ink ejection face) of the print unit 12, for conveying the recording paper 16 while keeping the recording paper 16 flat; a print determination unit 24 for reading the printed result produced by the print unit 12; and a paper output unit 26 for outputting recorded recording paper (printed matter) to the exterior.

The ink storing and loading unit 14 has ink tanks for storing the inks of each color to be supplied to the heads 12K, 12C, 12M, and 12Y respectively, and the tanks are connected to the heads 12K, 12C, 12M, and 12Y by means of prescribed channels. The ink storing and loading unit 14 has a warning device (for example, a display device or an alarm sound generator) for warning when the remaining amount of any ink is low, and has a mechanism for preventing loading errors among the colors.

In FIG. 1, a magazine for rolled paper (continuous paper) is shown as an example of the paper supply unit 18; however, a plurality of magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording medium (media) can be used, it is preferable that a medium such as a bar code and a wireless tag containing information about the type of medium is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28.

The decurled and cut recording paper 16 is delivered to the belt conveyance unit 22. The belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the print unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction. It is also possible to use an electrostatic attraction method, instead of a suction-based attraction method.

The belt 33 is driven in the clockwise direction in FIG. 1 by the motive force of a motor 88 (shown in FIG. 6) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration of nipping with a brush roller and a water absorbent roller or the like, an air blow configuration of blowing clean air, or a combination of these.

Instead of the belt conveyance unit 22, it is also possible to adopt a mode which uses a roller nip conveyance mechanism, but when the print region is conveyed by a roller nip mechanism, the printed surface of the paper makes contact with the roller directly after printing, and hence there is a problem in that the image is liable to be blurred. Therefore, a suction belt conveyance mechanism which does not make contact with the image surface in the print region is desirable, as in the present example.

A heating fan 40 is disposed on the upstream side of the print unit 12 in the conveyance pathway formed by the belt conveyance unit 22. The heating fan 40 blows heated air onto the recording paper 16 to heat the recording paper 16 immediately before printing so that the ink deposited on the recording paper 16 dries more easily.

Figure 2A:
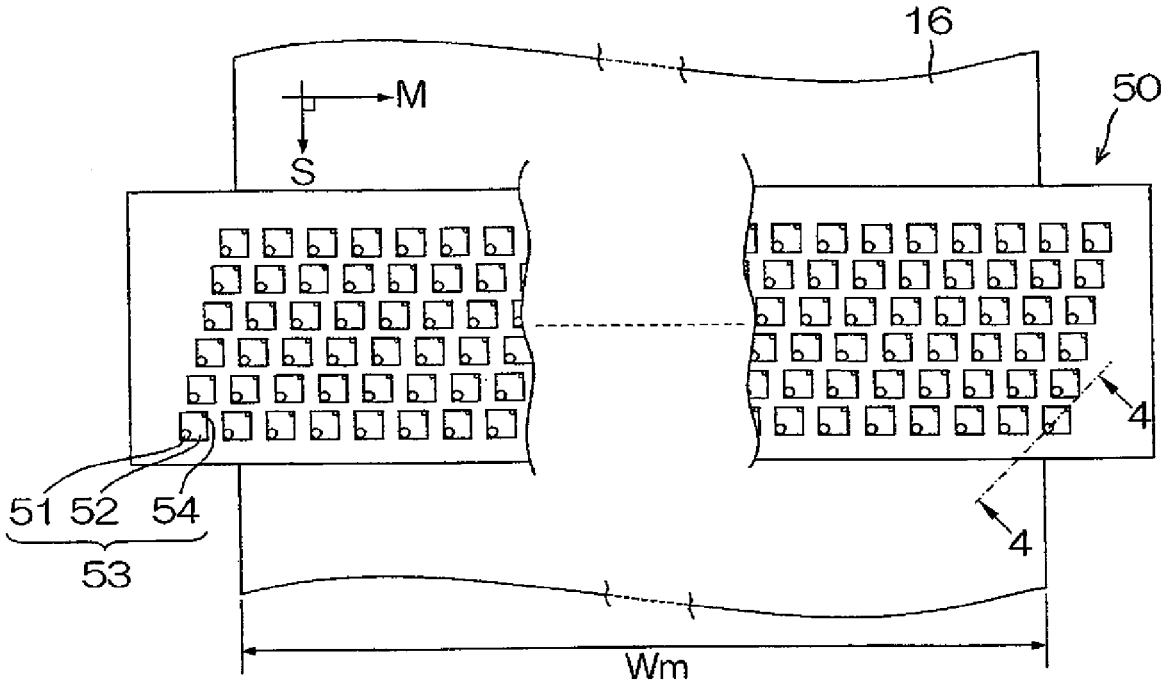
FIGS. 2A and 2B are plan view perspective diagrams showing an example of the composition of a print head.
Figure 2B:
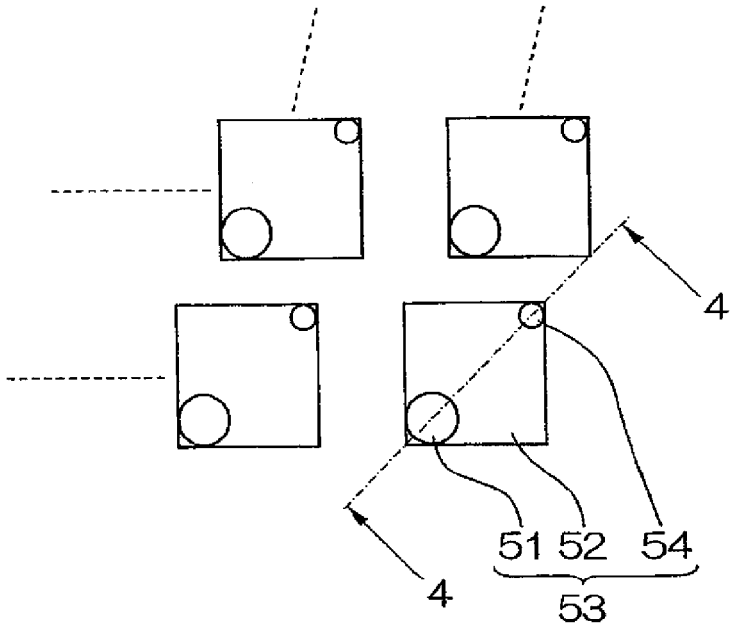

The heads 12K, 12C, 12M and 12Y of the print unit 12 are full line heads having a length corresponding to the maximum width of the recording paper 16 used with the inkjet recording apparatus 10, and comprising a plurality of nozzles for ejecting ink arranged on a nozzle face through a length exceeding at least one edge of the maximum-size recording medium (namely, the full width of the printable range) (see FIGS. 2A and 2B).

The print heads 12K, 12C, 12M and 12Y are arranged in color order (black (K), cyan (C), magenta (M), yellow (Y)) from the upstream side in the feed direction of the recording paper 16, and these respective heads 12K, 12C, 12M and 12Y are fixed extending in a direction substantially perpendicular to the conveyance direction of the recording paper 16.

A color image can be formed on the recording paper 16 by ejecting inks of different colors from the heads 12K, 12C, 12M and 12Y, respectively, onto the recording paper 16 while the recording paper 16 is conveyed by the belt conveyance unit 22.

By adopting a configuration in which the full line heads 12K, 12C, 12M and 12Y having nozzle rows covering the full paper width are provided for the respective colors in this way, it is possible to record an image on the full surface of the recording paper 16 by performing just one operation of relatively moving the recording paper 16 and the print unit 12 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

A post-drying unit 42 is disposed following the print unit 12. The post-drying unit 42 is a device to dry the printed image surface, and includes a heating fan, for example. It is preferable to avoid contact with the printed surface until the printed ink dries, and a device that blows heated air onto the printed surface is preferable.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. Although not shown in FIG. 1, the paper output unit 26A for the target prints is provided with a sorter for collecting prints according to print orders.

Structure of the Head

Next, the structure of a head will be described. The heads 12K, 12C, 12M and 12Y of the respective ink colors have the same structure, and a reference numeral 50 is hereinafter designated to any of the heads.

Figure 3:
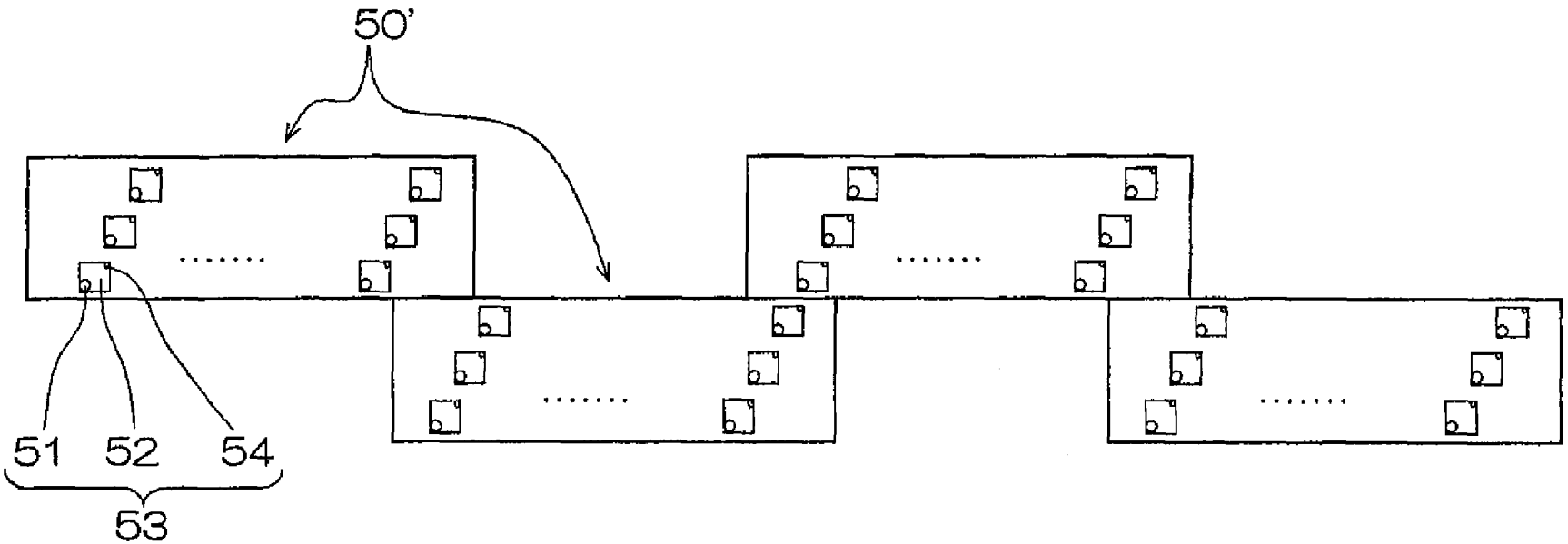
FIG. 3 is a plan view perspective diagram showing a further example of the composition of a full line head.
Figure 4:
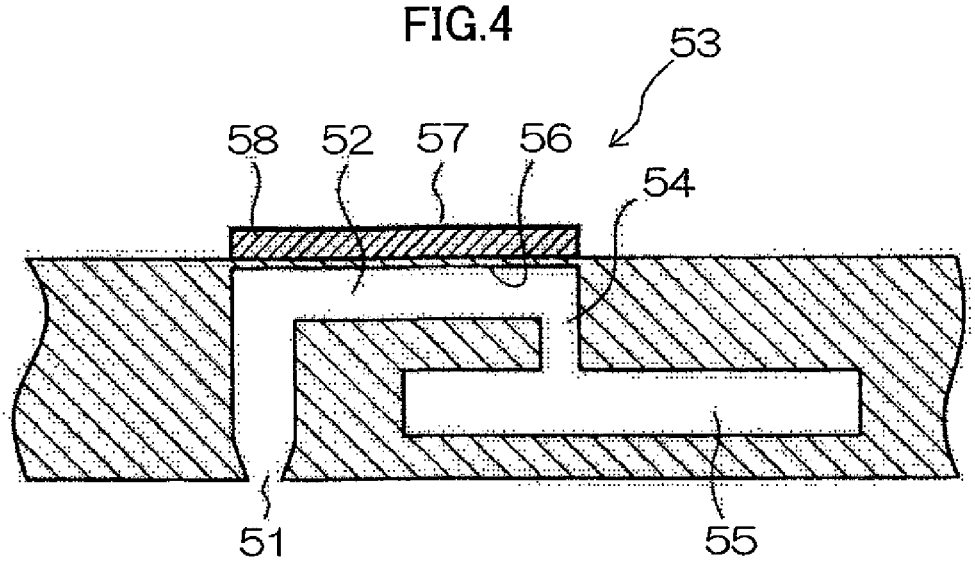
FIG. 4 is a cross-sectional view along line 4-4 in FIGS. 2A and 2B.

FIG. 2A is a plan view perspective diagram showing an example of the structure of a head 50, and FIG. 2B is an enlarged diagram of a portion of same. Furthermore, FIG. 3 is a plan view perspective diagram (a cross-sectional view along the line 4-4 in FIGS. 2A and 2B) showing another example of the structure of the head 50, and FIG. 4 is a cross-sectional diagram showing the three-dimensional composition of the liquid droplet ejection element corresponding to one channel which forms a unit recording element (namely, an ink chamber unit corresponding to one nozzle 51).

The nozzle pitch in the head 50 should be minimized in order to maximize the density of the dots printed on the surface of the recording paper 16. As shown in FIGS. 2A and 2B, the head 50 according to the present embodiment has a structure in which a plurality of ink chamber units (droplet ejection elements) 53, each comprising a nozzle 51 forming an ink ejection port, a pressure chamber 52 corresponding to the nozzle 51, and the like, are disposed two-dimensionally in the form of a staggered matrix, and hence the effective nozzle interval (the projected nozzle pitch) as projected (orthogonal projection) in the lengthwise direction of the head (the direction perpendicular to the paper conveyance direction) is reduced and high nozzle density is achieved.

The mode of forming nozzle rows with a length not less than a length corresponding to the entire width Wm of the recording paper 16 in a direction (the direction of arrow M; main-scanning direction) substantially perpendicular to the conveyance direction (the direction of arrow S; sub-scanning direction) of the recording paper 16 is not limited to the example described above. For example, instead of the configuration in FIG. 2A, as shown in FIG. 3, a line head having nozzle rows of a length corresponding to the entire width of the recording paper 16 can be formed by arranging and combining, in a staggered matrix, short head modules 50' having a plurality of nozzles 51 arrayed in a two-dimensional fashion.

As shown in FIGS. 2A and 2B, the planar shape of the pressure chamber 51 provided corresponding to each nozzle 52 is substantially a square shape, and an outlet port to the nozzle 51 is provided at one of the ends of a diagonal line of the planar shape, while an inlet port (supply port) 54 for supplying ink is provided at the other end thereof. The shape of the pressure chamber 52 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like.

As shown in FIG. 4, each pressure chamber 52 is connected to a common channel 55 through the supply port 54. The common channel 55 is connected to an ink tank (not shown in Figures), which is a base tank that supplies ink, and the ink supplied from the ink tank is delivered through the common flow channel 55 to the pressure chambers 52.

An actuator 58 provided with an individual electrode 57 is bonded to a pressure plate (a diaphragm that also serves as a common electrode) 56 which forms the surface of one portion (in FIG. 4, the ceiling) of the pressure chambers 52. When a drive voltage is applied to the individual electrode 57 and the common electrode, the actuator 58 deforms, thereby changing the volume of the pressure chamber 52. This causes a pressure change which results in ink being ejected from the nozzle 51. For the actuator 58, it is possible to adopt a piezoelectric element using a piezoelectric body, such as lead zirconate titanate, barium titanate, or the like. When the displacement of the actuator 58 returns to its original position after ejecting ink, the pressure chamber 52 is replenished with new ink from the common channel 55 via the supply port 54.

By controlling the driving of the actuators 58 corresponding to the nozzles 51 in accordance with the dot arrangement data generated from the input image, it is possible to eject ink droplets from the nozzles 51. By controlling the ink ejection timing of the nozzles 51 in accordance with the speed of conveyance of the recording paper 16, while conveying the recording paper in the sub-scanning direction at a uniform speed, it is possible to record a desired image on the recording paper 16.

Figure 5:
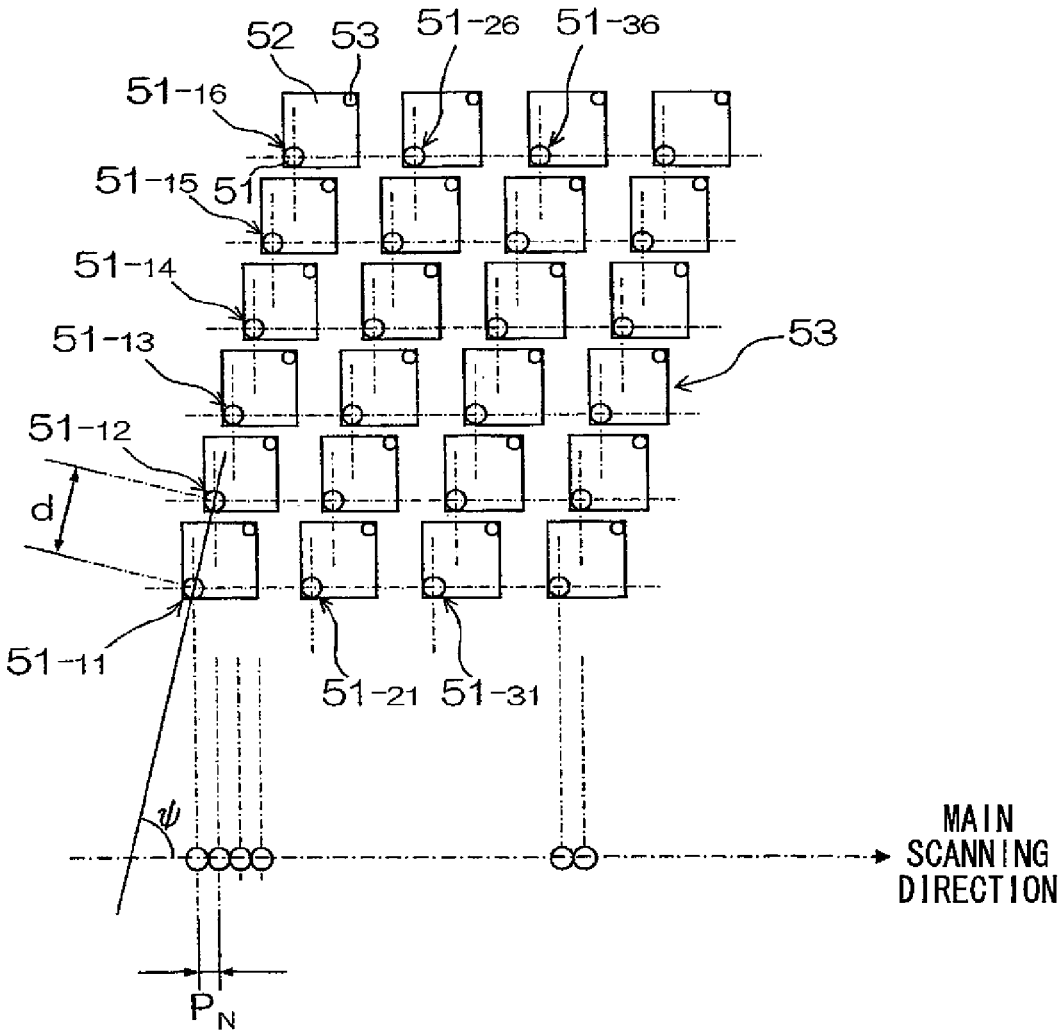
FIG. 5 is an enlarged diagram showing an example of the arrangement of nozzles in a head.

As shown in FIG. 5, the high-density nozzle head according to the present embodiment is achieved by arranging obliquely a plurality of ink chamber units 53 having the above-described structure in a lattice fashion based on a fixed arrangement pattern, in a row direction which coincides with the main scanning direction, and a column direction which is inclined at a fixed angle of $\theta$ with respect to the main scanning direction, rather than being perpendicular to the main scanning direction.

More specifically, by adopting a structure in which a plurality of ink chamber units 53 are arranged at a uniform pitch d in line with a direction forming an angle of $\psi$ with respect to the main scanning direction, the pitch PN of the nozzles projected so as to align in the main scanning direction is $d \times \cos \psi$, and hence the nozzles 51 can be regarded to be substantially equivalent to those arranged linearly at a fixed pitch P along the main scanning direction. Such configuration results in a nozzle structure in which the nozzle row projected in the main scanning direction has a high nozzle density of up to 2,400 nozzles per inch.

In a fall-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in, for example, following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The direction indicated by one line (or the lengthwise direction of a band-shaped region) recorded by main scanning as described above is called the "main scanning direction", and the direction in which sub-scanning is performed, is called the "sub-scanning direction". In other words, in the present embodiment, the conveyance direction of the recording paper 16 is called the sub-scanning direction and the direction perpendicular to same is called the main scanning direction.

In implementing the present invention, the arrangement of the nozzles is not limited to that of the example illustrated. Moreover, a method is employed in the present embodiment where an ink droplet is ejected by means of the deformation of the actuator 58, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Description of Control System

Figure 6:
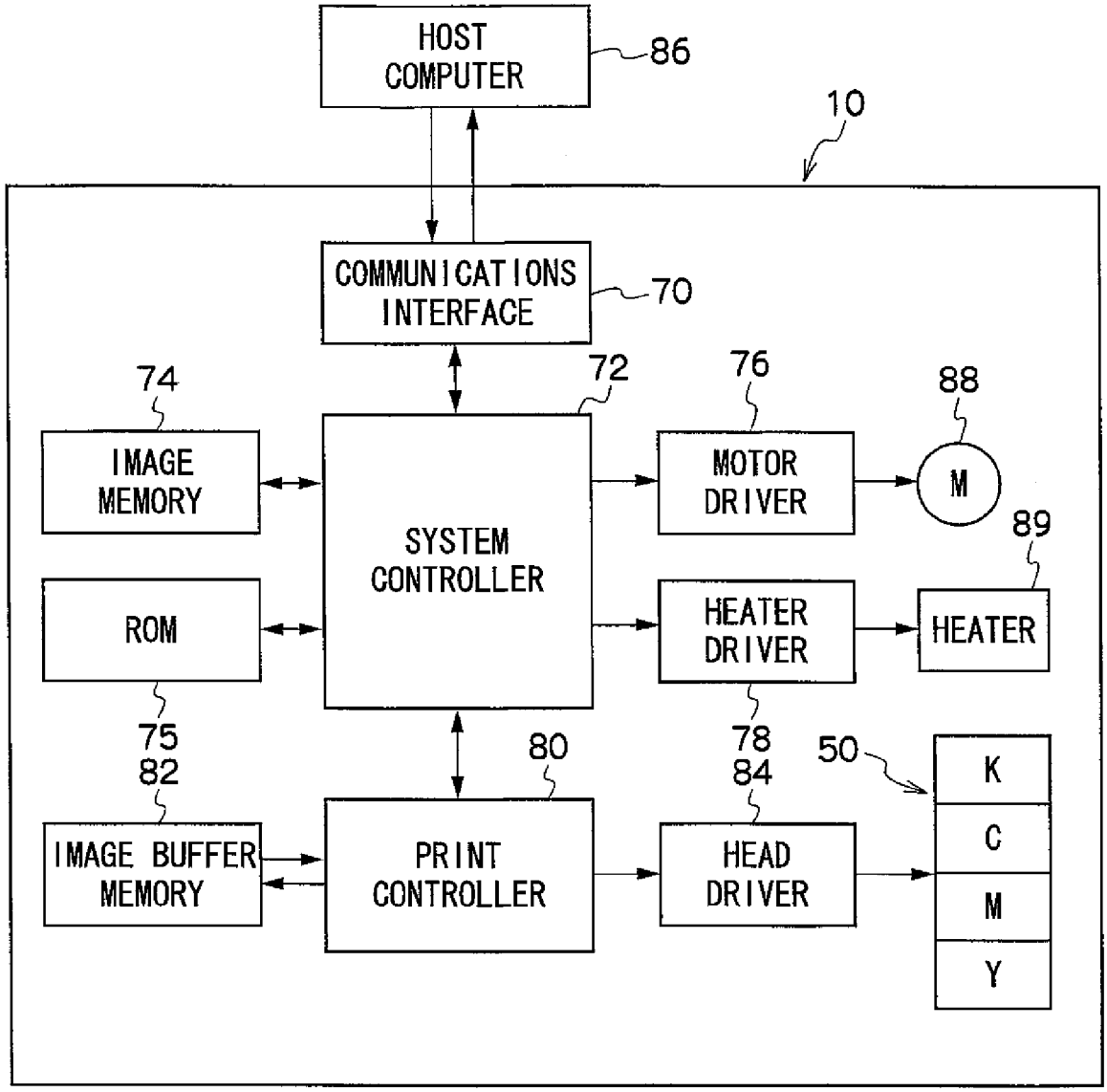
FIG. 6 is a block diagram showing the system composition of the inkjet recording apparatus.

FIG. 6 is a block diagram showing the system configuration of the inkjet recording apparatus 10. As shown in FIG. 6, the inkjet recording apparatus 10 comprises a communication interface 70, a system controller 72, an image memory 74, a ROM 75, a motor driver 76, a heater driver 78, a print controller 80, an image buffer memory 82, a head driver 84, and the like.

The communication interface 70 is an interface unit (image input unit) for receiving image data sent from a host computer 86. A serial interface such as USB (Universal Serial Bus), IEEE1394, Ethernet (registered trademark), wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is stored temporarily in the image memory 74. The image memory 74 is a storage device for storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74 and ROM 75, and it also generates control signals for controlling the motor 88 and heater 89 of the conveyance system.

The program executed by the CPU of the system controller 72 and the various types of data which are required for control procedures are stored in the ROM 75. The ROM 75 may be a non-writeable storage device, or it may be a rewriteable storage device, such as an EEPROM. The image memory 74 is used as a temporary storage region for the image data, and it is also used as a program development region and a calculation work region for the CPU.

The motor driver (drive circuit) 76 drives the motor 88 of the conveyance system in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data (original image data) stored in the image memory 74 in accordance with commands from the system controller 72 so as to supply the generated print data (dot data) to the head driver 84.

The print controller 80 is provided with the image buffer memory 82; and image data, parameters, and other data are temporarily stored in the image buffer memory 82 when image data is processed in the print controller 80. The aspect shown in FIG. 6 is one in which the image buffer memory 82 accompanies the print controller 80; however, the image memory 74 may also serve as the image buffer memory 82. Also possible is an aspect in which the print controller 80 and the system controller 72 are integrated to form a single processor.

To give a general description of the sequence of processing from image input to print output, image data to be printed (original image data) is input from an external source via a communications interface 70, and is accumulated in the image memory 74. At this stage, RGB image data is stored in the image memory 74, for example.

In this inkjet recording apparatus 10, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal gradations of the image (namely, the light and shade toning of the image) as faithfully as possible. Therefore, original image data (RGB data) stored in the image memory 74 is sent to the print controller 80 through the system controller 72, and is converted to the dot data for each ink color by a half-toning technique, using a threshold value matrix, error diffusion, or the like, in the print controller 80.

In other words, the print controller 80 performs processing for converting the input RGB image data into dot data for the four colors of K, C, M and Y. The dot data generated by the print controller 180 in this way is stored in the image buffer memory 82.

The head driver 84 outputs a drive signal for driving the actuators 58 corresponding to the nozzles 51 of the head 50, on the basis of print data (in other words, dot data stored in the image buffer memory 182) supplied by the print controller 80. A feedback control system for maintaining constant drive conditions in the head may be included in the head driver 84.

By supplying the drive signal output by the head driver 84 to the head 50, ink is ejected from the corresponding nozzles 51. By controlling ink ejection from the print heads 50 in synchronization with the conveyance speed of the recording paper 16, an image is formed on the recording paper 16.

As described above, the ejection volume and the ejection timing of the ink droplets from the respective nozzles are controlled via the head driver 84, on the basis of the dot data generated by implementing prescribed signal processing in the print controller 80, and the drive signal waveform. By this means, prescribed dot sizes and dot positions can be achieved.

Furthermore, the print controller 80 carries out various corrections with respect to the head 50, on the basis of information on the dot deposition positions and dot diameters (ink volume) acquired by the dot measurement method described below, and information on the determination of satellites and dirt and dust, and furthermore, it implements control for carrying out cleaning operations (nozzle restoration operations), such as preliminary ejection or suctioning, or wiping, according to requirements.

Overview of Dot Measurement Method

In order to gain an overall understanding of the dot measurement technology according to embodiments of the present invention, firstly, an overview of this technology will be described. In broad terms, the dot measurement method according to the present embodiment is carried out by means of the procedure described below (steps 1 to 8).

(Step 1): Droplets of ink which are to form the measurement object are ejected and deposited on a recording paper from the nozzles of an inkjet head, while moving the head and the recording paper relatively with respect to each other, and a line pattern created by a row of dots corresponding to respective nozzles is formed on the recording paper by the ink droplets ejected from the nozzles. In other words, a sample chart (measurement chart) is formed of the line patterns created by droplets of an ink for which the measurements are carried out.

There is no particular restriction on the timing at which this measurement chart is formed, and it may be formed at a variety of timings, such as when the head is installed, whenever there is a change in the droplet deposition positions which cannot be restored by a maintenance operation, when a prescribed time period has elapsed, or upon inspection at the start of operation, depending on assembling combinations of the head and the maintenance unit.

(Step 2): An image of the line pattern is captured in such a manner that the direction of the lattice of pixels in the captured image forms a prescribed angle (and desirably, an angle between 1° and 30°) with respect to the line direction of the line pattern formed in step 1 (this line direction corresponds to the sub-scanning direction when using a page-wide full-line head, and here is taken to be "direction S"), and electronic image data for the captured image (the image obtained by reading in the line pattern) is acquired.

(Step 3): The captured image (electronic image data) acquired by reading in the line pattern at step 2 is taken and the acquired image data is scanned in the pixel lattice direction of the captured image, which traverses (intersects with) the line patterns corresponding to the respective nozzles, thereby acquiring a plurality of profile graphs, each representing the variation in the image signal value of the one-dimensional pixel arrangement in this scanning direction, in respect of one line pattern.

(Step 4): In each of the plurality of profile graphs which correspond to one line pattern obtained at step 3, the peak position which corresponds to the density center of the line pattern in that profile (which is equivalent to the "extreme value position"; in a case where white corresponds to the maximum value, then this corresponds to the "trough position", but in order to simplify the description, this is referred to simply as "peak position" in all cases), and the left and right-hand edge positions of the line pattern (which is equivalent to the "first edge position" and the "second edge position"), are calculated accordingly. There are two edges of the line pattern in the breadthways direction, on the left and right-hand sides, and in the profile graph, the positions at which the signal value assumes a prescribed graduated tone value corresponding to an edge are judged to be edge positions.

Desirably, the edge positions and the peak position are calculated by using a commonly known interpolation technique on the basis of the one-dimensional pixel lattice positions and the signal values (graduated tone values), and hence the edge positions and the peak positions are calculated with greater accuracy than the interval between positions (pixel pitch) in the one-dimensional pixel lattice in the profile graph. In this way, a peak position and two edge positions are calculated for each of the profile graphs corresponding to one line pattern.

(Step 5): The data on the peak positions and the edge positions obtained respectively from the plurality of profile graphs corresponding to the one line pattern in step 4 is gathered, and an approximation line corresponding to the peak positions of the one line pattern, and an approximation line corresponding to the edge positions (left- and right-hand positions) are calculated, by using a least-square method.

(Step 6): Using the two approximation lines corresponding to the left and right-hand edge positions relating to the one line pattern, the perpendicular distance between these two straight lines is calculated and this perpendicular distance is taken as the line width of the line pattern in question. Furthermore, using the approximation lines corresponding to the peak positions of the respective line patterns, the interval between line patterns (the distance between mutually adjacent line patterns) is calculated from the perpendicular distance between the approximation lines corresponding to the peak positions of mutually adjacent line patterns.

(Step 7): On the other hand, the relationship (correlation) between the dot diameter and the line width is previously determined in accordance with the combination of the prescribed ink and the recording paper, and furthermore, the relationship between the ejected droplet volume and the dot diameter is also determined previously, and this correlation data is beforehand stored (in the form of a correspondence table, or the like) in a storage device, such as a memory.

(Step 8): The corresponding dot diameter (ink volume) is calculated from the line width of the line pattern calculated in step 6, on the basis of the relationship between the line width and the dot diameter (ink volume) previously determined in step 7. Furthermore, the relative droplet deposition positions of the respective nozzles are calculated from the line pattern interval calculated at step 6.

In this way, according to the present embodiment, since the dot diameter (ink volume) and the dot deposition positions can be calculated simultaneously on the basis of one captured image of a sample chart containing line patterns, then a beneficial effect is obtained in reducing the number of images to be captured. Furthermore, since the dot diameter is calculated on the basis of the line patterns, it is not necessary to calculate the surface areas of isolated dots by capturing distinct images of the isolated dots, as in the related art, and therefore it is possible to use an imaging apparatus having relatively low resolution.

Below, the dot measurement method according to the present embodiment is described in more detail.

1. Description of the Line Patterns in the Sample Chart

Figure 7:
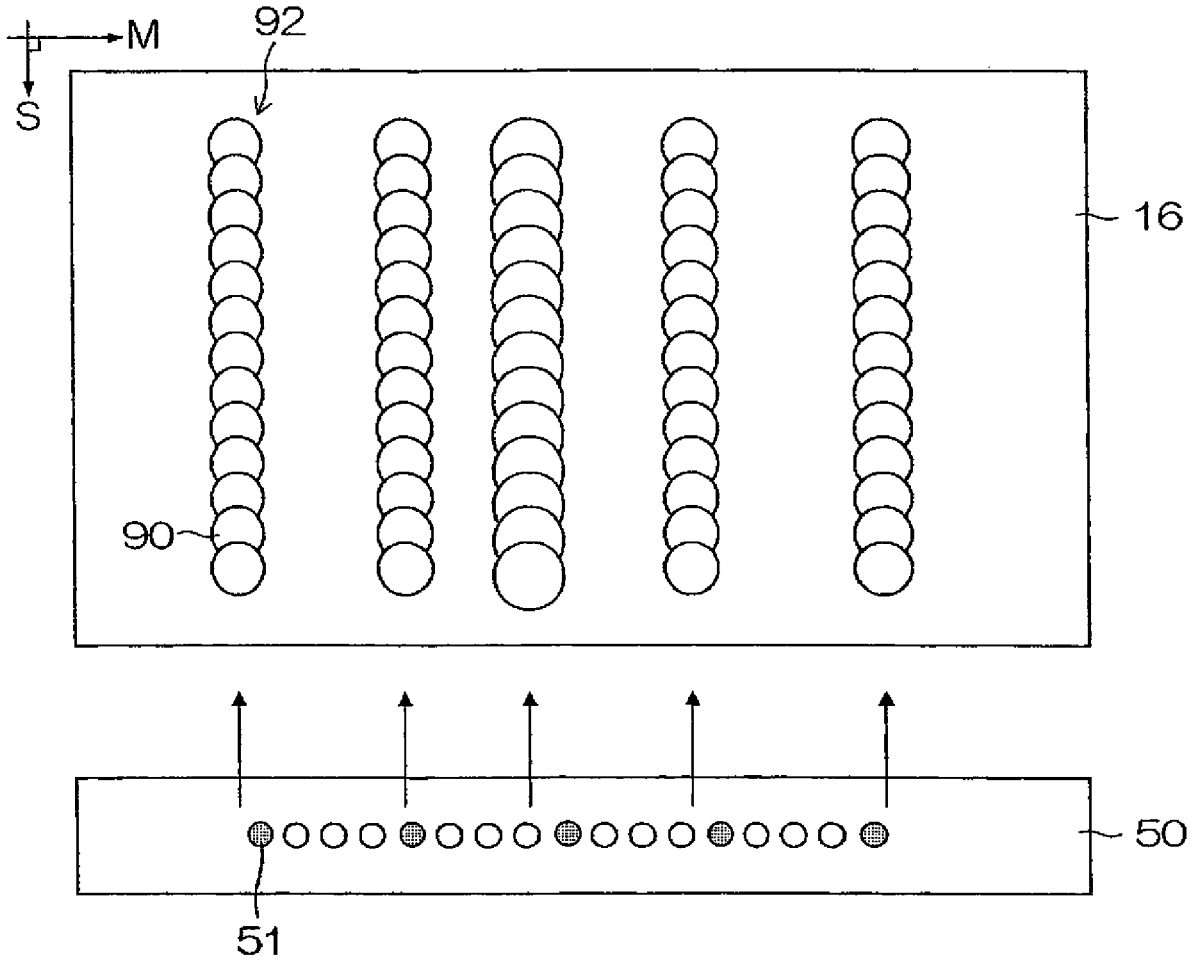
FIG. 7 is a schematic drawing showing irregularities in line patterns caused by nozzle characteristics.

FIG. 7 is a schematic drawing showing an example of the line patterns formed on the recording paper by means of an inkjet head. In FIG. 7, the vertical direction (sub-scanning direction) indicated by the arrow S represents the conveyance direction of the recording paper, and the lateral direction (the main scanning direction) indicated by the arrow M, which is perpendicular to the direction S, represents the longitudinal direction of the head 50. In FIG. 7, in order to simplify the description, a head having a plurality of nozzles aligned in one row is shown as an example, but as described in FIG. 3, it is also possible to employ a matrix head in which a plurality of nozzles are arranged two-dimensionally. In other words, a group of nozzles arranged in a two-dimensional configuration can be treated as being substantially equivalent to a nozzle configuration in a single row, by considering the effective nozzle row formed by projecting the nozzles normally to a straight line in the main scanning direction.

By conveying the recording paper 16 while ejecting liquid droplets from the nozzles 51 of the head 50 toward the recording paper 16, ink droplets deposit on the recording paper 16, and as shown in FIG. 7, dot rows (line patterns 92) are formed which include dots 90 formed by the ink droplets deposited from the nozzles 51, arranged in the form of lines.

FIG. 7 shows an example of line patterns formed on a sheet of recording paper 16 when there is fluctuation in the deposition positions and ink volume of the actually ejected ink droplets, in relation to the regular nozzle arrangement in the head 50.

Each of the line patterns 92 is formed by droplets ejected from corresponding one of the nozzles. In the case of a line head having a high recording density, when droplets are ejected simultaneously from all of the nozzles, the dots created by mutually adjacent nozzles overlap partially with each other, and therefore single dot lines are not formed. In order that the respective line patterns 92 do not overlap with each other, it is desirable to leave a space of at least one nozzle, and more desirably, three or more nozzles, between the nozzles which perform ejection simultaneously.

FIG. 7 shows an example in which a space of three nozzles is left. The respective line patterns reflect the characteristics of the corresponding nozzles, and due to the characteristics of the individual nozzles, variation occurs in the deposition position (dot position) or the dot diameter, giving rise to irregularity in the line pattern.

Figure 8:
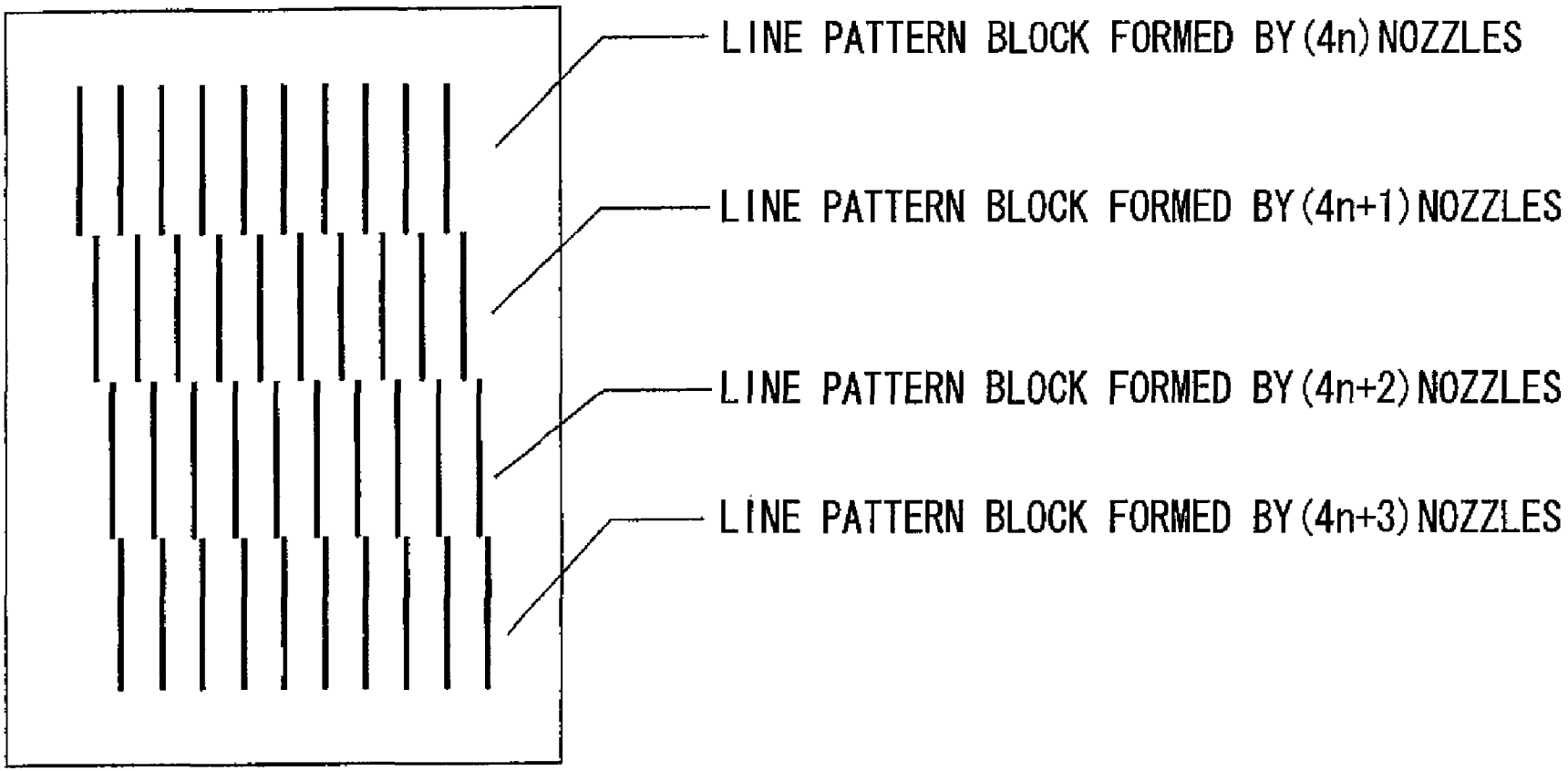
FIG. 8 is a diagram showing a first example of a measurement sample chart.

In order to obtain a line pattern for all of the nozzles 51 in the head 50, for example, a sample chart such as that shown in FIG. 8 is formed. In other words, if a spacing of three nozzles is applied in order to avoid mutual overlapping between the line patterns and if nozzle numbers i (i=1, 2, 3, . . . ) are assigned to all of the nozzles from the end of the nozzle row in the head 50, then a sample chart shown in FIG. 8 is created in which line patterns constituted of four blocks are formed. The four blocks shown in FIG. 8 include: a block in which a plurality of line patterns are formed in a direction perpendicular to the conveyance direction by means of the nozzles having nozzle numbers corresponding to multiples of four (i.e., i=4, 8, . . . ); a block in which a plurality of line patterns are formed in a direction perpendicular to the conveyance direction by means of the nozzles having nozzle numbers corresponding to multiples of four plus 1 (i.e., i=5, 9, . . . ); a block in which a plurality of line patterns are formed in a direction perpendicular to the conveyance direction by means of the nozzles having nozzle numbers corresponding to multiples of four plus 2 (i.e., i=6, 10, . . . ); and a block in which a plurality of line patterns are formed in a direction perpendicular to the conveyance direction by means of the nozzles having nozzle numbers corresponding to multiples of four plus 3 (i.e., i=7, 11, . . . ). By this means, it is possible to obtain a line pattern for each of the nozzles.

More specifically, if nozzle numbers are assigned to the nozzles in sequence from the end of the line head in the main scanning direction, to each of the nozzles which constitute the effective row of nozzles aligned in one row in the main scanning direction (the effective nozzle row obtained by normal projection), then taking n to be an integer of 0 or above, the respective line patterns are formed by shifting the droplet ejection timings respectively for each group (block) of nozzle numbers, $4n$, $4n+1$, $4n+2$, $4n+3$, for example.

Figure 24:
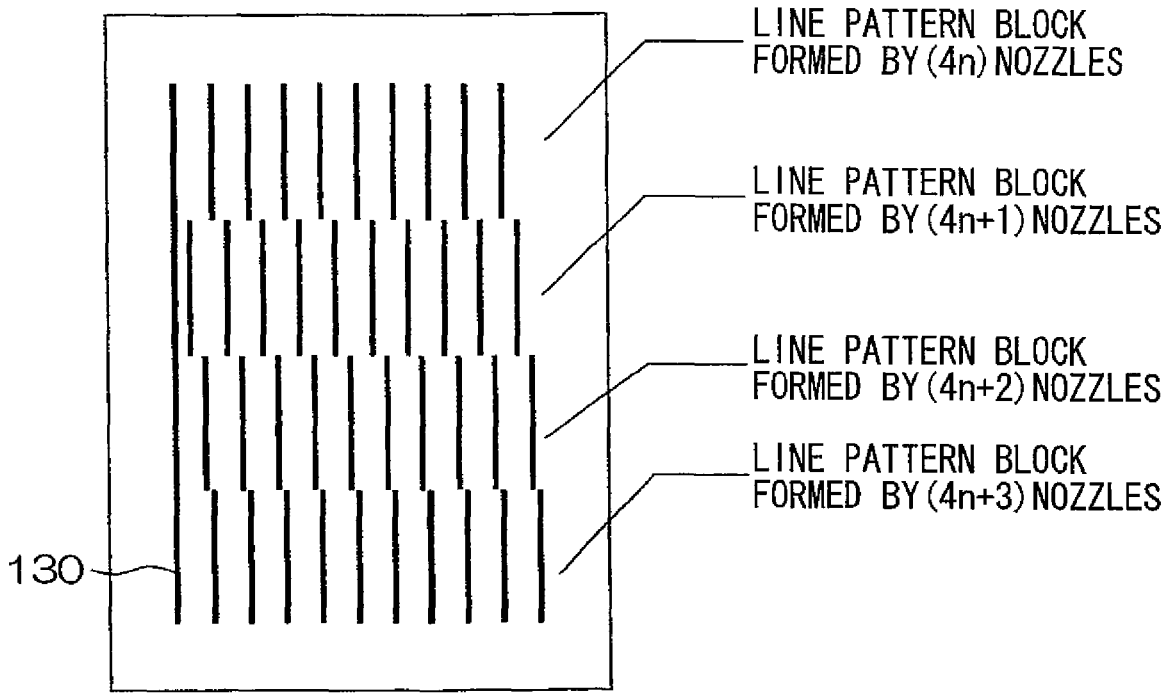
FIG. 24 is a diagram showing a second example of a measurement sample chart.
Figure 25:
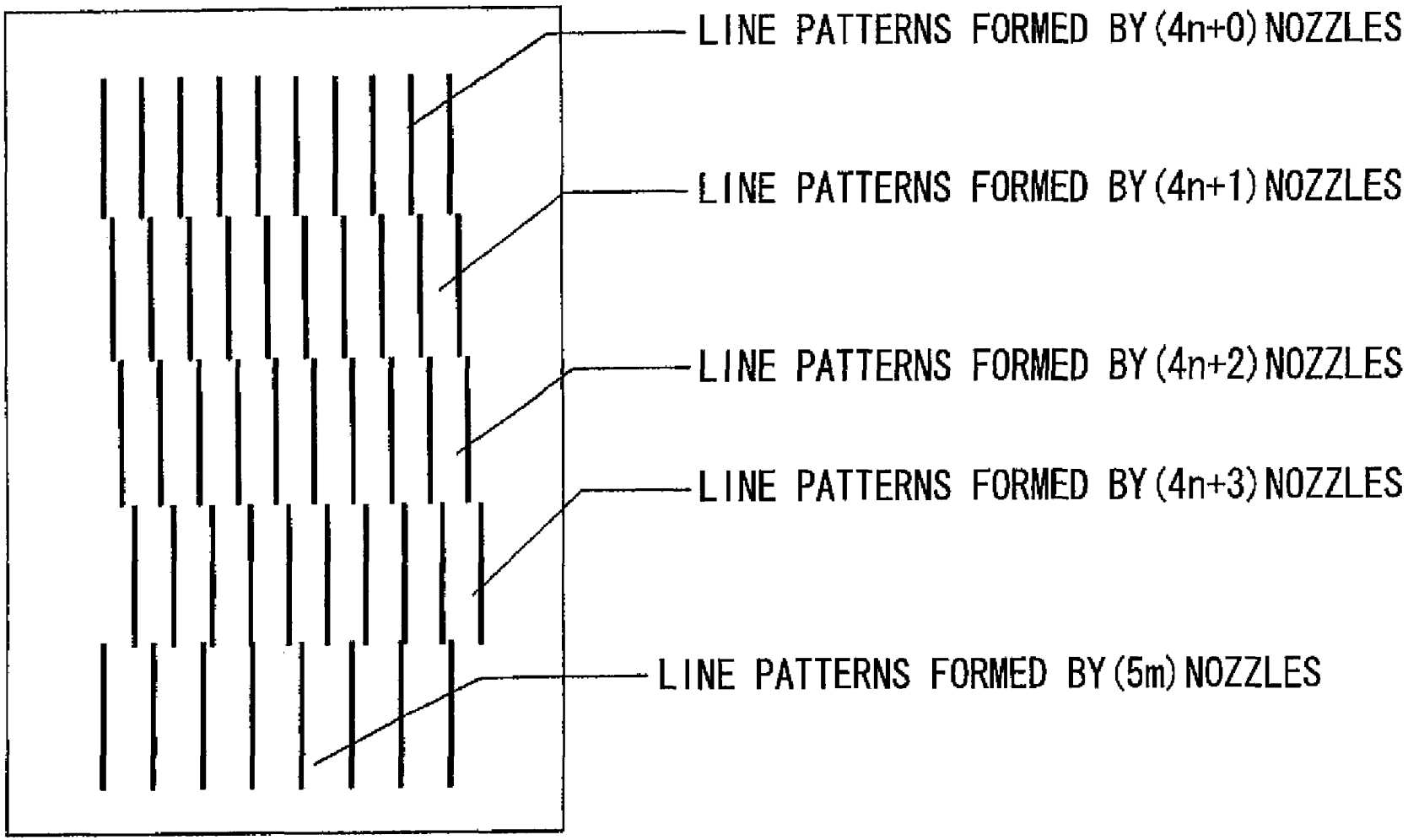
FIG. 25 is a diagram showing a third example of a measurement sample chart.
Figure 26:
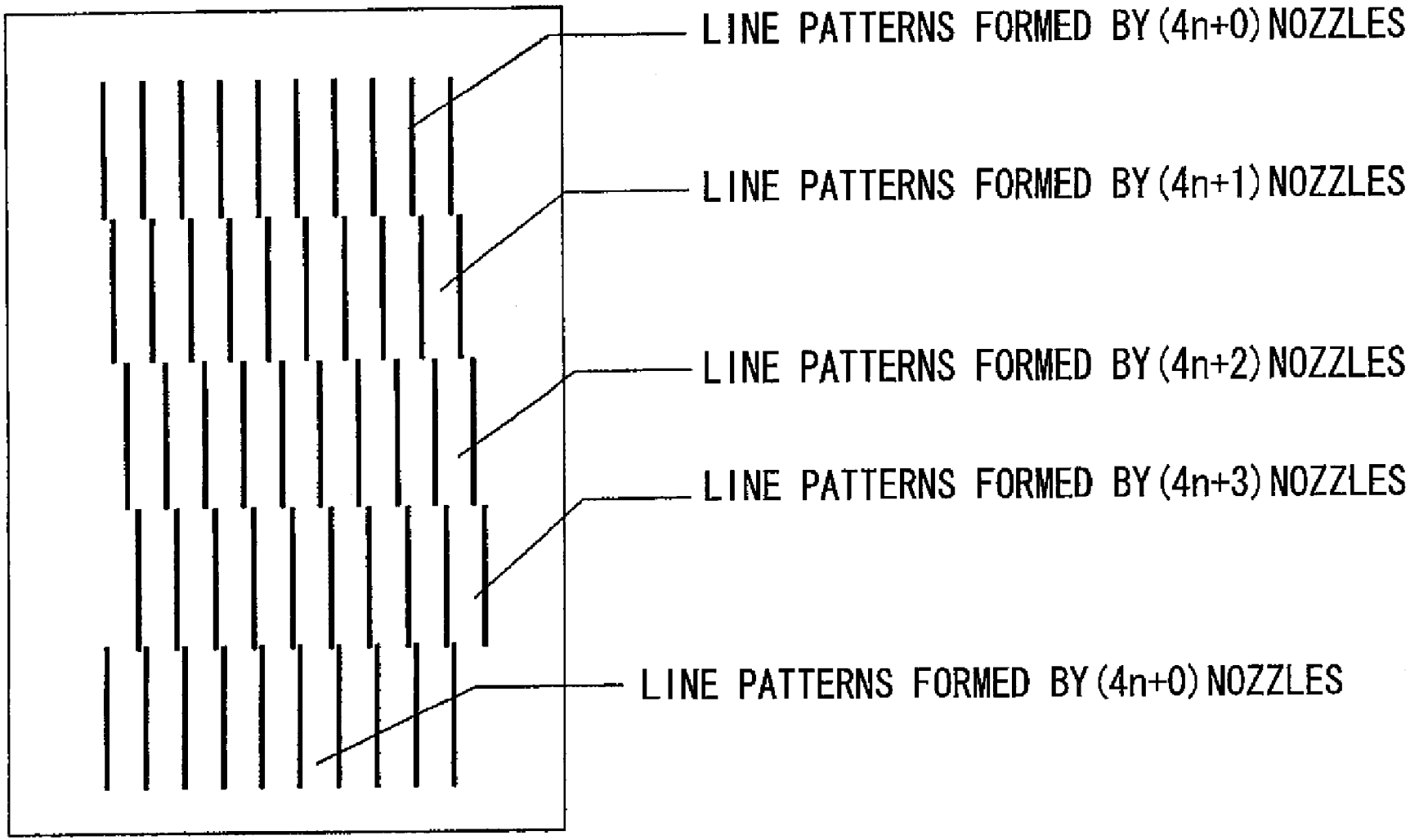
FIG. 26 is a diagram showing a fourth example of a measurement sample chart.

Consequently, as shown in FIG. 8, it is possible to form independent lines (which do not overlap with other lines), for all of the nozzles, without any mutual overlapping between the line patterns of the respective blocks, or between the lines within the same block. Another example of a sample chart devised in order to raise the determination accuracy of the positions between different blocks, in comparison with the positional accuracy of the image reading apparatus, will be described later (FIGS. 24 to 26).

2. Reading in Sample Chart (Imaging at an Oblique Angle)

When reading in the sample chart "A" comprising a plurality of line patterns formed as described above, by means of an image reading apparatus, the photoreceptor element row of the imaging apparatus reads in the image in an oblique direction which forms a prescribed angle (an angle of $0° < \gamma < 90°$; and desirably an angle in the range of 1° to 30°), with respect to the line pattern.

Figure 9:
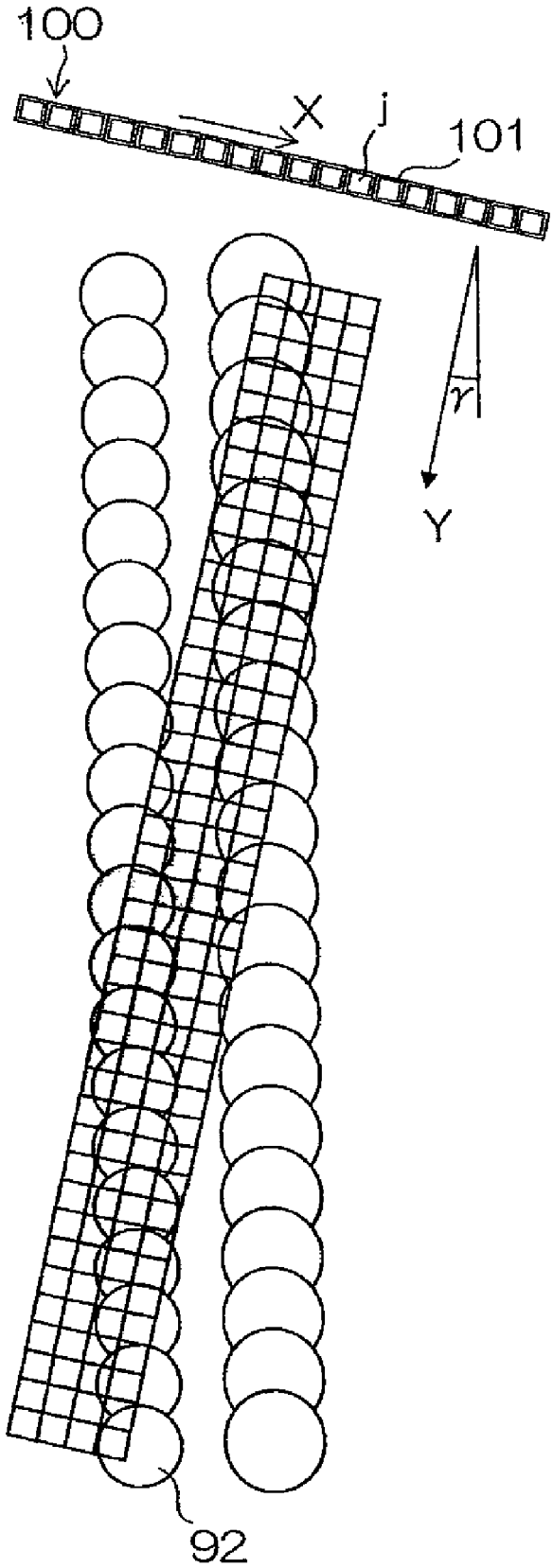
FIG. 9 is a diagram showing the relationship between a line sensor and a line pattern.

FIG. 9 is a diagram showing an example where a line sensor (linear image sensor) 100 is used as an imaging apparatus. Here, in order to simplify the description, the photoreceptor elements (photoelectric transducing elements) 101 are aligned in one row, but in actual practice, a three-line sensor having respective photoreceptor element rows for red (R), green (G) and blue (B) which are equipped with filters of the respective colors, (a so-called RGB line sensor) may be used. The photoreceptor surface of this line sensor 100 is disposed in parallel with the reading surface of the object of which an image is being captured (the surface of the recording paper on which the sample chart 92 has been recorded), and the photoreceptor element row is disposed at a prescribed non-perpendicular oblique angle with respect to the line patterns 92 on the recording paper.

By capturing an image while moving at least one of the recording paper on which the line patterns 92 have been formed, and the line sensor 100, in a direction (the direction indicated by arrow Y in FIG. 9) which is perpendicular to the direction (i.e., the X direction in FIG. 9) of the photoreceptor element row of the line sensor 100, then the whole surface of the sample chart (all of the line patterns) is read in as electronic image data.

By moving the photoreceptor element row of the line sensor 100 and the line patterns 92 of the recording paper relatively in one axis direction, which is indicated by arrow Y in FIG. 9, then looking in particular at the photoreceptor element (one photoreceptor element) at a certain position j in the line sensor 100, this j-th photoreceptor element moves so as to traverse the line pattern 92 obliquely as a result of the relative movement in the Y direction. Since all of the photoreceptor elements in the line sensor 100 moves (traverses) obliquely with respect to the line direction of the line patterns, then as shown in FIG. 10, the reading operation results in electronic image data (captured image) formed by a lattice-shaped pixel arrangement which intersects obliquely with the line patterns 92.

Figure 10:
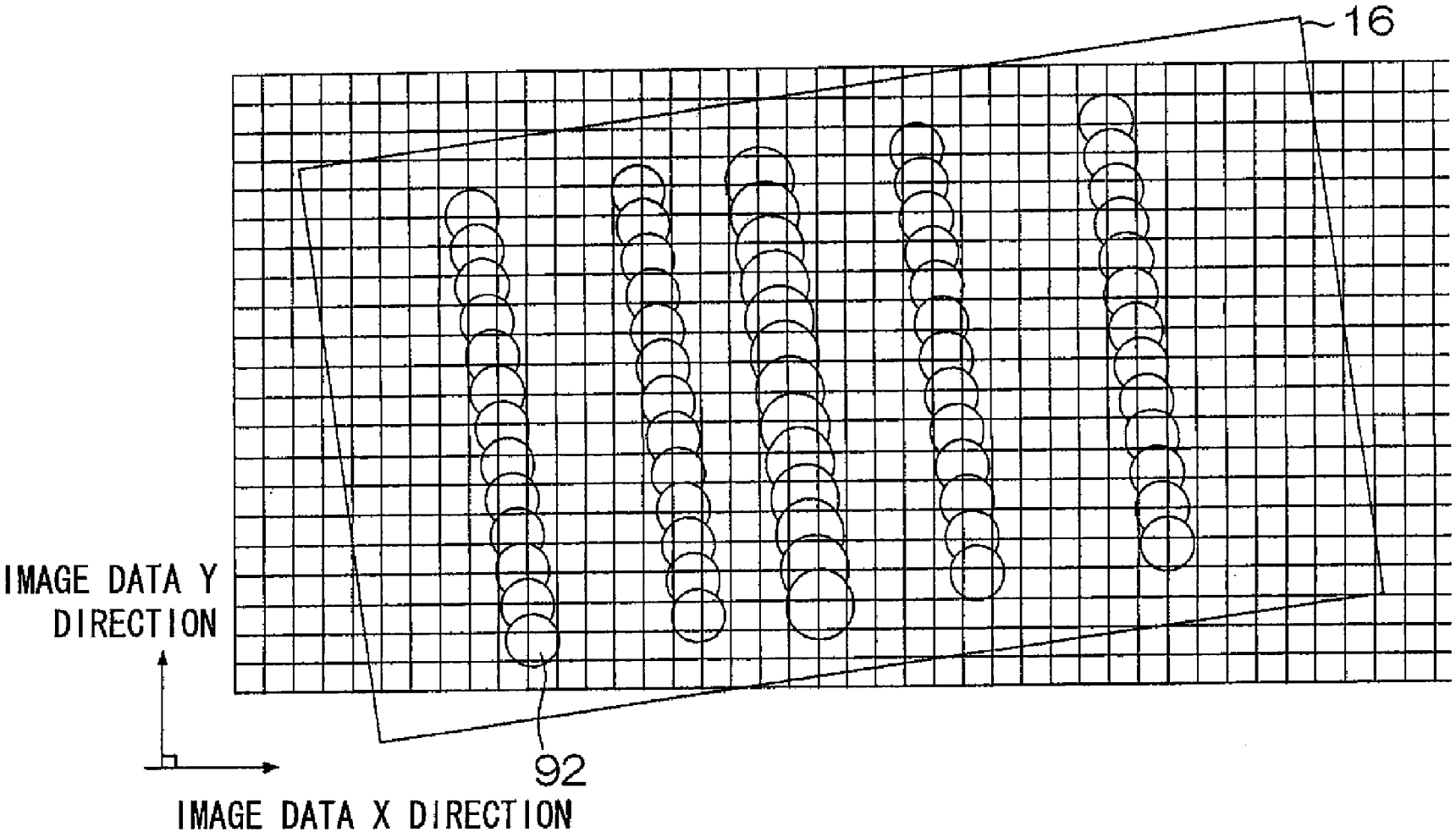
FIG. 10 is a diagram showing the positional relationship between a sample chart and the pixel pattern of a captured image.

FIG. 10 is a schematic drawing showing an example of the positional relationship between the pixel positions (image reading lattice positions) and the position of the sample chart, in the image data which is acquired as described above. In FIG. 10, the ratio of the size of the pixels (cells) of the image data to the size of the dots does not necessarily reflect the actual size ratio, and in order to simplify the description, the pixel units are depicted at a larger size than their actual size (the same applies to other drawings).

As shown in FIG. 10, the pixels of the image data are arranged in a square lattice configuration and the line patterns 92 on the recording paper 16 are captured in images so that they obliquely traverse the lattice of pixels. The lateral direction in FIG. 10 is the X axis and the vertical direction which is perpendicular to the X axis is the Y axis. The pixel lattice positions in the image data are expressed by the position (X, Y) in the X-Y coordinate. The respective pixels in the electronic image data obtained in the imaging step have signal values (graduated tone values) which reflect the optical density of the measurement object (in this case, the density of the line patterns).

In this way, the sample chart of the line patterns formed on the recording paper 16 is read in by the imaging apparatus of the image reading apparatus, and converted into electronic image data. Desirably, the image resolution in this case is 1200 dpi (dots per inch) or above.

3. Analysis of Captured Image Data

The image data thus read in is analyzed in accordance with the colors corresponding to the types of ink. With regard to the relationship between the ink colors and the processing channels (colors, RGB), a color (processing channel) for which the greatest contrast is obtained, is selected from the channels RGB for each respective ink. In other words, desirably, analysis is carried out by using the R signal in the case of cyan ink, the G signal in the case of magenta ink, the B signal in the case of yellow ink, and the G signal in the case of black ink. Channels for other special colors should be selected from ROB, depending on the channel which produces the greatest contrast. Conversely, in the judgement of dirt and dust described below, it is desirable to use the signal of the color (channel) which produces the lowest contrast in respect of the ink under measurement. If contrast of a similar level is obtained for a plurality of channels, then the color producing the lowest noise is preferably selected.

Figure 11:
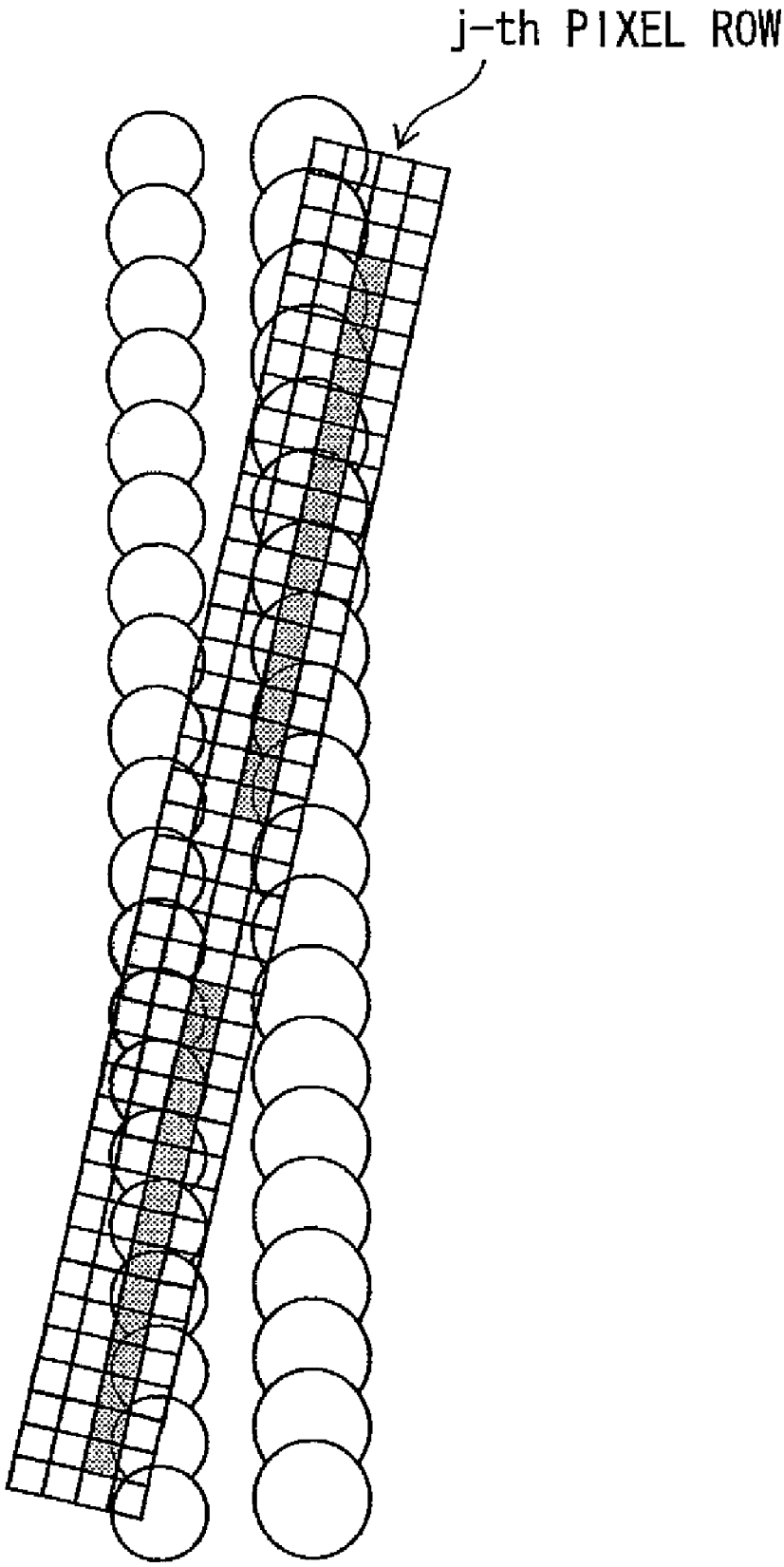
FIG. 11 is an illustrative diagram of the relationship between a profile graph and a one-dimensional pixel row which traverses the line pattern.

The specific details of the analysis of the captured image data are as described below. Firstly, profile graphs which represent the variations in the image signal value in respective one-dimensional pixel rows following the lattice direction (here, the Y direction) which traverse the respective line patterns, are obtained on the basis of the electronic image data obtained by image capture. FIG. 11 is a schematic drawing of the relationship between a one-dimensional pixel row for which a profile graph is obtained, and the line patterns on the sample chart. In FIG. 11, the shaded regions of the pixel row indicate those portions of the j-th one-dimensional pixel row traversing the line patterns which have a high image signal value due to the presence of an ink dot in a line pattern.

As shown in FIG. 11, since there are a plurality of one-dimensional pixel rows which traverse one line pattern (namely, pixel rows aligned in the read scanning direction (Y direction)) and profile graphs are obtained from the respective pixel rows, then a plurality of profile graphs are obtained for each line pattern.

Figure 12:
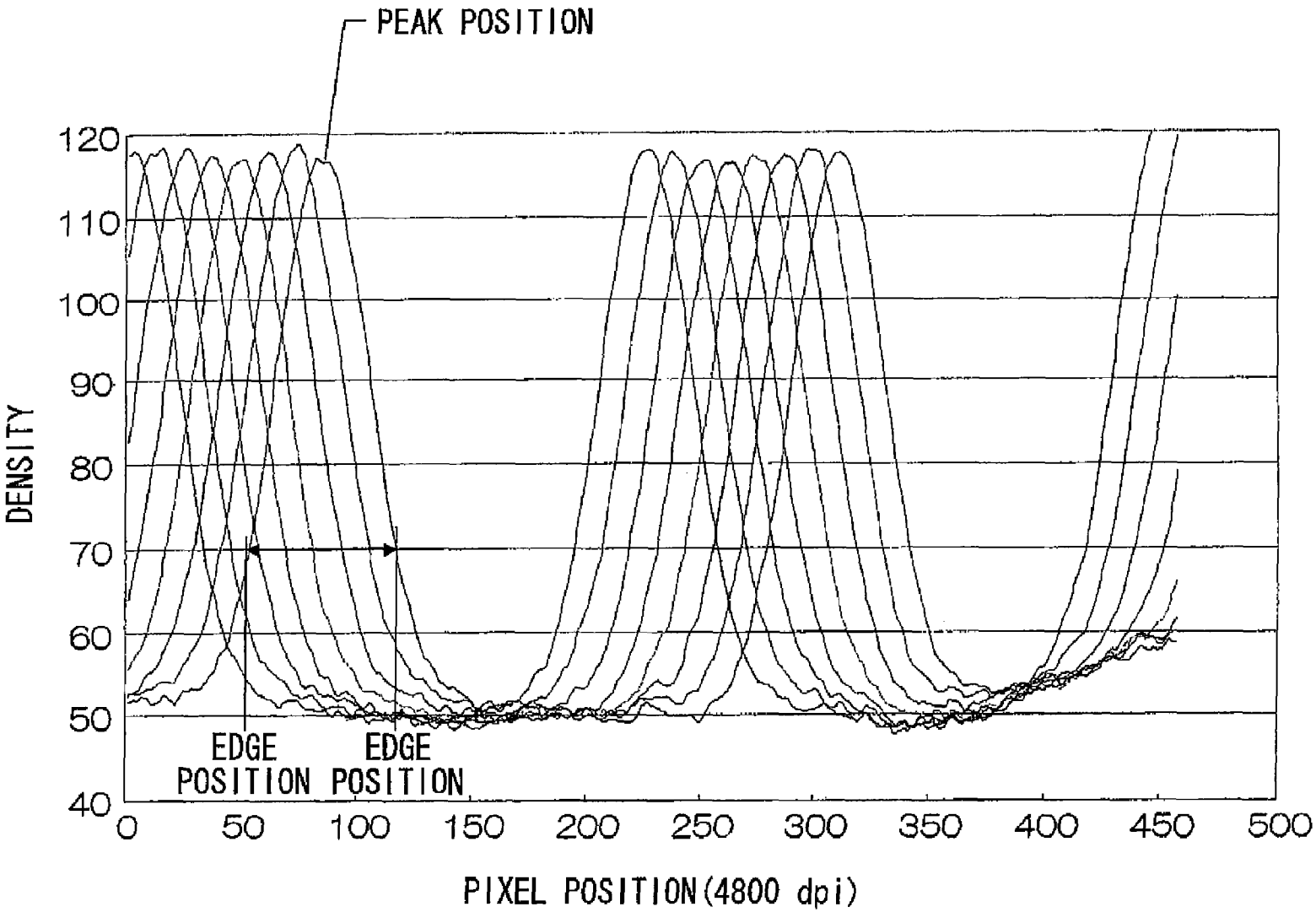
FIG. 12 is a diagram showing an example of a profile graph.

FIG. 12 is a diagram showing an example of a profile graph. The horizontal axis in FIG. 12 represents the pixel position in the Y direction, and the vertical axis represents the image signal value (in other words, a value reflecting the density). The plurality of curves (graphs) in FIG. 12 relate respectively to different pixel positions in the X direction. As shown in FIG. 12, a plurality of profile graphs are obtained in respect of the X-direction pixel positions. The profile graph represents variation in brightness, and in this case, the greater the density of the ink dots, the greater the image signal value in the image data; portions where no dot is present (the regions of the blank recording paper, in other words, white regions) have a low image signal value.

The peak position in a profile graph corresponds generally to the center of the line width of a line pattern, and a pixel position where the image signal value becomes a prescribed value (for example, a graduated tone value indicated as a density of "70" in FIG. 12) is specified as an edge position of a line pattern (namely, a boundary position in the breadthways direction).

More specifically, from the respective profile graphs, the graduated tone value corresponding to an edge position, and the pixel positions (on the left and right-hand sides) at which the stated graduated tone value is obtained, or at which it is deduced that the graduated tone value is obtained by interpolation from a position where the value has changed beyond the graduated tone value, are calculated. Furthermore, the peak position which corresponds to the position where the greatest optical density is obtained in the line pattern (a trough position having the lowest signal value in the case of a density signal, luminosity signal or brightness signal) is also calculated. In calculating the peak position, the extreme value position of the change in the signal value is calculated by interpolation from signal values to either side of the peak position.

For each of the line patterns read in from the sample chart, the edge positions (left and right-hand side) and the peak positions are calculated respectively from the corresponding plurality of profile graphs, and this data is gathered up and the positional information is converted into physical distances on the recording paper. For example, if the resolution in the horizontal direction of the captured image is Rx, and the resolution in the vertical direction is Ry (mm/pixel), then each position (X, Y) is converted respectively to a physical position of (Rx×X mm, Ry×Y mm). Thereupon, approximation lines are calculated respectively for the left and right-hand edge positions and the peak position corresponding to each of the respective line patterns, by using a least-square method. The approximation lines may be derived as three independent straight lines, or alternatively, the approximation lines may be derived by applying restrictions in such a manner that the straight lines have the same gradient.

On the basis of the approximation lines obtained as described above, a line width is determined for each line pattern by calculating the perpendicular distance between the approximation line corresponding to the left-hand edge of the line pattern and the approximation line corresponding to the right-hand edge of the line pattern.

When determining the approximation lines, if restrictions are applied in such a manner that the resulting straight lines have the same gradient, then the method described above can be used without any problems. If, on the other hand, the three straight lines are derived independently, then the following method can be used. Firstly, the central point of the left-hand edge positions of the corresponding line pattern are determined (for example, by simply specifying the average position of the edge position coordinates as the central point), Y coordinate corresponding to the X coordinate of this central point of the left-hand edge positions is calculated by means of the approximation line of the left-hand edge, and the distance between this coordinate (X, Y) thus calculated and the approximation line of the right-hand edge is determined. Similarly, the central point of the right-hand edge positions of the corresponding line pattern are determined, Y coordinate corresponding to the X coordinate of this central point of the right-hand edge positions is calculated by means of the approximation line of the right-hand edge, and the distance between this coordinate (X, Y) thus calculated and the approximation line of the right-hand edge is determined. The average value of these two distances is taken to be the line width.

The peak positions can also be found by determining the distance between the line patterns, by using a method similar to that described above. More specifically, if the approximation lines corresponding to the peak positions of the respective line patterns are calculated so that they have the same gradient and are therefore parallel to each other, then the distance between the approximation lines which correspond to mutually adjacent peak positions will be equivalent to the distance between the deposition positions of the dots formed by the respective nozzles.

On the other hand, if the approximation lines have been determined in such a manner that the approximation lines for the respective line patterns are not necessarily parallel, then the central points of the peak positions corresponding to these line patterns are determined. For example, the average value of the X coordinates of the peak positions corresponding to the respective line patterns is determined, and the Y coordinate corresponding to the X coordinate is calculated by means of the approximation line. The distance between the position (X, Y) thus obtained, and the approximation line corresponding to the peak positions for the mutually adjacent line pattern, is then determined. Thereupon, the central point of the peak positions for the adjacent line pattern described above is determined and the distance between this and the approximation line corresponding to the other line pattern is found. The average value of these two distances is taken to be the interval between the deposition positions of the dots formed by the nozzles.

4. Method for Determining the Dot Diameter (Ink Volume) on the Basis of the Line Width of the Line Patterns After determining the line width of the line patterns by means of the image analysis described above, the dot diameter (ink volume) is calculated by the following method, on the basis of the line width information.

In other words, previously, an isolated dot (and desirably, a plurality of isolated dots) followed by a line pattern are formed by ink ejected from one nozzle onto the recording paper, in accordance with the prescribed combination of the type of recording paper and the ink, and the result is captured by means of a high-resolution camera having a microscope attached to the imaging apparatus, and the dot diameter of the isolated dot and the line width of the line pattern are measured on the basis of the image data thus obtained. The sample chart "B" based on groups of isolated dots and line patterns in this way is measured, and the conversion function which represents the relationship between the isolated dot diameter and the line width of the line pattern (the "dot diameter—line width correlation function" which represents the correlation between the dot diameter and the line width) is determined. The dot diameter of isolated dots and the line width of a dot row formed by ejecting and depositing droplets continuously in a line shape have mutually different spreading rates, and therefore they do not have the same value.

The sample chart "B" is based on the same combination (the same recording conditions) of recording paper and ink (the same types) as the measurement sample chart "A" described above.

Moreover, the line widths of the portions of the line patterns in the sample chart "B" are calculated by means of the technique (hereinafter, called the method according to the present embodiment) as that used in "2. Reading in sample chart" and "3. Analysis of captured image data" described above. Thereupon, the conversion function representing the relationship between the line width measured by the microscopic camera and the line width of the line pattern measured by the method of the present embodiment (namely, the "measurement results correlation function" which represents the correlation between the measurement results from the microscopic camera and the measurement results based on the method of the present embodiment) is beforehand determined.

By combining the two conversion functions described above (namely, the "dot diameter/line width correlation function" and the "measurement result correlation function"), it is possible to convert the information on the line width of the line pattern as measured by the method of the present embodiment into dot diameter information. The relationship between the isolated dot diameter and the line width obtained by the method of the present embodiment may be determined as a direct conversion function.

Furthermore, the ink volume can be determined from the information on the line width, by previously measuring, with a microscopic camera, the ink volume projected from a nozzle by means of a commonly known method and measuring the dot diameter formed by a dot of that ink volume, determining the relationship between the ink volume and the dot diameter as a conversion function (a "volume/dot diameter correlation function" which indicates the correlation between the ink volume and the dot diameter), and combining this conversion function (the "volume/dot diameter correlation function") with the two conversion functions described above (the "dot diameter/line width correlation function" and the "measurement result correlation function").

In measuring the isolated dots and determining the dot diameter, desirably, a plurality of isolated dots are measured and the average value of these measurements is used.

The "measurement result correlation function", the "volume/dot diameter correlation function" and the "dot diameter/line width correlation function" described above can be used as a polynomial expression by representing the relationship between two variables which represent the measurement results as a polynomial function, by means of a polynomial curve fitting method. Alternatively, the conversion functions described above can be used by means of a commonly known spline function or linear interpolation method, if the relationship between the two variables which represent the measurement results is subjected to a commonly known noise shaping process or smoothing process, and the two processed variables are then determined in a table format. To describe one example of a method for obtaining the "volume/dot diameter correlation function", the volume of an ink droplet in fight which has been ejected from a specific nozzle is determined a plurality of times by means of a commonly known method, the average value thereof is calculated, the ink droplet in flight that has been ejected from the specific nozzle is deposited onto recording paper (of the same type) in a pattern same as the sample chart A used for measurement, the diameter of a dot formed by the ink droplet is measured a plurality of times by means of a microscopic camera, the average value of the dot diameter is calculated, and the relationship between the ink volume and the dot diameter can then be determined as a conversion function (a "volume/dot diameter correlation function" which indicates the correlation between the ink volume and the dot diameter).

The commonly known method used for measuring the volume of ink droplets in flight that have been ejected from a nozzle may be a method which captures an image of the ejected ink droplets in flight by means of a high-speed camera, or a method which receives a plurality of ejected droplets in a container, determines the differential between the weight of the container before droplet ejection and the weight of the container after droplet ejection, and hence finds the weight of one ejected droplet on the basis of the number of droplet ejections, and then determines the volume of an ink droplet on the basis of the ink density.

Concrete Example of Image Analysis Processing

Below, the image analysis processing is described in more detail.

Figure 13:
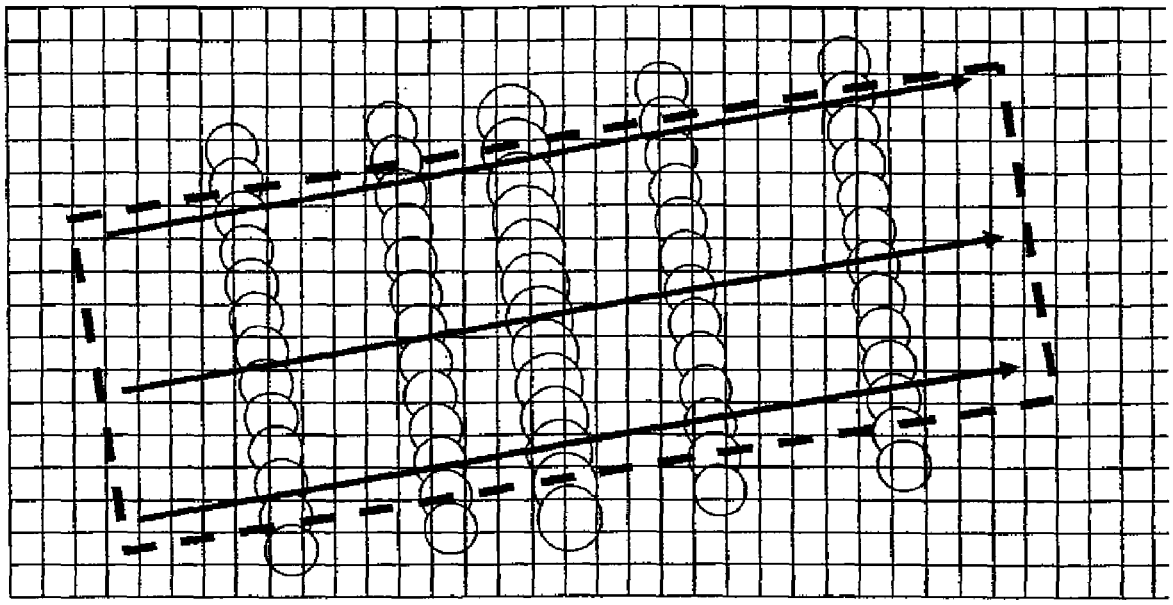
FIG. 13 is a diagram illustrating a processing step of image analysis.

(Step 1) As shown in FIG. 13, images of the respective line pattern blocks of captured image data obtained by reading in the measurement sample chart "A" described in FIG. 8 are scanned in the direction of the arrows, at coarse intervals (for example, central part and both ends as indicated by arrows in FIG. 13), following a quadrilateral shape (in FIG. 13, the rectangular shape indicated by the dotted line) which traverses the respective line pattern blocks, and profile graphs indicating the variation in the signal value in this scanning direction are obtained.

Figure 14:
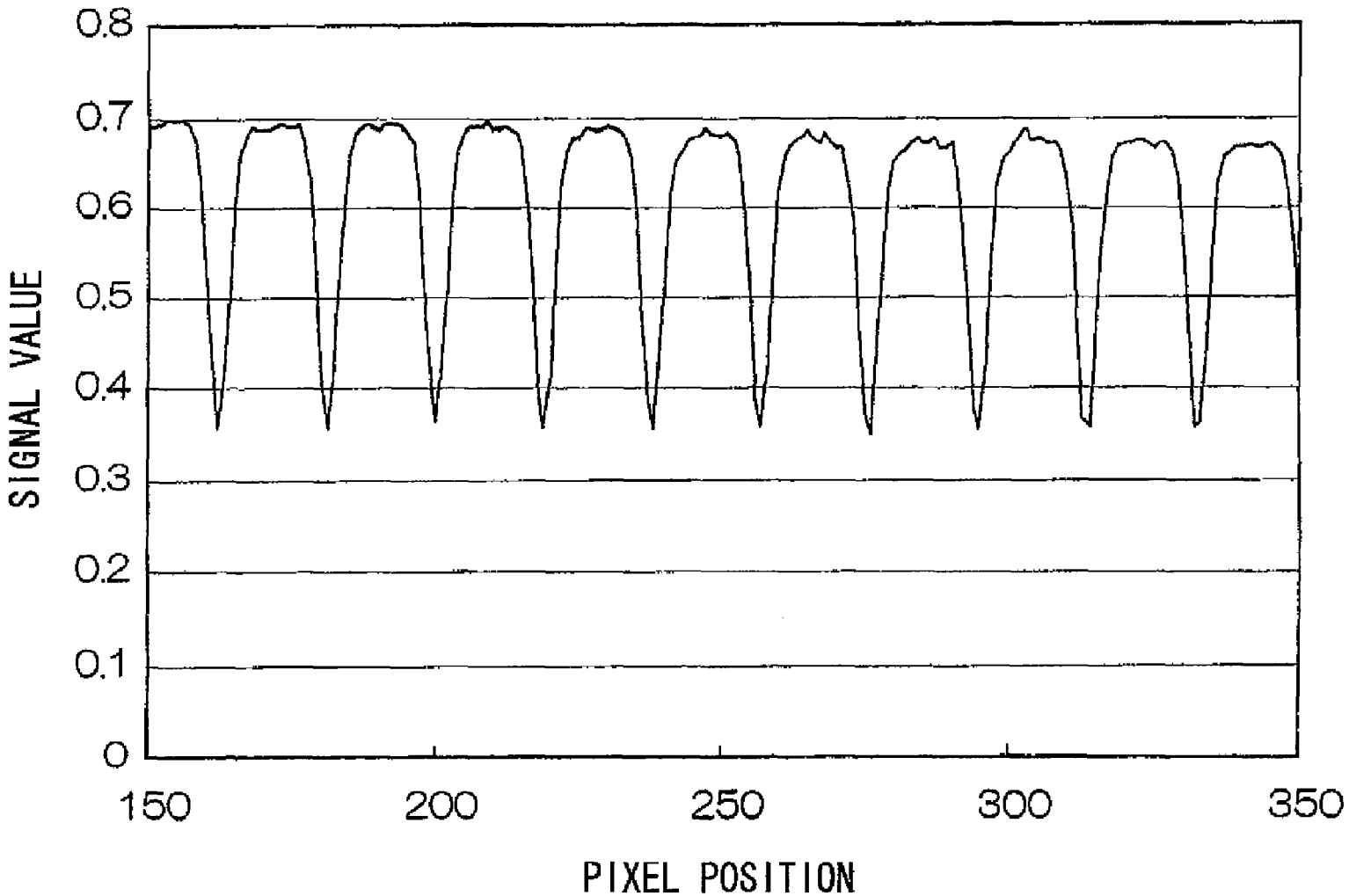
FIG. 14 is a diagram showing an example of a profile graph that displays variation in the signal value along the scanning direction in which the image is scanned as indicated by the arrow in FIG. 13.
Figure 15:
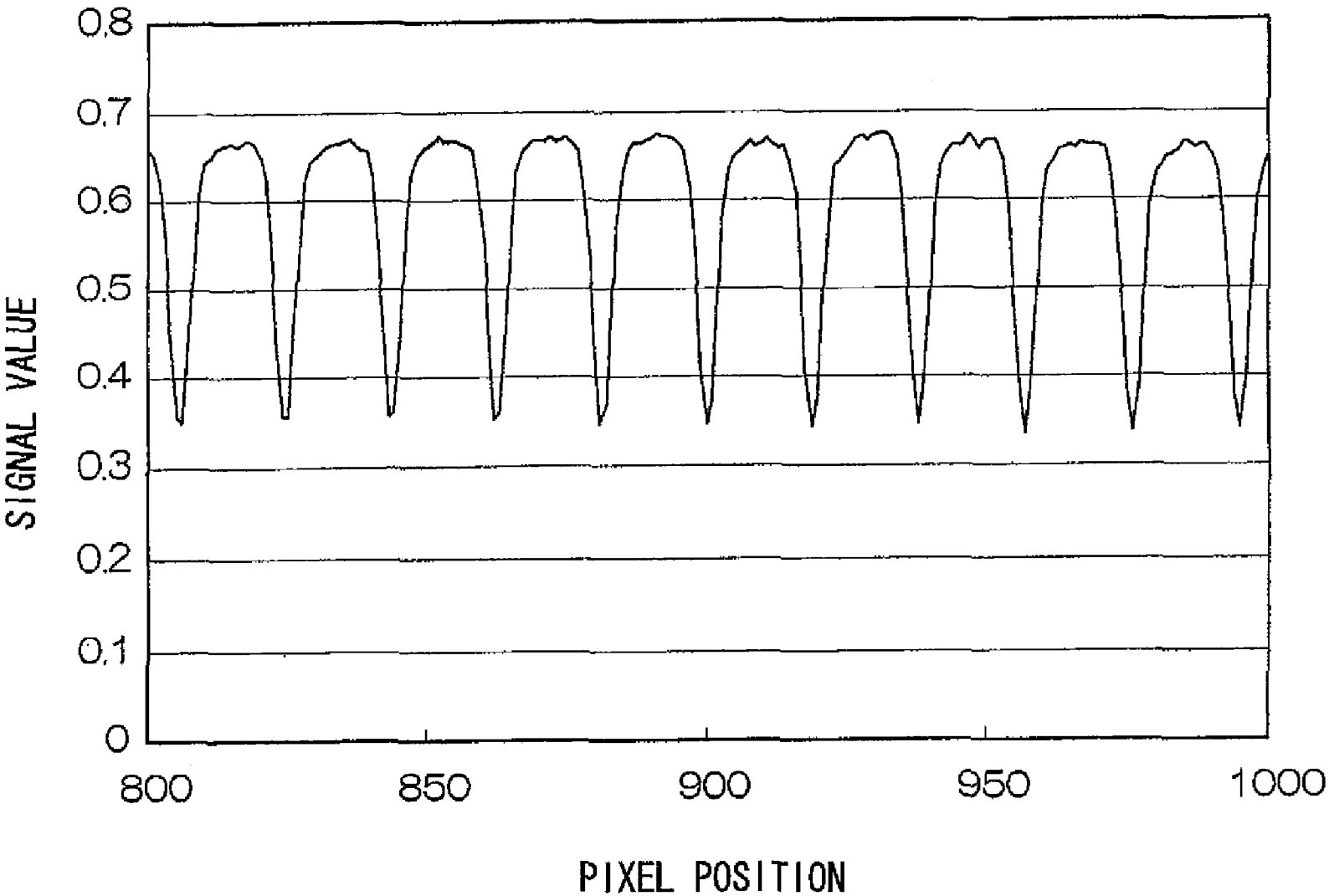
FIG. 15 is a diagram showing another example of a profile graph that displays variation in the signal value along the scanning direction in which the image is scanned as indicated by the arrow in FIG. 13.

FIGS. 14 and 15 are diagrams showing examples of these profile graphs. The horizontal axis in FIGS. 14 and 15 represents the pixel position, and the vertical axis represents the signal value of the image. In FIGS. 14 and 15, the signal value becomes smaller, the greater the density of the dot formed by the ink, and in regions where no dot is present (the portions of the blank recording paper, in other words, white regions), the signal value assumes a large value. Therefore, the signal value has a different meaning to that of the graph shown in FIG. 12 (in other words, the relationship between the magnitudes of the density and the signal value is the opposite).

(Step 2) Thereupon, the coordinates at which the profile graph obtained at step 1 is cut horizontally at the prescribed signal value are determined.

The coordinates are then classified according to the direction of change of the signal (from white to black or from black to white) and their sequential position, and are gathered for each coordinate which corresponds to the same sequential position and the same direction of signal change. In so doing, the left-hand edge and the right-hand edge which correspond to the same line pattern can be distinguished within each image scan.

(Step 3) The straight line forming the right-hand edge is determined by using a least-square method, or the like, on the basis of the group of coordinates obtained for the right-hand edge for each line pattern. The straight line forming the left-hand edge is also determined by a similar method.

(Step 4) The quadrilateral shapes containing the respective line patterns (see FIG. 16) and the quadrilateral shapes which are positioned between the line patterns and do not contain a line pattern (see FIG. 17) are specified by the straight lines corresponding to the left and right-hand edges determined for each line pattern, and the upper edge and the lower edge of the first quadrilateral shape (see FIG. 13). In other words, the quadrilateral shape shown in FIG. 13 is divided into a first group of quadrilateral shapes shown in FIG. 16 and a second group of quadrilateral shapes shown in FIG. 17.

In this case, it may be difficult to contain the line patterns completely depending on the prescribed signal values which specify the edges, but it is possible to specify a quadrilateral shape which contains the line pattern completely by expanding the quadrilateral shape containing the line pattern in parallel with the straight line corresponding to the left-hand edge (and expanding in the same way on the right-hand side as well).

Shading Correction

An image reading apparatus has non-uniformity in the read signal, which is known as shading, and as shown in FIGS. 14 and 15, this appears in the profile graphs as variations in the white and black levels between the graphs corresponding to the respective line patterns. This variation in the white and black levels has an adverse effect on the accuracy of calculating the edge positions (the positional accuracy) based on the signal values (graduated tone values). Therefore, shading correction of the following kind is implemented with a view to improving the positional accuracy.

If the X direction is taken as the lateral (horizontal) direction (i.e., the direction of alignment of the photoreceptor elements in the line sensor), and if the Y direction is taken as the vertical (perpendicular) direction (i.e., the sub-scanning direction of the line sensor), then the aforementioned shading correction for the X direction and shading correction for the Y direction is carried out as described below, respectively, with regard to each of the quadrilateral shapes (indicated by the quadrilateral shapes marked by thick lines in FIG. 16) containing a line patterns.

Figure 16:
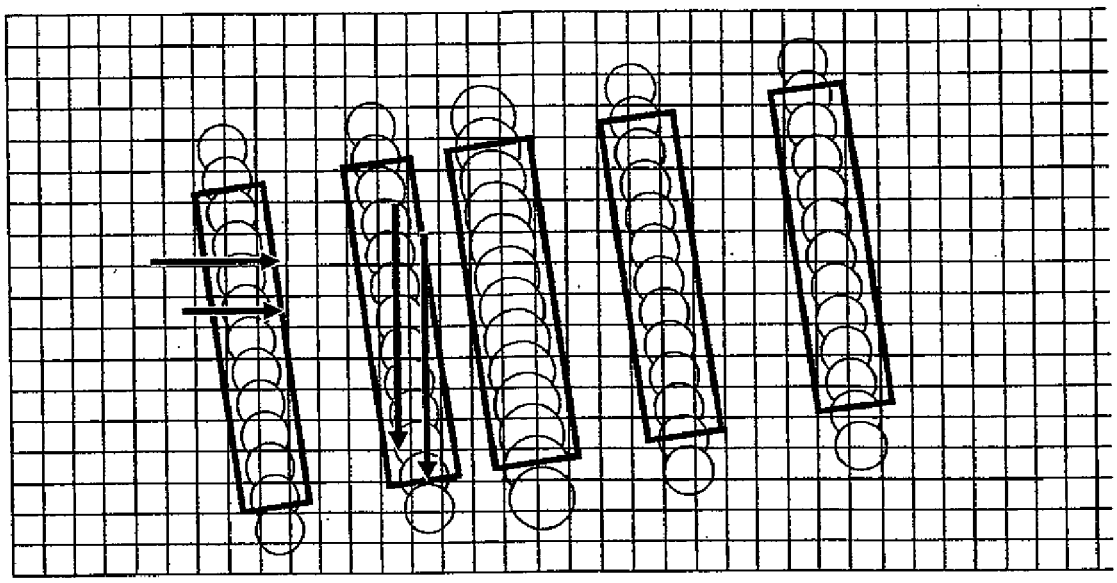
FIG. 16 is an illustrative diagram of a processing step of image analysis.

X Direction Shading Correction Method (1) Firstly, the signal value corresponding to black is determined inside the quadrilateral shapes containing the line patterns as shown in FIG. 16. This is done by determining the signal corresponding to black as the minimum value or maximum value (in the X direction within the quadrilateral shape), and then averaging this value in the Y direction, and thereby determining the signal value corresponding to black. This signal value is set as "$BK_i$".

Figure 17:
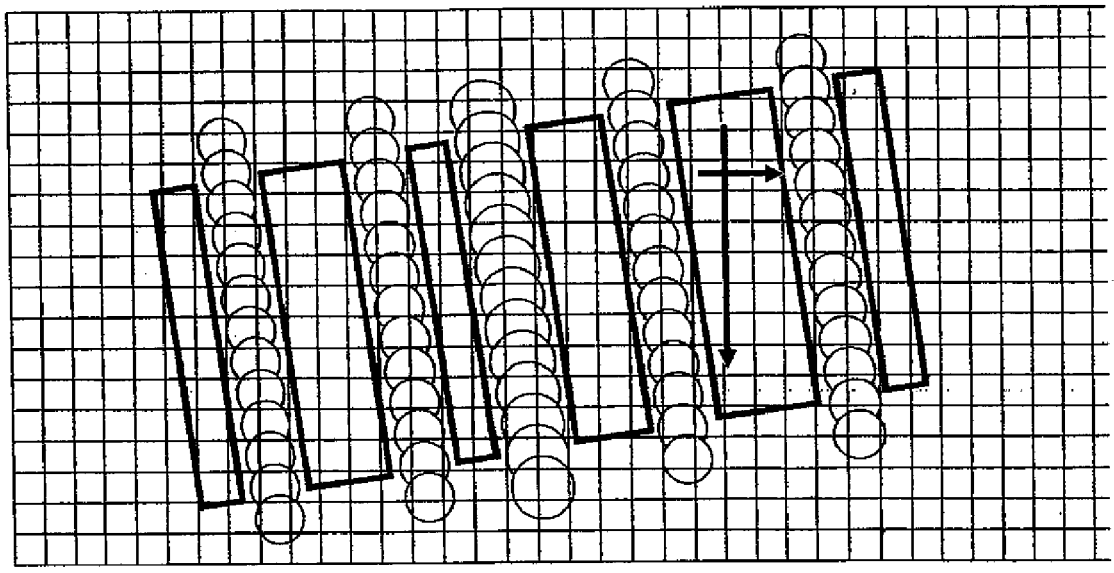
FIG. 17 is an illustrative diagram of a processing step of image analysis.

(2) On the other hand, in respect of the quadrilateral shapes which do not contain a line pattern as shown in FIG. 17, the image of the quadrilateral shape is passed through a low-pass filter in the X direction, the signal value corresponding to white in this filtered image is determined as the minimum value or the maximum value in the X direction, and this signal value is associated with the Y coordinate for each Y direction, in the form of a table. This table is taken as "$WH_TBL_i(Y)$". A signal value which is averaged in the Y direction "$WH_i$" is also calculated.

In this way, the aforementioned values ($BK_i$, $WH_i$) are determined for all of the quadrilateral shapes (the quadrilateral shapes containing line patterns and the quadrilateral shapes not containing line patterns).

(3) Next, the average value $BK_{ave}$ of the $BK_i$ values of the quadrilateral shapes which contain the respective line patterns, and the average value $WH_{ave}$ of the $WH_i$ values of the quadrilateral shapes which do not contain a line pattern, are determined.

(4) For each of the quadrilateral shapes containing the respective line patterns, a correction value which corrects the shading in the X direction is determined as described below.

(5) A linear conversion is defined whereby if the input value is $BK_i$, then the output value is $BK_{ave}$, and if the input value is $WH\mathbf{0}_i$, ten the output value is $WH_{ave}$. In other words, taking the central coordinate in the X direction of the $BK_i$ value of the quadrilateral shape containing the line pattern under investigation, to be $X\mathbf{1}_i$, taking the $WH_i$ value corresponding to the white portion of the left-hand side of the quadrilateral shape not containing a line pattern which is adjacent to the quadrilateral shape in question to be $WH\mathbf{0}_i$, taking the central coordinate thereof in the X direction to be $X\mathbf{0}_i$, taking the $WH_i$ value corresponding to the right-hand side to be $WH\mathbf{2}_i$, and taking the central coordinate thereof in the X direction to be $X\mathbf{2}_i$, then at the X coordinate of $X\mathbf{0}_i$, the following expressions are satisfied:

$$\text{output signal}=\text{gain0}\times\text{input signal}+\text{offset0};$$

$$\text{gain0}=(WH_{ave}-BK_{ave})/(WH0_i-BK_i);\ \text{and}$$

$$\text{offset0}=-\text{gain0}\times BK_i+BK_{ave}.$$

(6) Similarly, the following linear conversion is defined:

$$\text{output signal}=\text{gain1}\times\text{input signal}+\text{offset 1},$$

whereby when the X coordinate is $X\mathbf{1}_i$ i, then if the input value is $BK_i$, the output value will be $BK_{ave}$, and if the input value is $(WH\mathbf{0}_i+WH\mathbf{2}_i)/2$, then the output value will be $WH_{ave}$.

(7) Similarly, the following linear conversion is defined:

$$\text{output signal}=\text{gain2}\times\text{input signal}+\text{offset2},$$

whereby, when the X coordinate is $X\mathbf{2}_i$, then if the input value is $BK_i$, the output value will be $BK_{ave}$, and if the input value is $WH\mathbf{2}_i$, then the output value will be $WH_{ave}$.

(8) On the basis of the equations defined above, correction in the X direction is performed by applying the following formula:

$$\text{output value}=\text{gain}(x)\times\text{input value}+\text{offset}(x).$$

In this case, when the X coordinate is in the range between $X\mathbf{0}_i$ and $X\mathbf{1}_i$ ($X\mathbf{0}_i<x<X\mathbf{1}_i$), the following equations are used:

$$\text{gain}(x)=s\times\text{gain0}+t\times\text{gain1},\ \text{and}$$

$$\text{offset}(x)=s\times\text{offset0}+t\times\text{offset1},$$

$$\text{where } s=(X1_i-x)/(X1_i-X0_i),\ \text{and}$$

$$t=(x-X0_i)/(X1_i-X0_i).$$

On the other hand, when the X coordinate is in the range between $X\mathbf{1}_i$ and $X\mathbf{2}_i$ ($X\mathbf{1}_i<x<X\mathbf{2}_i$), the following equations are used:

$$\text{gain}(x)=s\times\text{gain1}+t\times\text{gain2}, \text{ and}$$

$$\text{offset}(x)=s\times\text{offset1}+t\times\text{offset2}$$

$$\text{where } s=(X2i-x)/(X2i-X1i), \text{ and}$$

$$t=(x-X1i)/(X2i-X1i).$$

Y Direction Shading Correction Method

Next, the correction of shading in the Y direction will be described. The correction values used to correct shading in the Y direction are determined as follows for the quadrilateral shapes containing line patterns shown in FIG. 16.

(1) Taking the $WH_TBL_i(Y)$ value which corresponds to the white region of the left-hand side of the quadrilateral shape not containing a line pattern which is adjacent to the quadrilateral shape (containing a line pattern) under investigation to be $WH_TBL\mathbf{0}_i(Y)$, and taking the $W_TBL_i(Y)$ value which corresponds to the right-hand side thereof, to be $WH_TBL\mathbf{1}_i(Y)$, the whitest data $WhPeak_0$ in $WH_TBL\mathbf{0}_i(Y)$ is determined, and the following equation is established:

$$\text{Scale0}(Y)=WhPeak0/WH_TBL0_i(Y).$$

(2) Similarly, the whitest data WhPeak1 in $WH_TBL\mathbf{1}_i(Y)$ is determined, and the following equation is established:

$$\text{Scale1}(Y)=WhPeak1/WH_TBL1_i(Y).$$

(3) The value Scalek(Y) for correcting the signal values corresponding to white to a uniform value in the Y direction is then determined.

$$\text{Scale}k(Y)=\{\text{Scale0}(Y)+\text{Scale1}(Y)\}/2$$

(4) Correction is carried out in the following manner. The signal S(X,Y) at coordinates (X,Y) is corrected to:

$$S'(X,Y)=\text{gain}(X)\times S(X,Y)+\text{Offset}(X);$$

$$S''(X,Y)\text{Scale}k(Y)\times S'(X,Y).$$

In this case, Scalek(Y) varies depending on the corresponding quadrilateral shape (k) containing a line pattern.

Acquiring Profile Graphs Corresponding to the Line Patterns (Step 5) The quadrilateral shapes which completely contain a line pattern as described in step 4 are image-scanned in the X direction or the Y direction as shown by the thick arrowed lines in FIG. 16, thereby acquiring profile graphs which indicate the variation in the signal value in a one-dimensional pixel row in the scanning direction. The profile graphs are subjected to the shading correction described above, in accordance with the scanning coordinates (X,Y).

Furthermore, in order to minimize noise, it is desirable to pass the profile graphs through a low-pass filtering process.

The profile graph obtained from the quadrilateral shape containing the k-th line pattern in FIG. 16 is represented as shown below.

ProfGraph Ykx(Y): scan in Y direction (X:X coordinate within quadrilateral shape)

ProfGraph Xky(X):scan in X direction (Y:Y coordinate within quadrilateral shape)

Processing for Specifying Peak Position (Step 6) In the profile graphs obtained in step 5 described above, if the magnitude relationship of the signal values is white signal > black signal, then the position of the trough of the profile graph is set as the peak position (corresponding to the nozzle droplet ejection position). It on the other hand, the signal relationship is white signal <black signal, then the crest position of the profile graph is set as the peak position.

A peak position set on the basis of the trough position is determined as follows. In the case of a profile graph obtained by scanning in the X direction, the quadratic function ($ax^2+bx+c$) which passes through the three points (i.e., $(x, S)=(x_{i-1}, S_{i-1})$, $(x_i, S_i)$, and $(x_{i+1}, S_{i+1})$, in the case of a profile graph obtained by scanning in the X direction) is determined. Then, the X coordinate $-b/(2a)$ producing the minimum value is set as the coordinate of the peak position. The Y coordinate is set as the Y coordinate of the reference scanning point. S is the signal value on the profile graph after the correction processing described above, and the suffix represents scanning in one pixel units in the prescribed direction (the X direction or the Y direction), (where continuous suffixes represent mutually adjacent pixels in the prescribed direction).

In the case of a profile graph obtained by scanning in the Y direction, instead of the three points $x_{i-1}$, $x_i$, and $x_{i+1}$ described above, three points $y_{i-1}$, $y_i$, and $y_{i+1}$ are used. More specifically, in the case of a profile graph obtained by scanning in the Y direction, the quadratic function ($ay^2+by+c$) which passes through the three points (i.e., $(y, S)=(y_{i-1}, S_{i-1})$, $(y_i, S_i)$, and $(y_{i+1}, S_{i+1})$, in the case of a profile graph obtained by scanning in the Y direction) is determined. Then, the Y coordinate $-b/(2a)$ producing the minimum value is set as the coordinate of the peak position. In this case, the X coordinate is set as the X coordinate of the reference scanning point.

On the other hand, in the case of a peak position determined on the basis of the crest position, with a profile graph obtained by scanning in the X direction, the quadratic function ($ax^2+bx+c$) passing through three points $(x, S)=(x_{i-1}, S_{i-})$, $(x_i, S_i)$ and $(x_{i+1}, S_{i+1})$ which satisfy ($S_{i-1}\leqq S_i$ and $S_i>S_{i+1}$) or ($S_{i-1}<S_i$ and $S_i\geqq S_{i+1}$) is determined, the X coordinate $-b/Y$ (2a) producing the maximum value is set as the coordinate of the peak position, and the Y coordinate is set to the Y coordinate of the reference scanning point.

Moreover, in the case of a profile graph obtained by scanning in the Y direction, the quadratic function ($ay^2+by+c$) passing through three points $(Y, S)=(y_{i-1}, S_{i-1})$, (yi, Si) and $(y_{i+1}, S_{i+1})$ which satisfy the conditions ($S_{i-}\leqq S_i$ and $S_i>S_{i+1}$) or ($S_{i-1}<S_i$ and $S_i\geqq S_{i+1}$) is determined, the Y coordinate $-b/(2a)$ producing the maximum value is set as the coordinate of the peak position, and the X coordinate is set to the X coordinate of the reference scanning point.

In this way, by determining the extreme values (peak positions) by means of quadratic approximations, it is possible to specify the peak positions with a high degree of accuracy.

Processing for Specifying the Edge Positions (Step 7) Next, processing for specifying the edge positions from the profile graph obtained at step 5 above will be described. The position of one edge of the left and right-hand edges (in this case, the left-hand edge "edge L") is determined as described below, taking the prescribed graduated tone value which is used as a reference for judging the edge of the line width to be T.

(a) In Cases where the Trough Position is Set as the Peak Position

In the case of a peak position set on the basis of the trough position, with a profile graph obtained by scanning in the X direction through 3 points satisfying $S_{i-1}>S_i$ and $S_i>S_{i+1}$, and $S_i\geqq T$, and $T\geqq S_{i+1}$ (i.e., $(x,S)=(x_{i-1},S_{i-1})$, $(x_i,S_i)$ and $(x_{i+1}, S_{i+1})$, in the case of a peak position set on the basis of the trough position), then the X coordinate of the point of intersection between the straight line of the graduated tone value T and the straight line which passes through the two points $(x_i, S_i)$ and $(x_{i+1}, S_{i+1})$ corresponding to $S_i$ and $S_{i+}$ is taken as the X coordinate of the edge position (edge L). The Y coordinate is set as the Y coordinate of the reference scanning point.

Moreover, in the case of a profile graph obtained by scanning in the Y direction, the Y coordinate of the edge position (edge L) is set as the Y coordinate of the point of intersection between the straight line of the graduated tone value T and the straight line which passes through the two points ($y_i$, $S_i$) and ($y_{+1}$, $S_{i+1}$) corresponding to $S_i$ and $S_{i+1}$, of the three points (y, S)=($y_{i-1}$, $S_{i-1}$), ($y_i$, $S_i$) and ($y_{i+1}$, $S_{i+1}$) which satisfy the conditions $S_{i-1}>S_i$ and $S_i>S_{i+1}$, and $S_i \geqq T$ and $T \geqq S_{i+1}$. In this case, the X coordinate is set as the X coordinate of the reference scanning point.

(b) In Cases where the Crest Position is Set as the Peak Position

In cases where the peak position is set on the basis of the crest position, then the coordinate of the edge position (edge L) is set as the coordinate of the point of intersection between the straight line of the graduated tone value T and the straight line which passes through the two points corresponding to $S_i$ and $S_{i+1}$ (in the case of scanning in the X direction, the corresponding points are ($x_i$, $S_i$) and ($x_{i+1}$, $S_{i+1}$), and in the case of scanning in the Y direction, the corresponding points are ($y_i$, $S_i$) and ($y_{i+1}$, $S_{i+1}$)), of the three points which satisfy the conditions, $S_{i-1}<S_i$ and $S_i<S_{i+1}$, and $S_i \leqq T$ and $T \leqq S_{i+1}$.

As regards the other edge (here, the right-hand edge, "edge R"), in a similar fashion, when the peak position has been set on the basis of the trough position, then in the case of a profile graph obtained by scanning in the X direction through three points satisfying $S_{i-1}<S_i$ and $S_i<S_{i+1}$, and $S_i \leqq T$ and $T \leqq S_{i+1}$, the coordinate of the edge position (edge L) is set by the X coordinate of the point of intersection between the straight line of the graduated tone value T and the straight line passing through the two points ($x_i$, $S_i$) and ($x_{i+1}$, $S_{i+1}$) corresponding to $S_i$ and $S_{i+1}$, of the three points (x, S) ($x_{i-1}$, $S_{i-1}$), ($x_i$, $S_i$) and ($x_{i+1}$, $S_{i+1}$). Here, the Y coordinate is set by the Y coordinate of the scanning reference point.

Furthermore, in the case of a profile graph obtained by scanning in the Y direction, the coordinate of the edge position (edge R) is set by the coordinate of the point of intersection between the straight line of the graduated tone value T, and the straight line passing through the two points ($y_i$, $S_i$) and ($y_{i+1}$, $S_{i+1}$) corresponding to $S_i$ and $S_{i+1}$, of the three points (y, S)=($Y_{i-1}$, $S_{i-1}$), ($y_i$, $S_i$) and ($y_{i+1}$, $S_{i+1}$) which satisfy the conditions $S_{i-1}<S_i$ and $S_i<S_{i+1}$ and $S_i \leqq T$ and $T \leqq S_{i+1}$. Here, the X coordinate is set by the X coordinate of the scanning reference point.

If the peak position is set on the basis of the crest position, then the coordinate of the edge position (edge R) is set by the coordinate of the point of intersection between the straight line of the graduated tone value T and the straight line passing through the two points corresponding to $S_i$ and $S_{i+1}$ of the three points which satisfy the conditions $S_{i-1}<S_i$ and $S_i<S_{i+1}$, and $S_i \leqq T$ and $T \leqq S_{i+1}$, (in the case of scanning in the X direction, these two corresponding points are ($x_i$, $S_i$) and ($x_{i+1}$, $S_{i+1}$), and in the case of scanning in the Y direction, they are ($y_i$, $S_i$) and ($y_{i+1}$, $S_{i+1}$)).

As described above, the coordinates of the edge positions can be calculated from the points of intersection between the straight line corresponding to the prescribed graduated tone value T which serves as the reference judgment value and the straight line which passes through two points which are on either side of this prescribed graduated tone value T.

Additional Processing for Further Enhancing Measurement Accuracy

[Dealing with Satellite Droplets]

Figure 18:
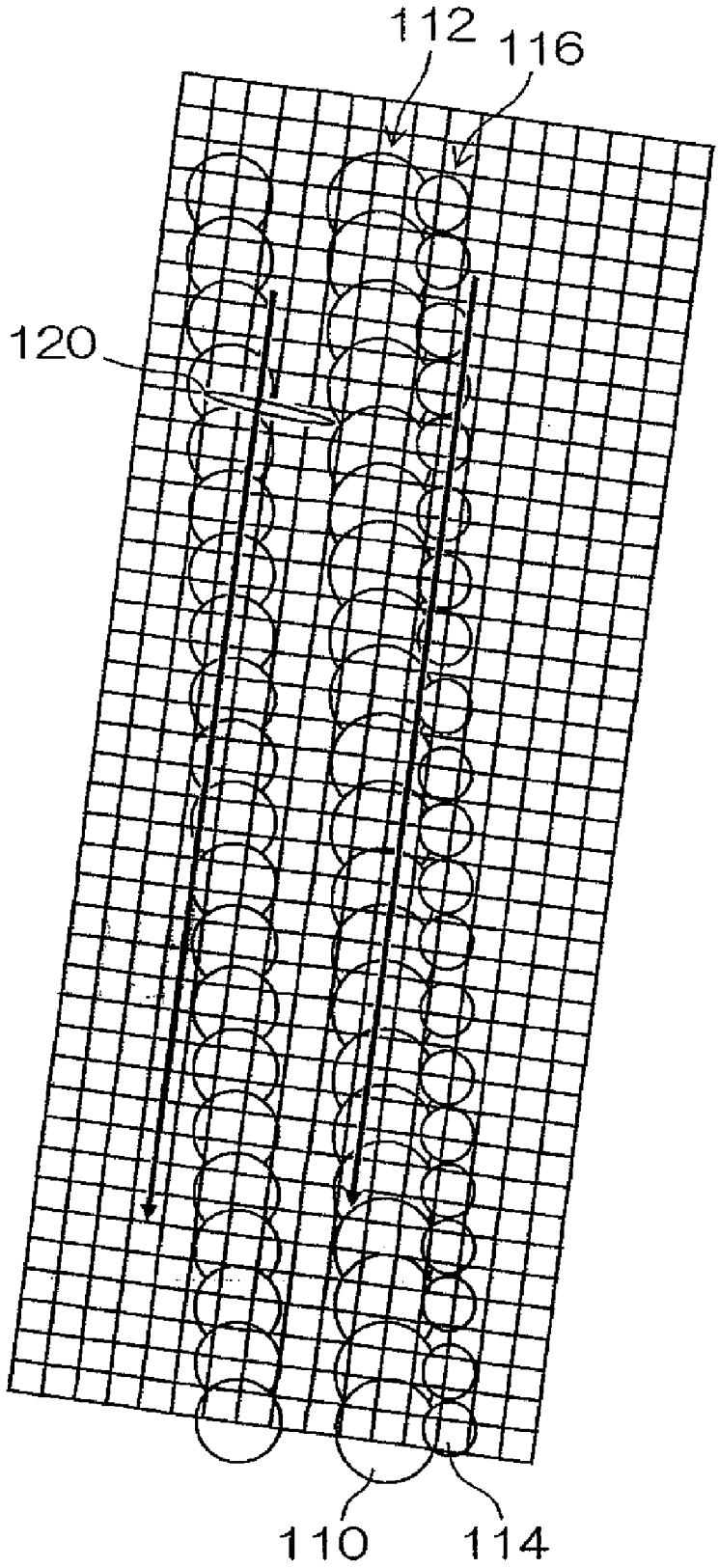
FIG. 18 is an illustrative diagram of a case which includes the effects of satellite dots or dust.

Subsidiary droplets (also referred to as "satellite droplets") which separate from the main droplet during ink ejection may occur in particular nozzles, for various reasons, such as nozzle defects or the like. When a satellite droplet of this kind deposits at a position different from the deposition position of the main droplet on the recording paper, then it forms a satellite dot. In this case, as shown in the line pattern of the sample chart illustrated in FIG. 18, an additional dot row 116 constituted of satellite dots 114 caused by the deposition of subsidiary droplets is added alongside the dot row 112 formed by the main dots 110 created by the deposition of main droplets.

Figure 19A:
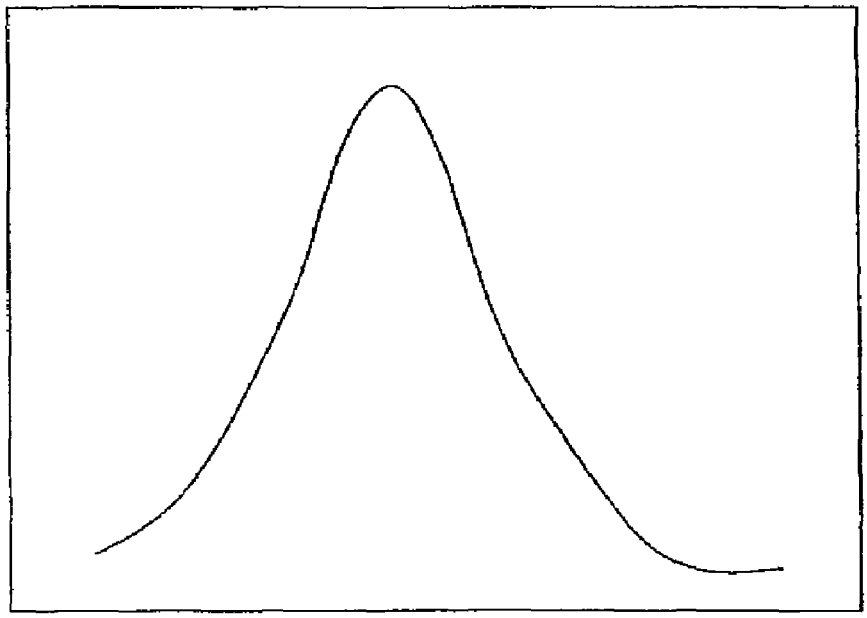
FIGS. 19A and 19B are illustrative diagrams of the shape of a profile graph.
Figure 19B:
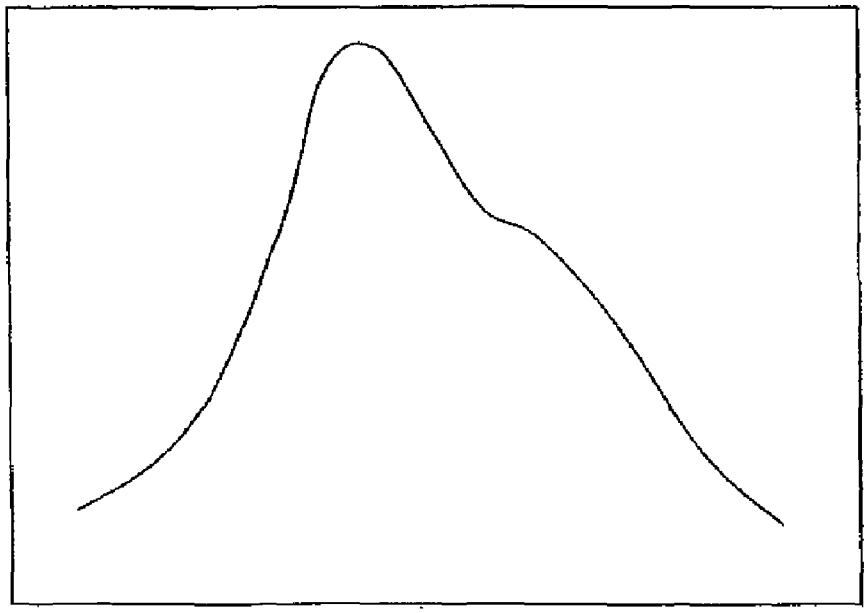
Figure 20:
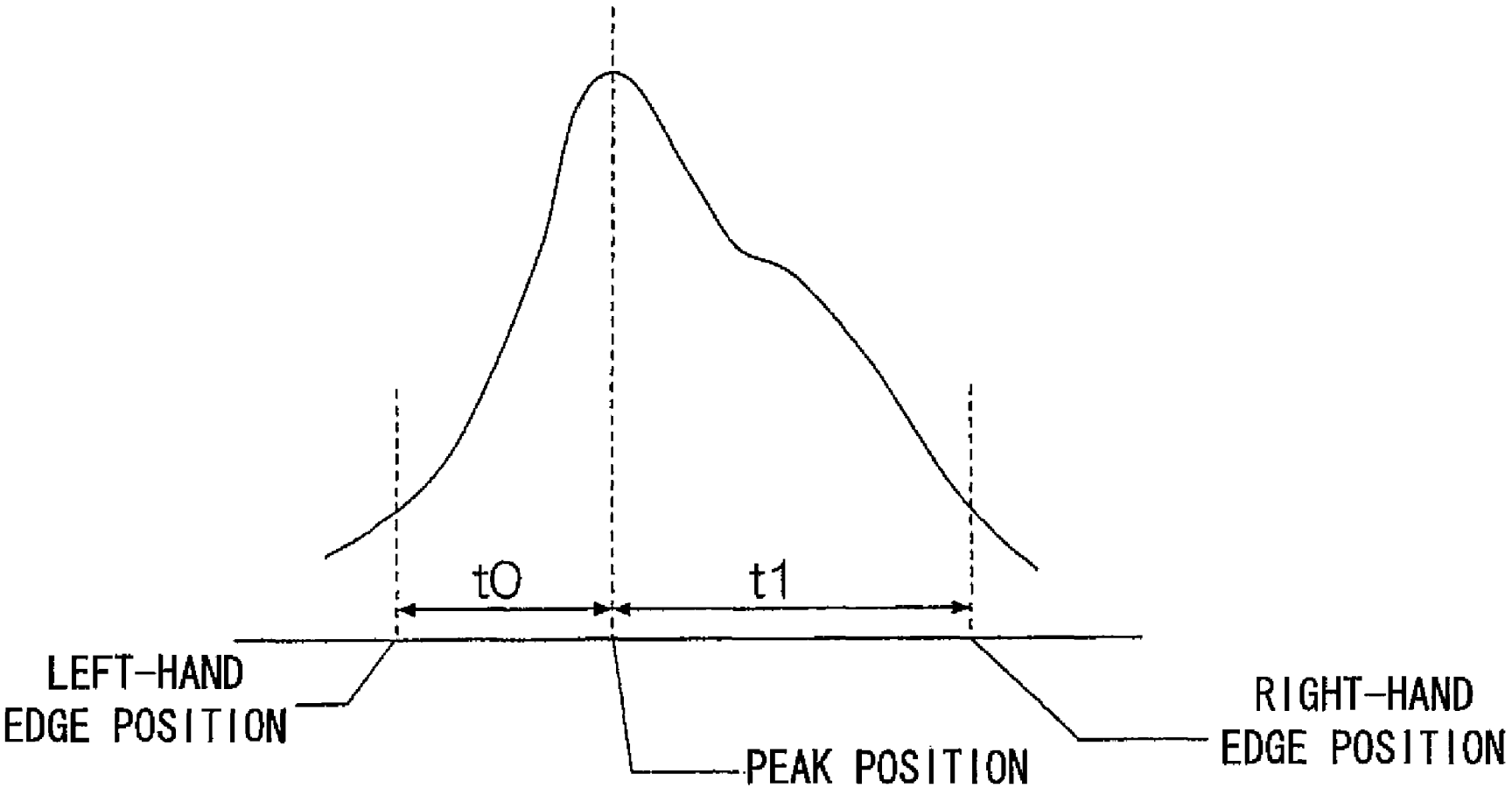
FIG. 20 is an illustrative diagram of the shape of a profile graph affected by satellite dots.

FIG. 19A is a diagram showing a profile graph which traverses a normal line pattern that does not contain satellite dots (here, the horizontal axis represents the pixel position in the Y direction). FIG. 19B is a diagram showing a profile graph which traverses a line pattern that does contain satellite dots 114. The profile graph shown in FIG. 19A has a substantially symmetrical shape centered on the peak position. On the other hand, the profile graph shown in FIG. 19B contains signal components corresponding to the satellite dots, and hence it has an asymmetrical shape. Therefore, the presence or absence of satellite dots is judged on the basis of the asymmetry of the profile graph corresponding to the line pattern, or the presence of sub-peaks (peaks caused by satellite dots), and the edge positions are recalculated by determining the amount of displacement from the estimated edge positions.

To give a concrete example of processing for judging the presence or absence of satellite dots, it is possible to use the following method.

More specifically, the profile graph of a line pattern containing satellite dots is as shown in FIG. 19C. Taking the interval between the left-hand edge position and the peak position in the profile graph to be t0, and taking the interval between the peak position and the right-hand edge position to be t1, then when the profile graph has a symmetrical shape, R (which is expressed by the equation of R=t0/(t0+t1)) is calculated to have a value of approximately 0.5. On the other hand, if the graph contains satellite dots, then the symmetrical shape is disturbed, and the value of R diverges from 0.5 and approaches a value of 0 or 1.

Consequently, if the absolute differential between R and "0.5" (which can be expressed as D=ABS (R−0.5)) is greater than a prescribed value, it is judged that satellite dots are present. Desirably, the prescribed value is set to an optimal value on the basis of experimental research, but in general terms, it can be set to 0.07 or above.

If satellite dots are detected, then this information is stored and can be used, for instance, to control the implementation of head maintenance (namely, cleaning operations for restoring the nozzle ejection performance, such as nozzle suctioning, preliminary ejection, wiping of the nozzle surface, and so on).

[Dealing with the Presence of Dirt and Dust During the Reading Operation]

Furthermore, dirt or dust may adhere to the sample chart, for any particular reason, and it can be envisaged that this dirt or dust (hereinafter, referred to simply as "dirt") may have an adverse effect on the reading of the line patterns and the analysis of the resulting images. The reference numeral 120 in FIG. 18 indicates the aspect of dirt adhering to the sample chart when it has been captured as an image. The following countermeasures are implemented in order to deal with dirt and dust of this kind.

Generally, dirt has no absorption peak, and therefore the RGB signals all display the same variation in response to the presence of dirt. Therefore, the presence or absence of dirt is judged from data at a read wavelength which is separate from the absorption wavelength of the ink under measurement, and processing is carried out in order to exclude the profile data containing the effects of this dirt, from the calculation.

For example, if the dot positions and dot diameter are calculated by reading in a line pattern formed by cyan ink, then the G signal (or B signal) is used to distinguish the dirt from the cyan ink (which displays greatest variation in the R signal), and hence a position producing a large variation in the G signal is judged to be affected by dirt. This position is excluded from the profile graph used to calculate the peak position and edge positions, and therefore the effects of the dirt on the calculation process can be minimized.

[Example of Processing for Dealing with the Presence of Dirt or Dust]

A specific example of this processing is given below. After calculating the edge positions and the peak position, statistical values, and more specifically, an average value and a standard deviation σ (sigma), are calculated for the respective signal values at the calculated positions (namely, the signal values at the left and right-hand edge position, and the peak position), in a dirt/dust determination channel which is different from the color channel used in the positional calculation processing.

If the signal value in the dirt/dust determination channel shows a deviation of ±3σ or above from the average value (i.e., the signal value is not less than (average value +3σ), or not greater than (average value −3σ)), then the signal value is considered to be affected by dirt, and the data for that position is removed (deleted). In this case, if the coordinates are not integers, then integer positions that can be obtained by rounding up or down to the nearest whole number are used.

If the contrast of the separate dirt/dust determination channel is high, as in the case of black ink, then the statistical values (the average value and the standard deviation σ) are calculated for the perpendicular distance between the straight line calculated by the least-square method described below, and the coordinate positions used in this least-square method. If the distance diverges by ±3σ or above, then this positional data is deleted and the straight line based on the least-square method is recalculated.

Furthermore, similarly to the determination of satellite dots, if the presence of dirt or dust is detected, then this information can be stored and used to control the implementation of head maintenance (namely, cleaning operations for restoring the nozzle ejection performance, such as nozzle suctioning, preliminary ejection, wiping of the nozzle surface, and the like).

[Straight Line Calculation by Means of the Least-square Method]

(Step 8) Using the data of the respective coordinates (X,Y) of the peak positions, the edge L and the edge R determined as described in steps 6 and 7, from the plurality of profile graphs traversing a line pattern which is located inside a quadrilateral shape k containing the line patterns, the straight lines AX+BY+C=0 which correspond respectively to the peak positions, the edge L and the edge R are determined by using a least-square method. The straight line corresponding to the peak positions is referred to as "$P_k$", the straight line corresponding to the edge L is referred to as "$L_k$" and the straight line corresponding to the edge R is referred to as "$R_k$"

[Measurement of Dot Deposition Position (Effective Nozzle Position) and Line Width]

(Step 9) The nozzle positions (dot deposition positions) and the line width are determined as described below, on the basis of the straight line $P_k$, the straight line $L_k$ and the straight line $R_k$ determined in Step 8 by using the least-square method described above in respect of the quadrilateral shape k containing the line patterns;

(a) Method of Calculating Line Width

Figure 21:
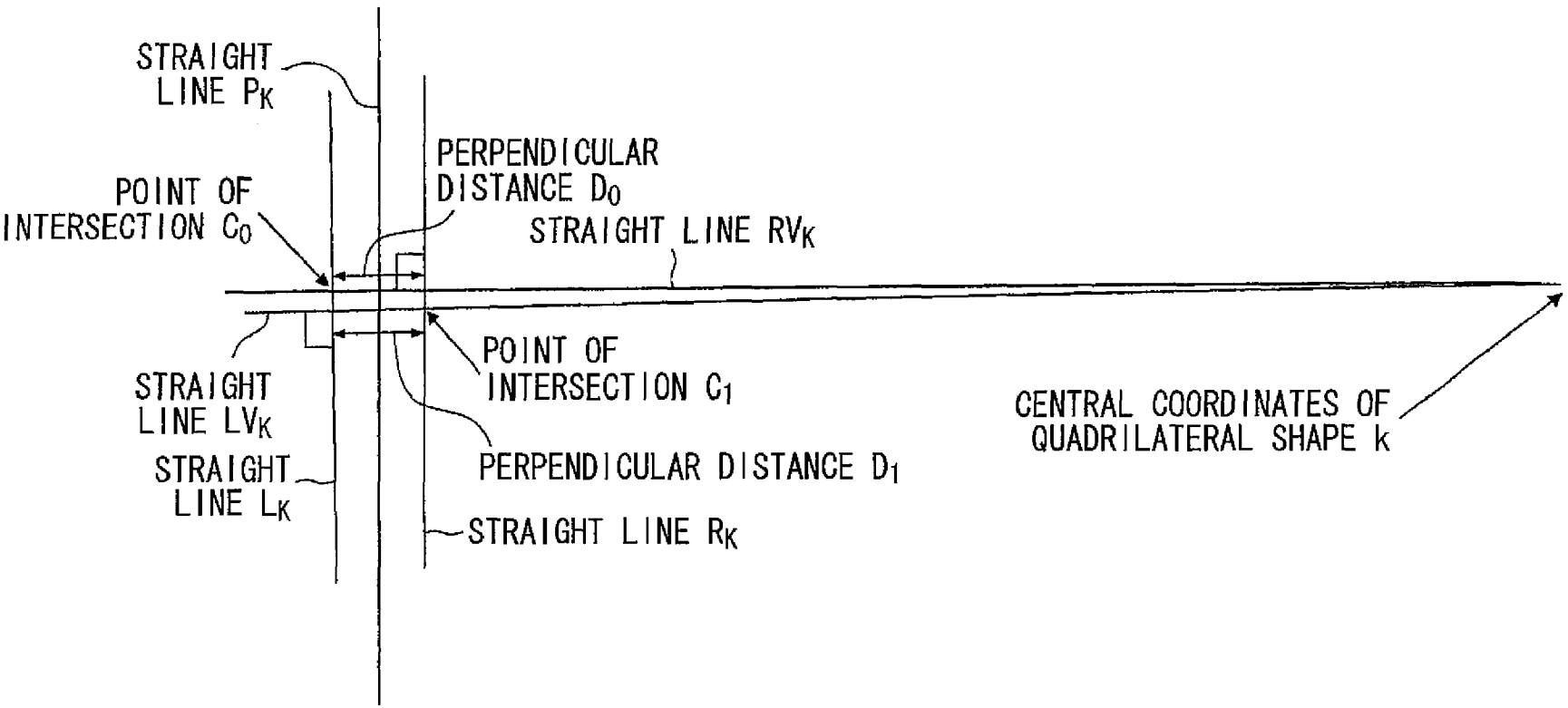
FIG. 21 is an illustrative diagram of a line width calculation method.

The line width D is calculated as the average of the values D0 and D1, which can be obtained as follows. More specifically, the point of intersection C0 between the straight line $L_k$ and the straight line $R_{Vk}$ is determined and the perpendicular distance D0 between this point of intersection C0 and the straight line $R_k$ is determined (see FIG. 21). In FIG. 21 the straight line $R_{Vk}$ is a line which is perpendicular to the straight line $R_k$ and passes through the central coordinates of the quadrilateral shape k containing the line patterns. Prior to calculating the distance, the X coordinates and Y coordinates can be converted into actual distances by multiplying X and Y respectively by the actual unit distance corresponding to one pixel.

Similarly, the point of intersection C1 between the straight line $R_k$ and the straight line $L_{Vk}$ is determined, and the perpendicular distance D1 between this point of intersection C1 and the straight line $R_k$ is determined. In this case, the straight line $L_{Vk}$ is a line which is perpendicular to the straight line $L_k$ and passes through the central coordinates of the quadrilateral shape k containing the line patterns.

From the perpendicular distances D0 and D1 obtained as described above, the line width D is derived by the formula: D=(D0+D1)/2.

(b) Method of Calculating the Nozzle Position

For each quadrilateral shape k, the dot deposition position (in other words, the effective nozzle position) is found by firstly calculating the average value θ of the gradient of the straight line $P_k$, and determining the gradient $\theta_V$ which is perpendicular to this gradient θ. The straight line, "Base Line", which has the gradient $\theta_V$ and passes through the central position of the whole line pattern block (this may be the average value of the central positions of the respective quadrilateral shapes k) is determined, and the points of intersection $C_{Pk}$ between this straight line, "Base Line", and the respective straight lines $P_k$, are determined.

Distances between two points $C_{Pk}$ aligned along the straight line, "BaseLine", represent the effective nozzle spacings (in other words, the distance between two points $C_{Pk}$ for adjacent two of the straight lines $P_k$ represents the effective nozzle spacing between two nozzles corresponding to the adjacent two of the straight lines $P_k$). Furthermore, the position of each point $C_{Pk}$ corresponds to an effective nozzle position (the deposition position of a dot created by a droplet ejected from the corresponding nozzle).

Figure 22:
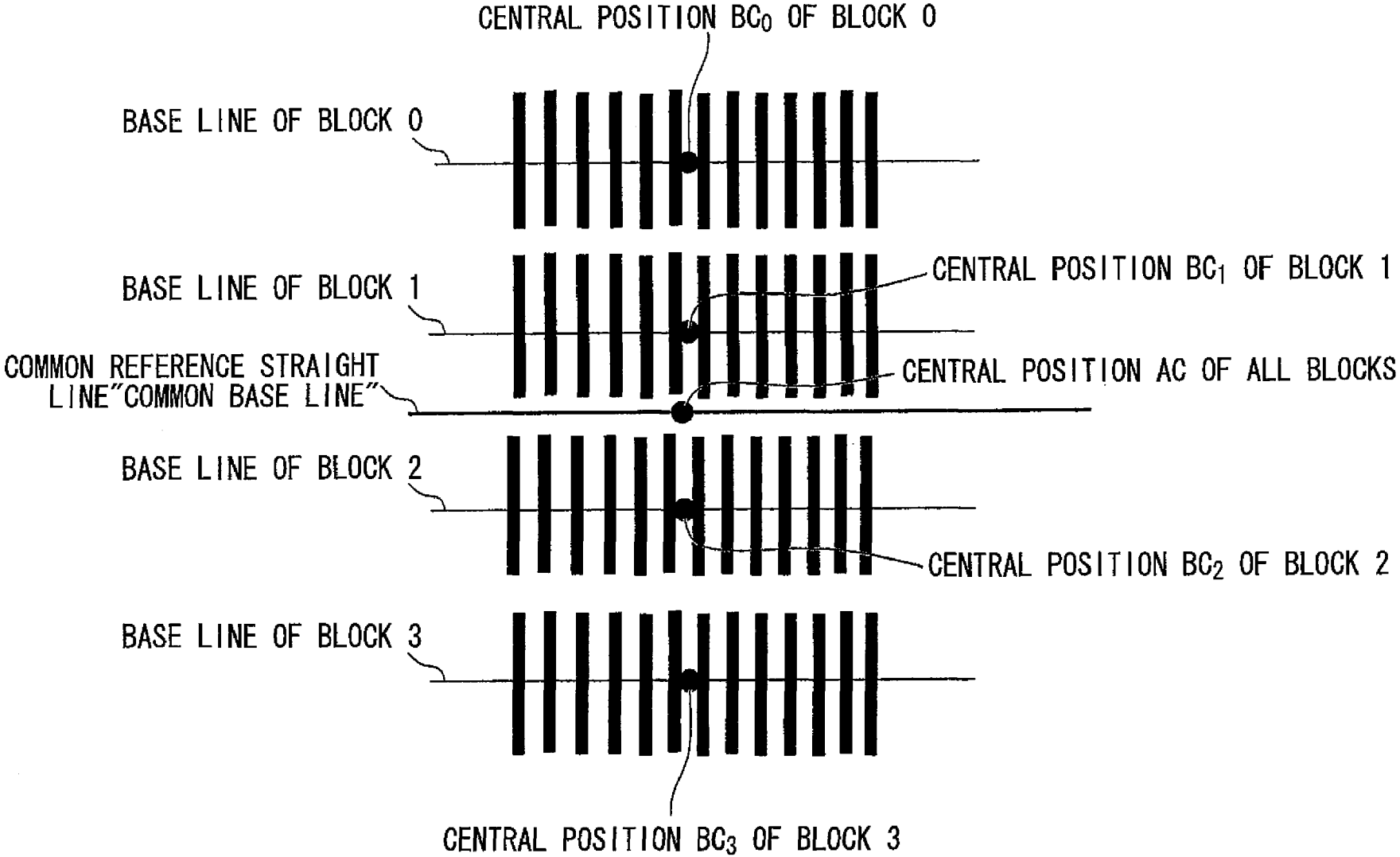
FIG. 22 is an illustrative diagram of a nozzle position calculation method.
Figure 23:
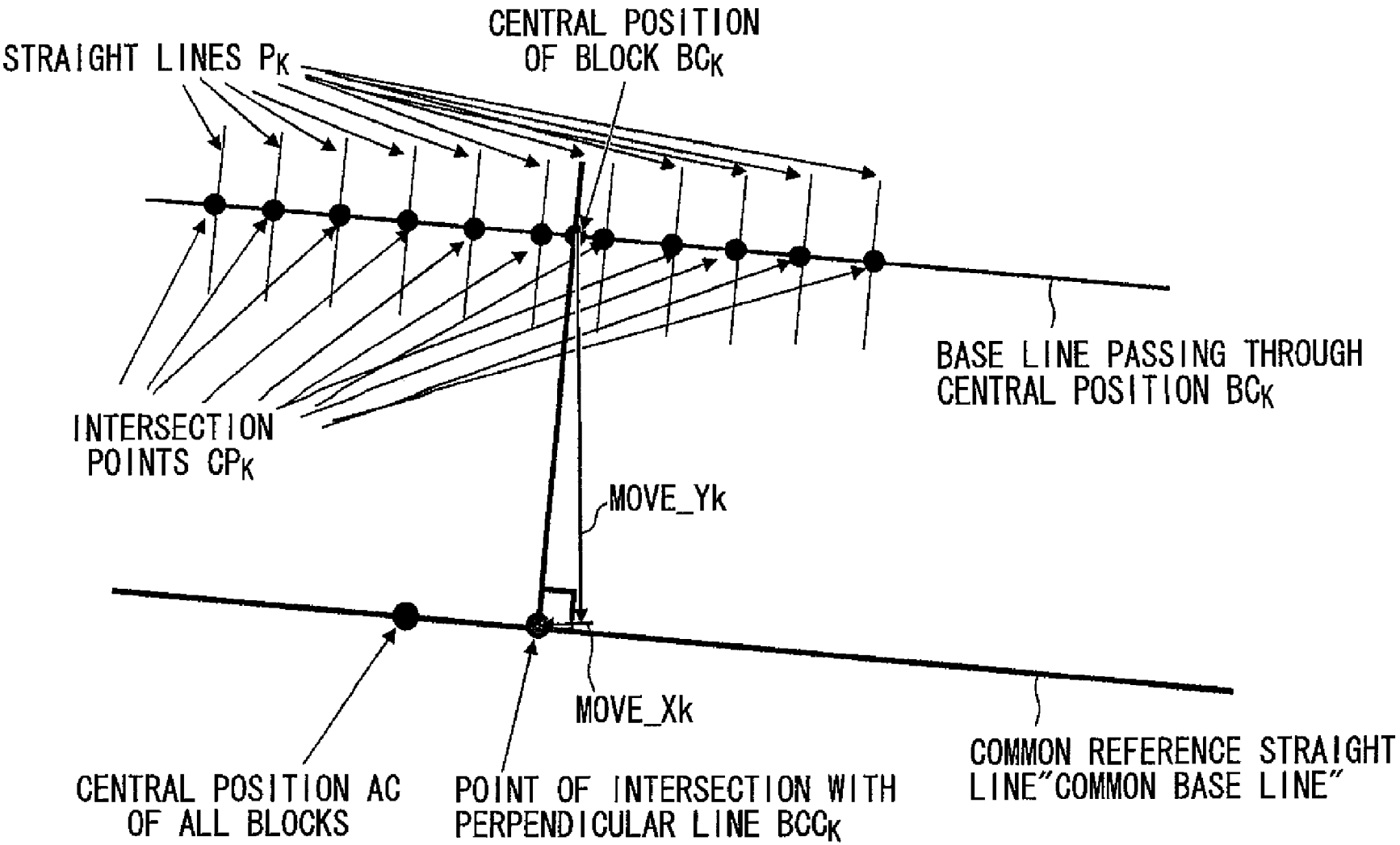
FIG. 23 is an illustrative diagram of a nozzle position calculation method.

If there are a plurality of line pattern blocks of this kind (for example, if using the sample chart shown in FIG. 8), then the average value of the gradient of the straight lines $P_k$ in all of the blocks is calculated, the gradient $\theta_V$ perpendicular to this gradient is found, and in each of the blocks, a straight line, "Base Line", which passes through the central position $BC_k$ of the respective block is determined (see FIG. 22), and the points of intersection $CP_k$ between the straight line, "Base Line", corresponding to the block and the respective straight lines $P_k$ determined for the line patterns contained in the block are found (see FIG. 23).

Next, the common reference line "Common Base Line" (gradient $\theta_V$) which passes through the central position AC of all of the blocks is determined, and as shown in FIG. 23, the point of intersection $BCC_k$ determined by the perpendicular line drawn down to $BBC_k$ from the central position $BC_k$ of each of the straight lines (Base Line) is found, and a parameter ($Move_X_k$, $Move_Y_k$) for the parallel movement from $BC_k$ to $BCC_k$ is calculated accordingly. The points $CP_k$ are then moved in parallel by using this parameter ($Move_X_k$, $Move_Y_k$). This is equivalent to mapping the "Base Lines" onto the common reference line, "Common Base Line". Here, $Move_X_k$ represents parallel movement in the X direction and $Move_Y_k$ represents parallel movement in the Y direction.

Since all of the blocks can be mapped to the common reference line, "Common Base Line", in this way, then the dot forming positions (nozzle positions), which are divided into respective blocks, can be determined in the form of common one-dimensional coordinates.

However, due to the effects of the conveyance accuracy of the image reading apparatus (scanner) and the variation in the sensor pitch, there may be error in the nozzle positions belonging to different blocks, when they are mapped to the common reference line, "Common Base Line", as described above. Even if the nozzle positions are mutually adjacent, they are separated in terms of the line pattern blocks on the sample chart, and therefore the measurement results can be significantly affected by the variations described above.

[Processing for Correcting Positional Error Between Line Pattern Blocks]

One desirable example of a means of resolving problems of this kind is to increase the determination accuracy of the positions between different blocks, compared to the positional accuracy of the reading apparatus, by adopting sample charts having a composition as shown in FIGS. 24 to 26, for example.

FIG. 24 is a diagram showing a sample chart in which a line derived from ink droplets ejected from a reference nozzle (nozzle number 0 in FIG. 24) is formed in all of the line pattern blocks. In other words, the sample chart in FIG. 24 contains a line pattern (indicated by reference numeral 130) formed by a common reference nozzle which is present in all of the line pattern blocks.

Error can be minimized by moving all of the nozzles positions belonging to each block, together in parallel, onto a common reference line, "Common Base Line", in such a manner that the position (peak position) of this reference line pattern is matching in all of the blocks.

FIG. 25 is a diagram showing an example of a further measurement pattern which takes account of the correction of positional error between blocks. In FIG. 25, a line pattern block created by nozzles having a nozzle number 5*m* (where m is an integer equal to or greater than 0) is formed below (after) the line pattern block formed by nozzles having a nozzle number of 4*n*+3. The nozzles belonging to the group 5*m* include nozzles having the nozzle numbers 4*n*, 4*n*+1, 4*n*+2, 4*n*+3, evenly. In other words, the respective lines m=0, 1, 2, 3, in the line pattern block created by the 5*m* nozzles are recorded respectively by the same nozzles as the nozzles 4*n* (n=0), 4*n*+1 (n=1), 4*n*+2 (n=2), 4*n*+3 (n=3) (the same applies below).

Therefore, it is possible to align the coordinate positions determined in each block, on the basis of the respective line positions in the 5*m* block. In the example described here, a line pattern created by the 5*m* nozzles is appended, but the nozzle numbers are not limited to multiples of 5 and a similar approach may be adopted using any integer other than multiples of 4. In other words, this same approach can be adopted provided that there are nozzle numbers which are common multiples.

In FIG. 25, the nozzle positions belonging to the block corresponding to the nozzle numbers 5*m* (where m=0, 1, 2, 3, . . . ) are taken to be correct positions, and these positions are used when correcting the nozzle positions of the other blocks so as to match the nozzle positions belonging to the block 5*m*.

A concrete example of this positional correction method is described below.

The line pattern block 5*m* shown at the bottom of FIG. 25 includes the nozzles numbered 0, 5, 10, 15, 20 . . . . For example, looking in particular at the 21st nozzle position, this nozzle "21" belongs to the block (4*n*+1). The nozzles numbered 5 and 25 which belong to both block 5*m* and block (4*n*+1) and which are disposed on either side of "21" are identified, and a parallel movement parameter is determined so as to match the nozzle 5 position in the 4*n*+1 block is determined, as well as a parameter for extending the distance between the nozzle 5 position and the nozzle 25 position so as to match the nozzle 25 position in the 4*n*+1 block. In this way, the nozzle 5 position and the nozzle 25 position in block 4*n*+1 are made to match the positions of nozzle 5 and nozzle 25 in the block 5*m*. The position of the nozzle number 21 is corrected by using the parallel movement parameter and the extending parameter.

In other words, if the dot position created by nozzle 5 and belonging to block 5*m*, is denoted as "P@5*m*", the position created by nozzle 25 and belonging to block 5*m*, is denoted as "P25@5*m*", the position created by nozzle 5 and belonging to block (4*n*+1), is denoted as "P5@(4*n*+1)" and the position created by nozzle 25 and belonging to block (4*n*+1) is denoted as "P25@(4*n*+1)", then the values are corrected by means of the following expressions.

$$(\text{output})=COEFA\times\{(\text{input value})-P5@(4n+1)\}+COEFB$$

$$COEFA=(P25@5n-P5@5n)/(P25@(4n+1)-P5@(4n+1))$$

$$COEFB=P5@5n.$$

If it is not possible to find nozzle positions belonging to common blocks which are disposed on either side as described above, then correction is carried out using the same correction parameters as the nearest position which belongs to common blocks. For example, correction is performed for nozzle number 1 (which belongs to the 4*n*+1 block) in the same fashion as if it were positioned between the nozzle numbers 5 and 25, which are the closest nozzles belonging to common blocks.

FIG. 26 is an example of a further measurement pattern which takes account of the correction of positional error between blocks.

FIG. 26 shows an example where the nozzle positions belonging to blocks which are disposed between reference blocks (in FIG. 26, 4*n* blocks) are corrected on the basis of variation in the reference blocks.

In FIG. 26, the same block as the block (4*n*) at one end of the sample chart is formed at the other end (the bottommost part of the FIG. 26). By means of this composition, it is possible to identify the variation in the positional relationship of the same nozzle, between the upper and lower versions of the same block (4*n*), and the variation in the positional relationship thus identified can be reflected in the blocks (4*n*+1, 4*n*+2, 4*n*+3) which are disposed between the two blocks (4*n*).

Figure 27:
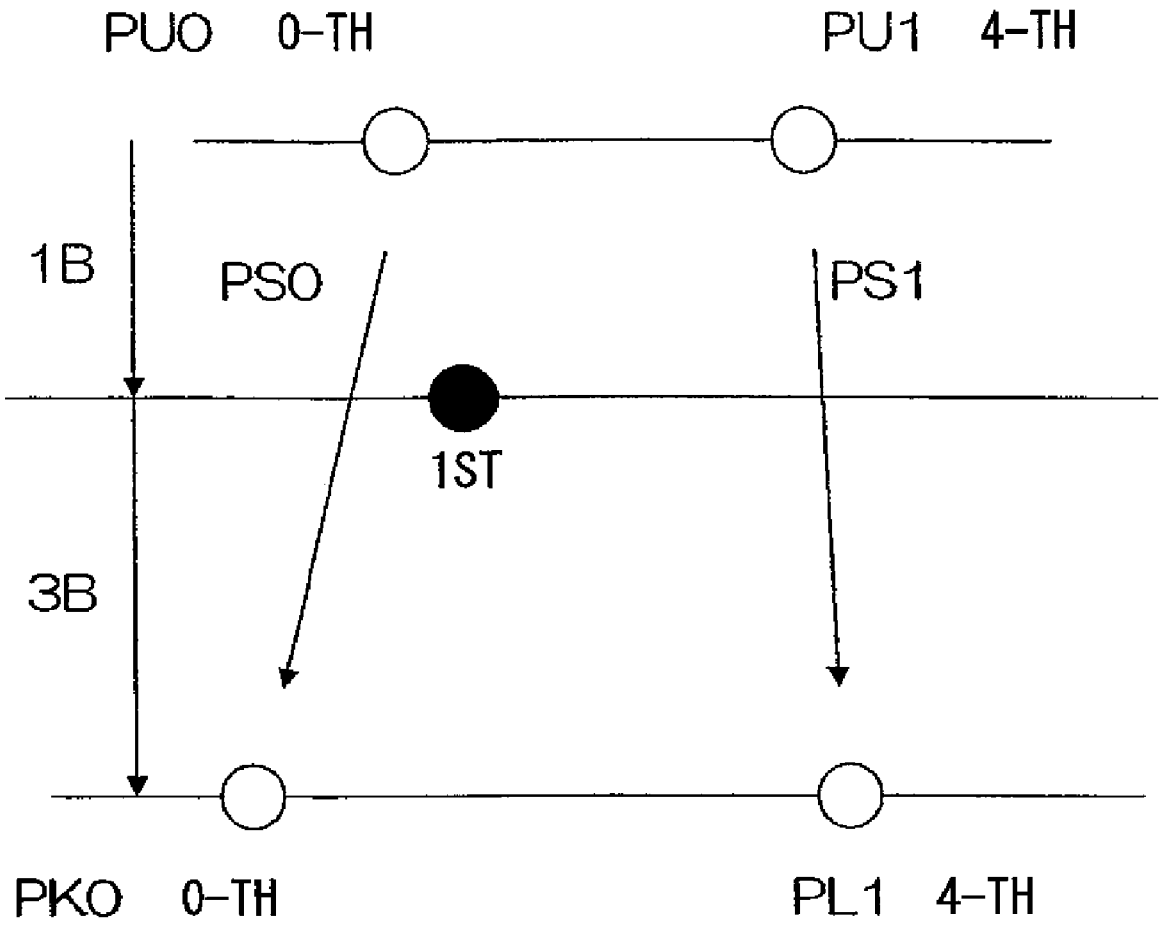
FIG. 27 is an illustrative diagram of positional alignment processing between blocks.

In FIG. 26, the distance in the Y direction between the position $U_i$ of the 4*n* block in the upper part and the position $L_i$ of the 4*n* block in the lower part is taken to be 4B, and the distance in the Y direction one block and the next block is taken to be B. Here, taking nozzle number 1 as an example, as shown in FIG. 27, the nozzle number 0 and the nozzle number 4 belonging block 4*n*, which are disposed on either side of the nozzle number 1, are converted from upper 4*n* block to lower

4*n* block in the following manner from the positions PU0 and PU1 in the upper end block, to the positions PL0, PL1 in the lower end block, via the block 4*n*+1 to which the nozzle number 1 belongs.

$$(\text{output value})=COEFS\times\{(\text{input value})-PU0\}+COEFT$$

$$COEFS=(PL1-PL0)/(PU1-PU0),\text{ and}$$

$$\text{COEFT}=\text{PL0}$$

As shown in FIG. 27, the distance in the Y direction from the upper 4*n* block to the lower 4*n* block is 4B, whereas the distance from the 4*n*+1 block to the lower block is 3B, and therefore the following correction formula is used to correct the position of the nozzle number 1.

$$(\text{output value})=COEFS\times\{(\text{input value})-PU0)\}+COEFT$$

$$COEFS=(PS1-PS0)/(PU1-PU0)$$

$$\text{COEFT}=\text{PL0}$$

$$PS0=PL0+(PU0-PL0)\times 3/4$$

$$PS1=PL1+(PU1-PL1)\times 3/4$$

If positions on either side of the position under investigation do not exist, then the nearest nozzle numbers of the group 4*n* are used and the correction formula between these two nozzles is applied.

Next, the sequence of the dot measurement processing according to the present embodiment will be described with reference to a flowchart.

FLOWCHART EXAMPLE 1

Figure 28:
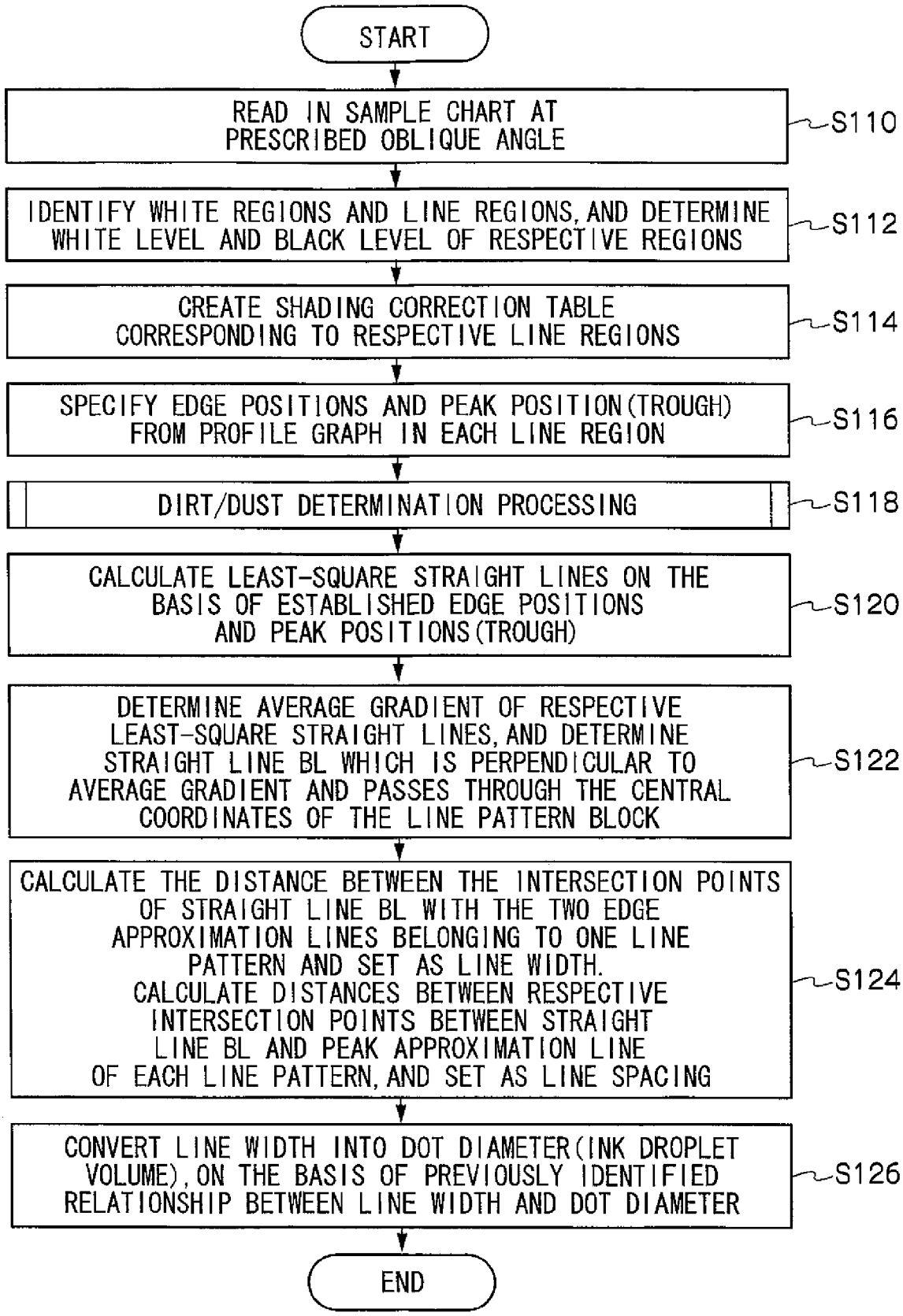
FIG. 28 is a flowchart showing an example of a sequence of dot measurement processing (first example)

FIG. 28 is a flowchart showing a first example of the dot measurement processing. As shown in FIG. 28, firstly, the sample chart is read in at a prescribed oblique angle and electronic image data for the captured image is acquired (step S110).

As shown in FIGS. 13, 16 and 17, the white regions and the line regions are identified from this captured image, and the white level and the black level in the respective regions are determined (step S112 in FIG. 28).

Thereupon, a shading correction table corresponding to the respective line regions is created on the basis of the white level and black level information thus obtained (step S114). The method for carrying out shading correction for the X direction and the Y direction has been described already above.

Subsequently, in each of the line regions, the edge positions (left and right-hand edges) and the peak position (which may also be the trough position; the same applies below) are identified on the basis of the profile graph (step S116).

Thereupon, a sub-routine (see FIG. 29) for dust/dirt determination processing is carried out (step S120).

Figure 29:
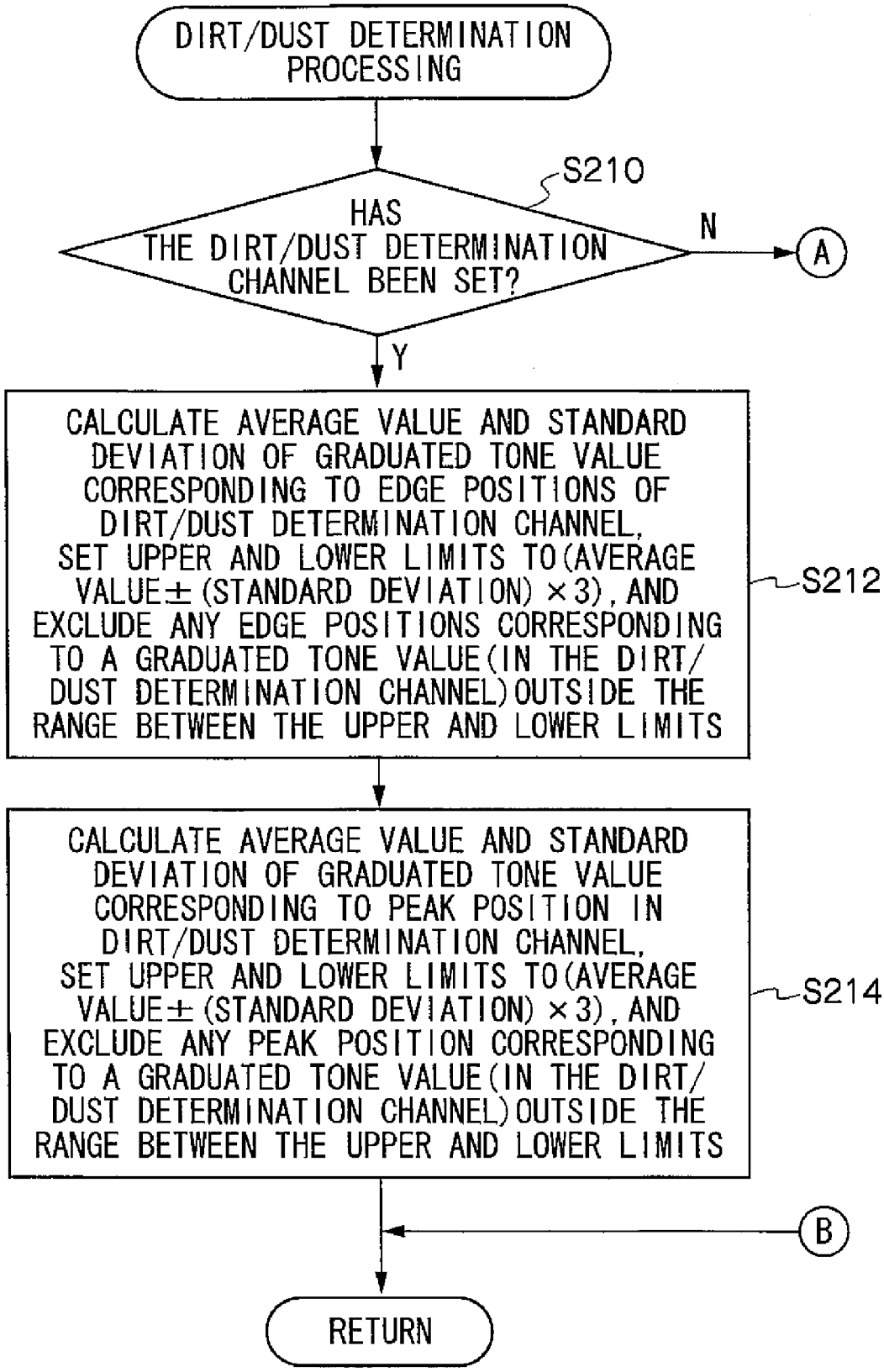
FIG. 29 is a flowchart showing the contents of dirt/dust determination processing
Figure 29:
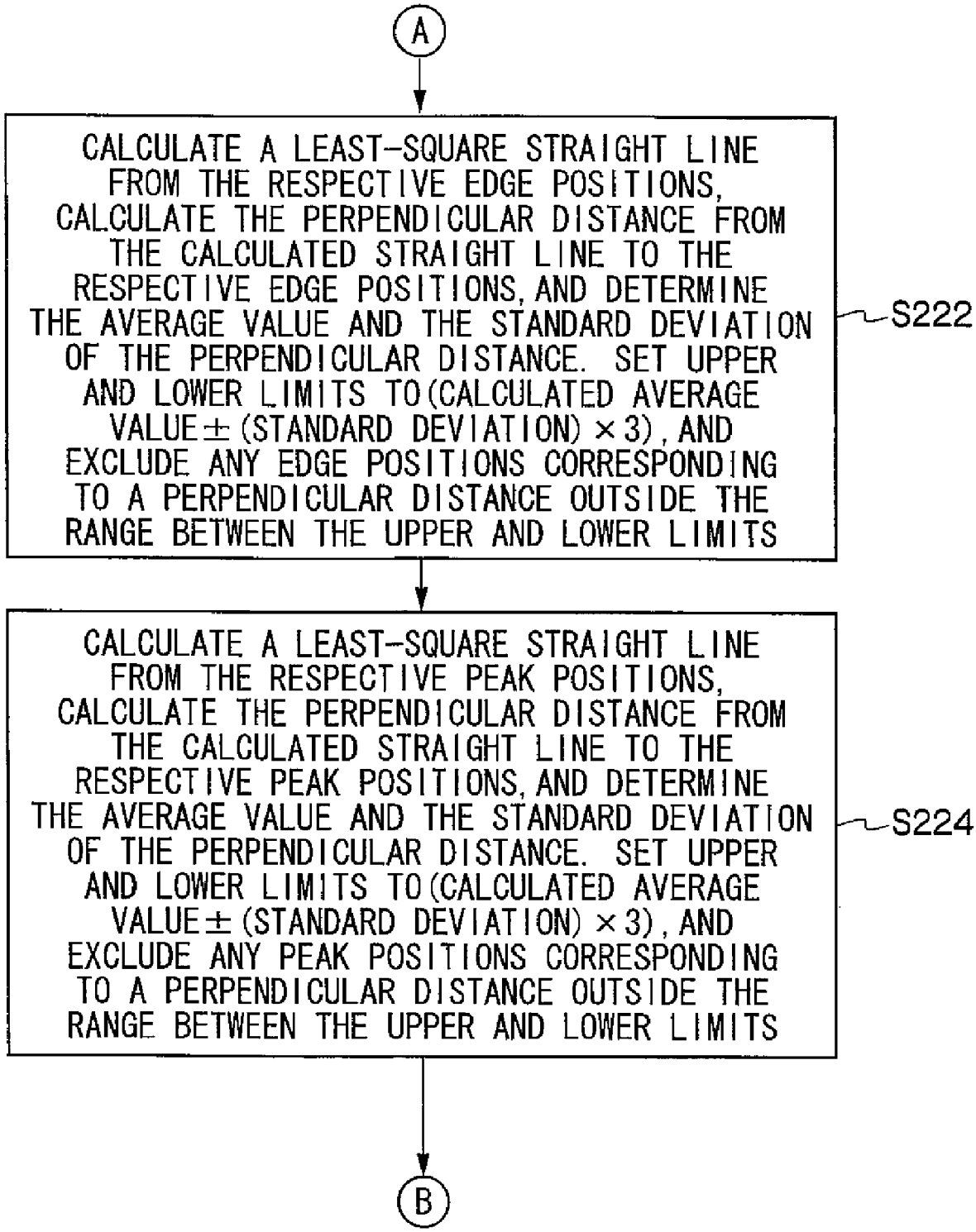

FIG. 29 is a diagram showing a flowchart of dust/dirt determination processing. When the sub-routine of the dirt/dust determination processing shown in FIG. 29 is started, then firstly, it is judged whether or not the dirt/dust determination channel has been set (step S210). If the verdict is YES, then the procedure advances to step S212. At step S212, the average value and the standard deviation of the graduated tone values corresponding to the edge positions obtained from the profile graph in the dirt/dust determination channel are calculated, upper and lower limits corresponding to a value of (average value ± standard deviation×3) are established, and any edge positions (in other words, edge positions obtained from the measurement channel) corresponding to graduated tone values which are outside the range between the upper and lower limits (graduated tone values in the dirt/dust determination channel) are excluded.

Subsequently, at step S214, the average value and the standard deviation of the graduated tone values corresponding to the peak position obtained from the profile graph in the dirt/dust determination channel are calculated, upper and lower limits corresponding to a value of (average value ± standard deviation×3) are established, and any peak positions (in other words, peak positions obtained from the measurement channel) corresponding to graduated tone values which are outside the range between the upper and lower limits (graduated tone values in the dirt/dust determination channel) are excluded.

On the other hand, at step S210, if the dirt/dust determination channel has not been set (NO verdict), then the procedure advances to step S222.

At step S222, the least-square straight line is calculated from the respective edge positions calculated from the plurality of profile graphs in the same line region, and the perpendicular distances from the straight line thus obtained to the respective edge positions are calculated, and the average value and standard deviation of these perpendicular distances are found. An upper limit and a lower limit are set at a value of (average value ± standard deviation×3), and any edge positions (obtained from the measurement channel) corresponding to a perpendicular distance outside the range between the upper limit and the lower limit are excluded.

Subsequently, at step S224, the least-square straight line is calculated from the respective peak positions calculated from the plurality of profile graphs in the same line region, the perpendicular distances from the straight line thus obtained to the respective peaks positions are calculated, and the average value and standard deviation of these perpendicular distances are found. An upper limit and a lower limit are set at a value of (average value +standard deviation×3), and peak positions (obtained from the measurement channel) corresponding to a perpendicular distance outside the range between the upper limit and the lower limit are excluded.

After the processing in step S214 or S224, the procedure leaves the sub-routine in FIG. 29 and returns to the sequence in FIG. 28 (step S120).

At step S120 in FIG. 28, least-square straight lines are calculated respectively on the basis of the remaining edge positions and peak positions which have not been excluded in the dirt/dust determination processing in step S118 (step S120).

The average value of the gradients of the respective least-square straight lines is determined, and a straight line "Base Line" (hereinafter, referred to as "straight line BL"), which is perpendicular to the average value of the gradient and which passes through the central coordinates of the line pattern block, is determined (step S122).

Thereupon, at step S124, the distance between the straight line BL and the two edge approximation lines which belong to one line pattern are calculated, and the distance thus obtained is taken as the "line width". Furthermore, the distances between the respective points of intersection between the straight line BL and the peak approximation lines of the line patterns are calculated, and the distances thus obtained are taken as the "line interval". The "line interval" obtained in this way indicates the dot deposition positions created by the respective nozzles.

Thereupon, processing is carried out for converting the information about the line width into dot diameter information or ink volume information, or both, on the basis of a previously established relationship between the line width and the dot diameter (or ink volume) (step S126).

The information on the dot deposition positions (line intervals) and dot diameters (ink volume) obtained by the steps described above is input to the inkjet recording apparatus, and is used for correcting droplet ejection and controlling head maintenance, and the like.

FLOWCHART EXAMPLE 2

Figure 30:
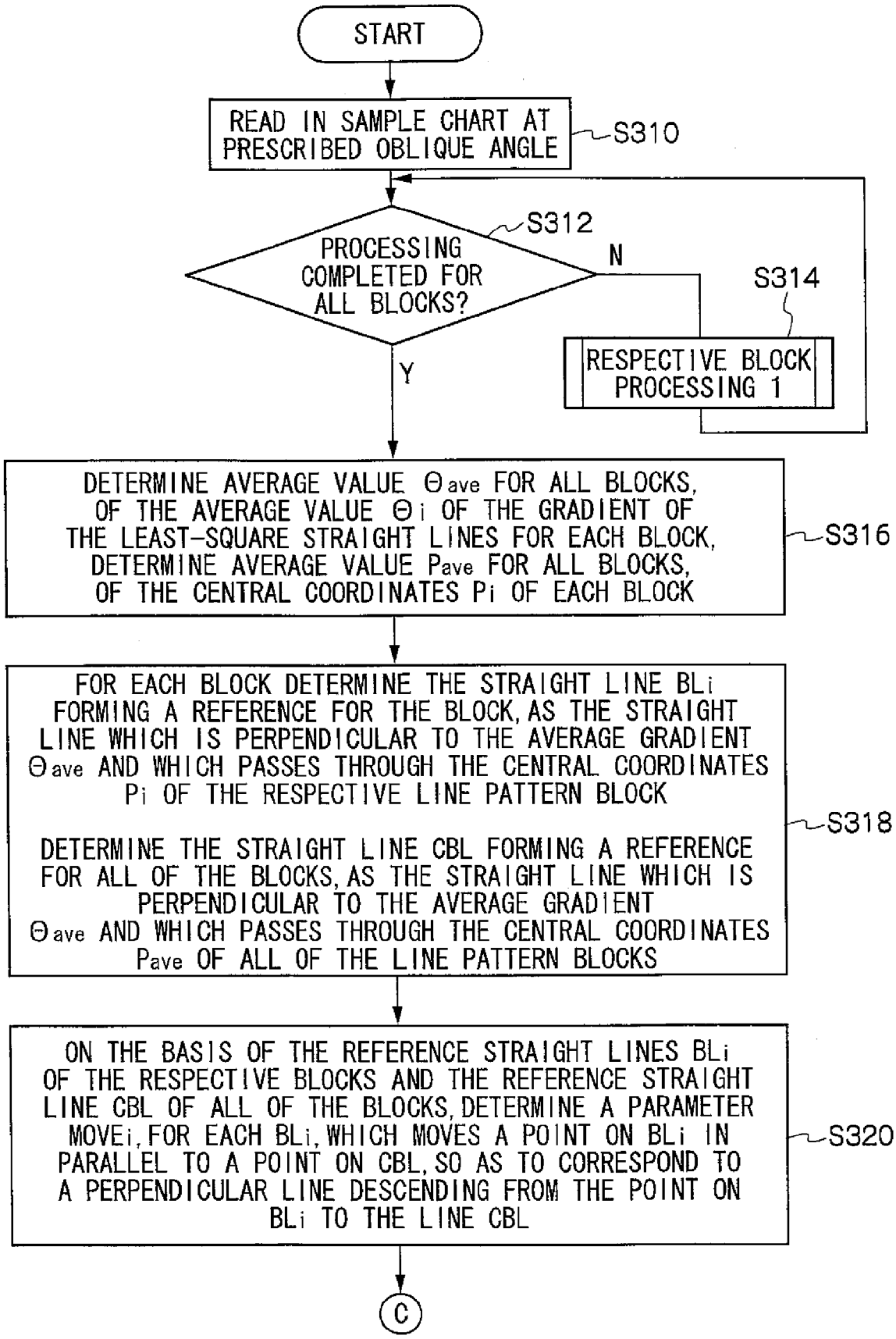
FIG. 30 is a flowchart showing an example of a sequence of dot measurement processing (second example)
Figure 30:
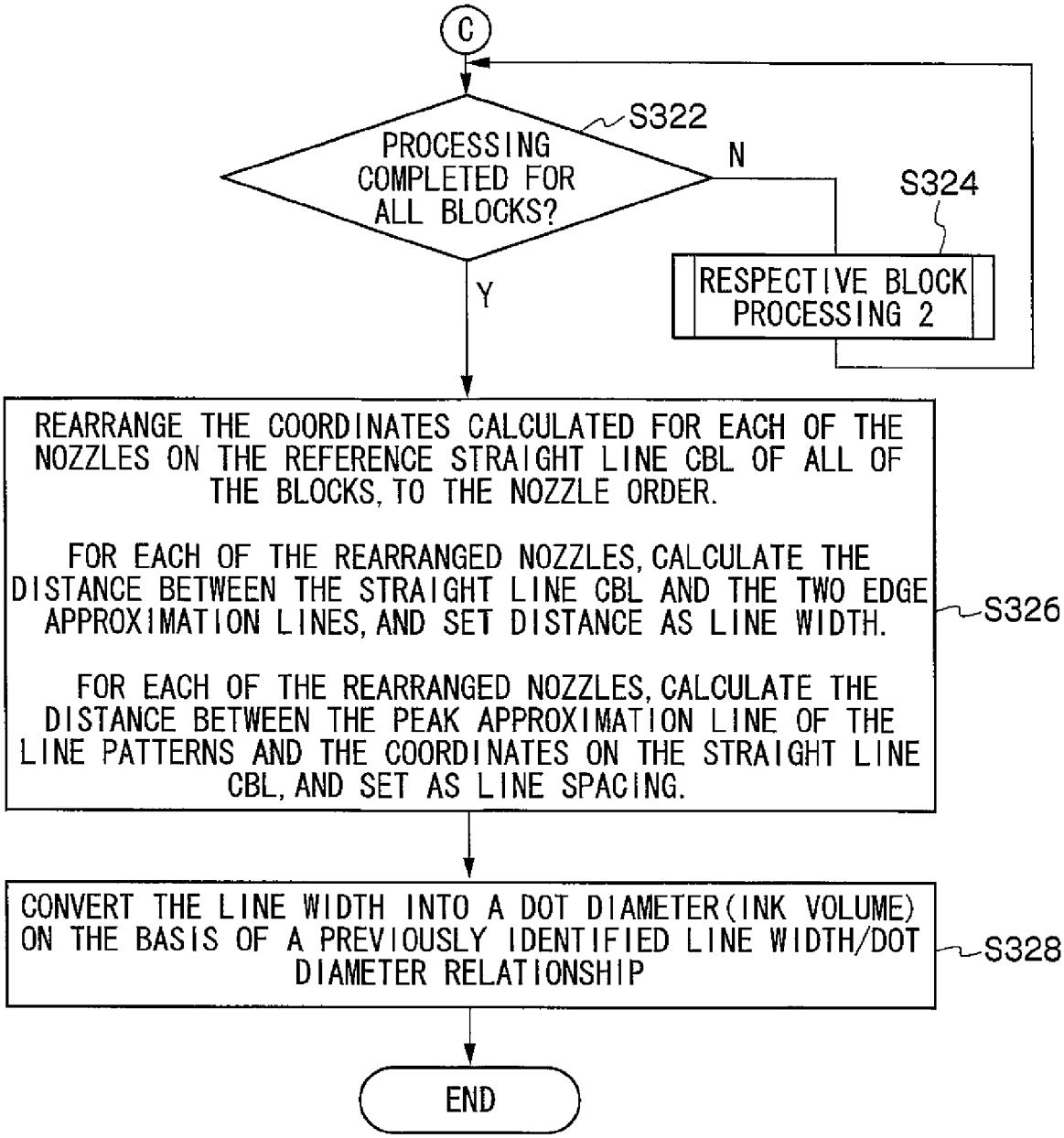

FIG. 30 is a flowchart showing a second example of the measurement processing. As shown in FIG. 30, firstly, the sample chart is read in at a prescribed oblique angle and electronic image data is acquired (step S110).

Thereupon, the procedure advances to step S312, and it is judged whether or not block processing 1 (the sub-routine processing shown in FIG. 31) has been completed in respect of all of the line pattern blocks in the sample chart. If the verdict is NO at step S312, then the procedure advances to step S314, and the block processing 1 is carried out in respect of the blocks that have not been processed.

Figure 31:
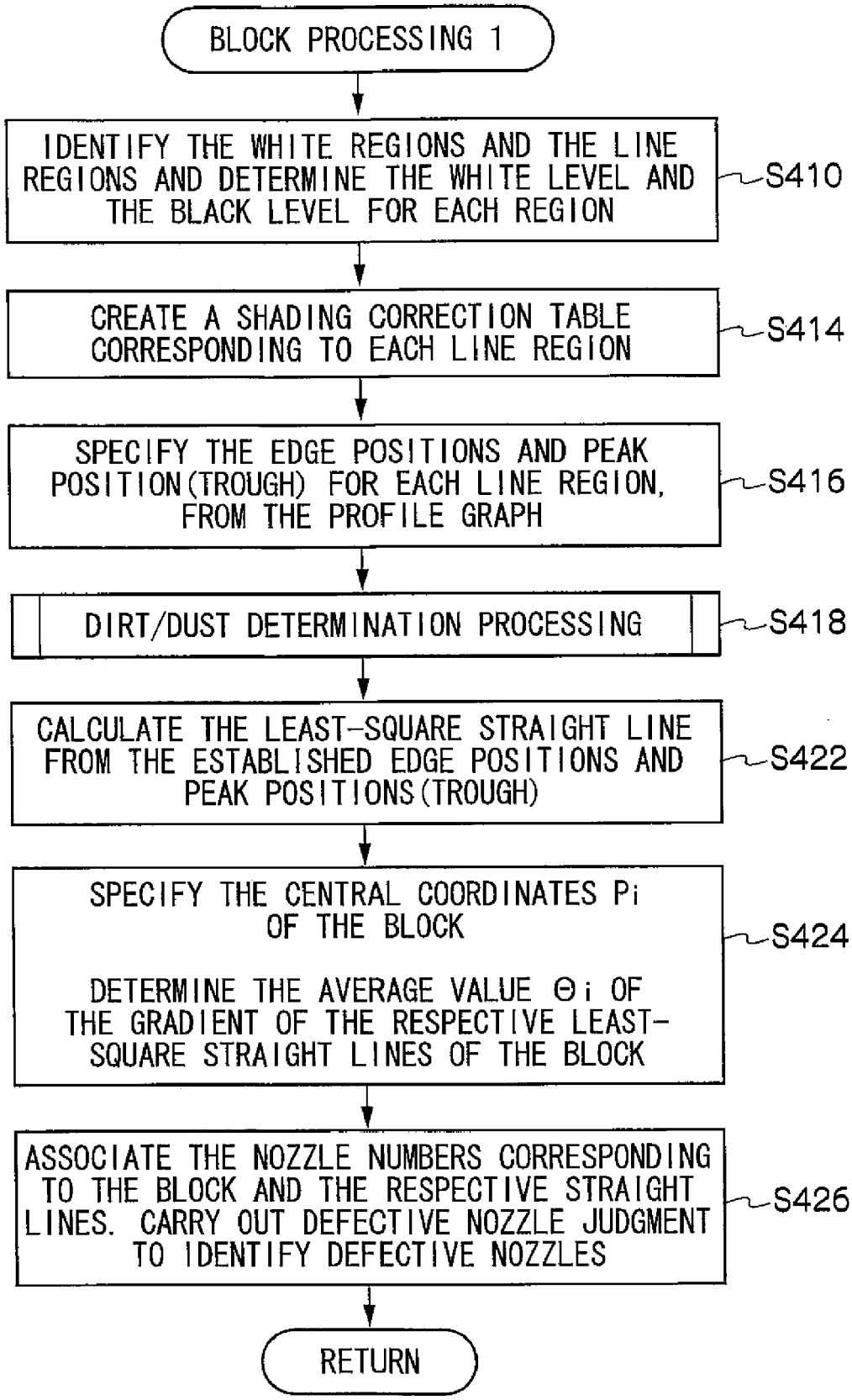
FIG. 31 is a flowchart showing the contents of block processing 1 in FIG. 30.

FIG. 31 is a flowchart showing the contents of the sub-routine of the block processing 1. When the sub-routine of the block processing 1 shown in FIG. 31 is started, firstly, the white region and the line region are identified, and the white level and the black level of the respective regions are determined (step S410). Thereupon, a shading correction table corresponding to the respective line regions is created (step S414).

In each of the line regions, the edge positions (left and right-hand edges) and the peak position (which may also be the trough position; the same applies below) are identified on the basis of the profile graph (step S416).

Thereupon, a sub-routine (see FIG. 29) for dust/dirt determination processing is carried out (step S418). Next, the least-square straight line is calculated on the basis of the established edge positions and peak positions (step S422).

Furthermore, the central coordinates $P_i$ of the block in question are determined, and the average value $\theta_i$ of the gradients of the respective least-square straight lines for the block is determined (step S424).

Next, the procedure advances to step S426 and the nozzle numbers corresponding to the block and the straight lines are mutually associated. A process for judging defective nozzles described hereinafter (shown by the flowchart in FIG. 32) is carried out, and defective nozzles are identified (step S426 in FIG. 31). After the processing in step S426, the procedure leaves the sub-routine in FIG. 31 and returns to the sequence in FIG. 30 (step S312).

Figure 32:
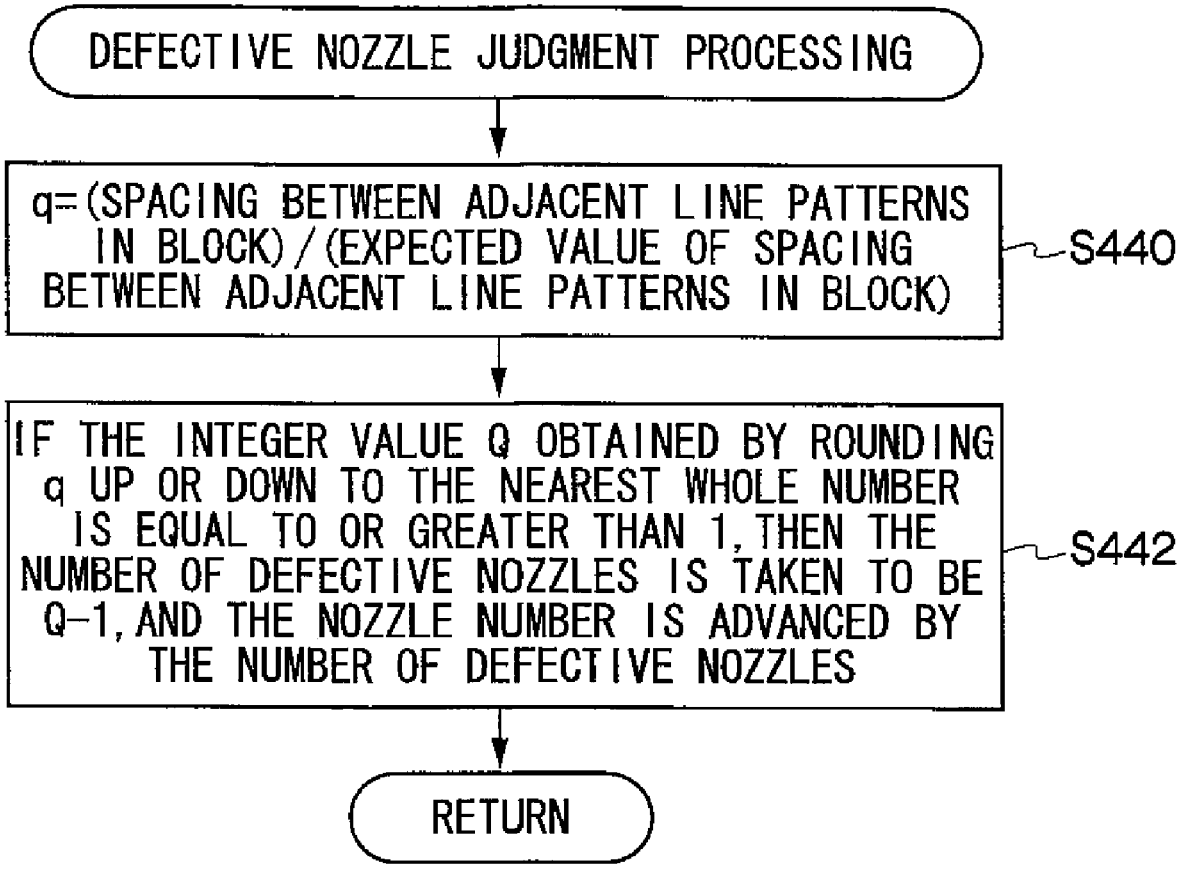
FIG. 32 is a flowchart showing the contents of defective nozzle judgment processing.

FIG. 32 is a flowchart showing the sub-routine of the defective nozzle judgment processing. As shown in FIG. 32, in the defective nozzle judgment processing, firstly the interval between line patterns which are mutually adjacent in the block in question is divided by the expected value of the interval between mutually adjacent line patterns in that block, and the result is set as q (step S440). Thereupon, if the integer value Q obtained by rounding the value of q thus determined up or down to the nearest integer is equal to or greater than 1, then the number of defective nozzles is taken to be Q−1, and the nozzle number is incremented by an amount corresponding to the number of defective nozzles (step S442). When this processing for identifying defective nozzles has terminated, the procedure returns to step S312 in FIG. 30.

When the block processing 1 has been completed for all of the blocks in the sample chart, then a YES verdict is obtained at step S312 in FIG. 30 and the procedure then advances to step S316. At step S316, the average value $\theta_{ave}$, over all of the blocks, of the average value $\theta_i$ of the gradient of the least-square straight line of each block, is determined, and similarly, the average value $P_{ave}$, over all of the blocks, of the central coordinates $P_i$ of each block is also determined (step S316).

Thereupon, in each block, the straight line $BL_i$ forming the reference for the block is determined as a straight line which is perpendicular to the average gradient value $\theta_{ave}$ and which passes through the central coordinates $P_i$ of the line pattern block, and furthermore, a common reference straight line, "Common Base Line" (hereinafter, also referred to as "straight line CBL") forming a reference for all of the blocks is determined as a straight line which is perpendicular to the average gradient value $\theta_{ave}$ and which passes through the central coordinates $P_{ave}$ of all of the line pattern blocks (step S318).

On the basis of the reference straight lines $BL_i$ of the respective blocks and the common reference straight line CBL of all of the blocks, a parameter $MOVE_i$ is determined for each $BL_i$, in order to move a point on $BL_i$, in parallel, to a point on CBL, so as to correspond to a perpendicular line descending from the point on $BL_i$ to CBL (step S320).

Thereupon, the procedure advances to step S322, and it is judged whether or not block processing 2 (the sub-routine processing shown in FIG. 33) has been completed in respect of all of the line pattern blocks in the sample chart. If the verdict is NO at step S322, then the procedure advances to step S324, and the block processing 2 is carried out in respect of the blocks that have not been processed.

Figure 33:
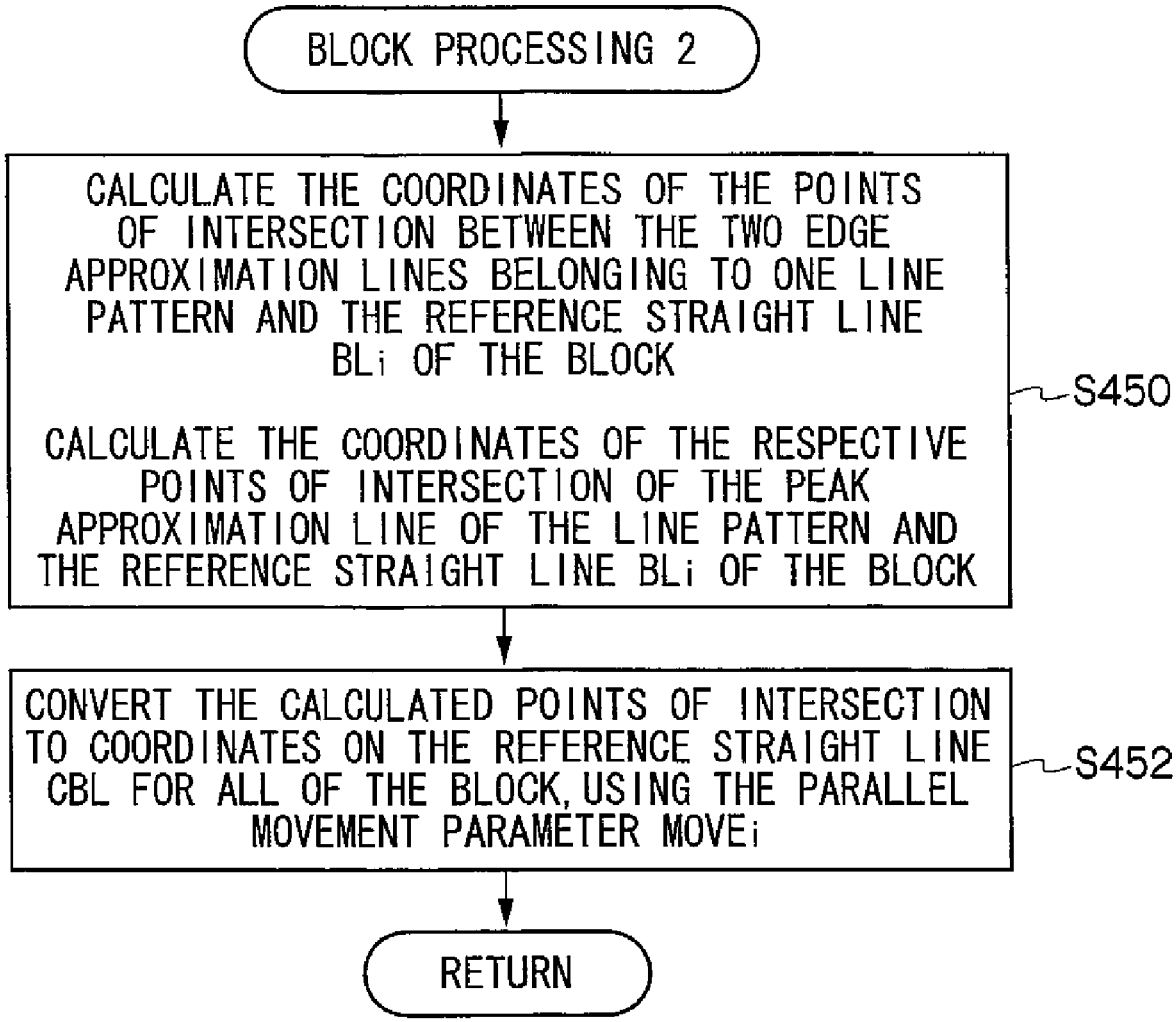
FIG. 33 is a flowchart showing the contents of block processing 2 in FIG. 30.

FIG. 33 is a flowchart showing the contents of the sub-routine of the block processing 2. When the processing shown in FIG. 33 is started, firstly, the coordinates of the points of intersection between the two edge approximation lines belonging to the same line pattern and the reference straight line $BL_i$ for the block in question are calculated, and furthermore, the coordinates of the point of intersection between the peak approximation line of the line pattern and the reference straight line $BL_i$ of the block are calculated (step S450). The points of intersection thus obtained are then converted to coordinates on the reference straight line CBL of all the blocks, by using the parallel movement parameter MOVES which moves the points of intersection onto the line CBL (step S452). After the processing in step S452, the procedure leaves the sub-routine in FIG. 33 and returns to the sequence in FIG. 30 (step S322).

When the block processing 2 has been completed for all of the blocks in the sample chart, then a YES verdict is obtained at step S322 in FIG. 30 and the procedure then advances to step S326. At step S326, the calculated coordinates on the reference straight line CBL of all of the blocks of the nozzles are rearranged in nozzle order. Thereupon, for each of the rearranged nozzles, the distance between the two edge approximation lines and the coordinates on the straight line CBL are calculated, and the distances thus found are taken to be the line width (step S326).

Thereupon, processing is carried out for converting the information about the line width into dot diameter information or ink volume information, or both, on the basis of a previously established relationship between the line width and the dot diameter (or ink volume) (step S328).

FLOWCHART EXAMPLE 3

Figure 34:
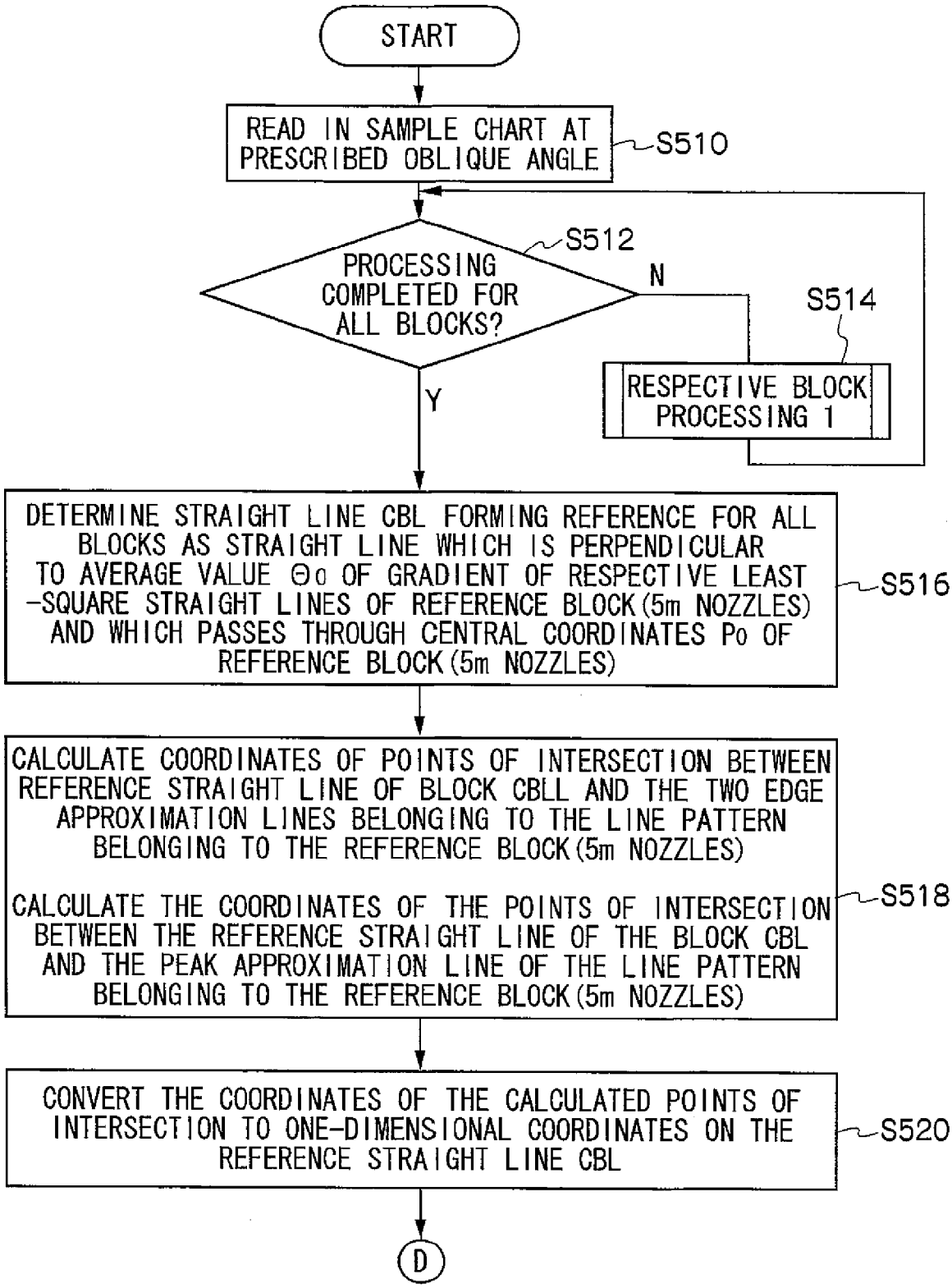
FIG. 34 is a flowchart showing an example of a sequence of dot measurement processing (third example)
Figure 34:
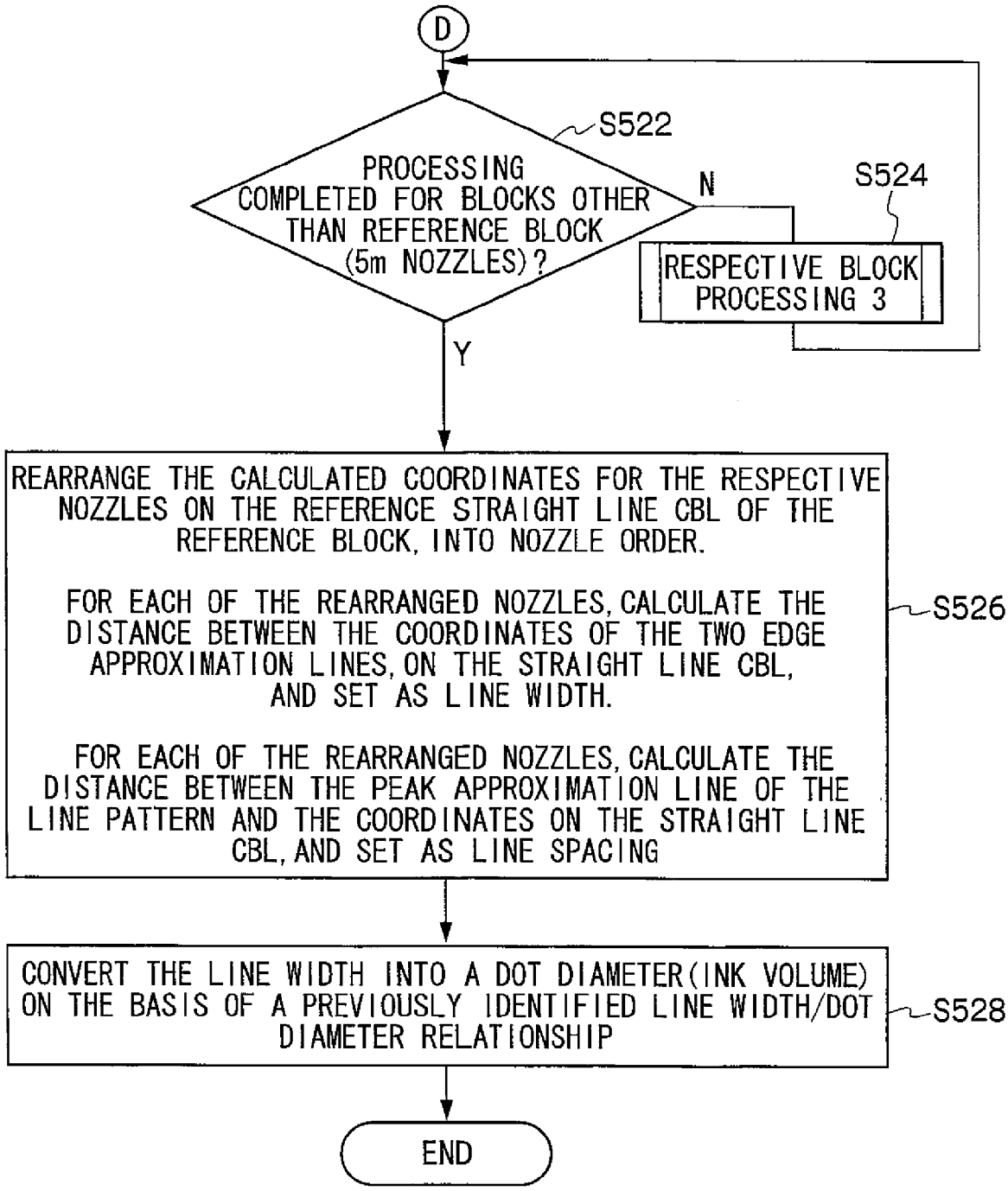

FIG. 34 is a flowchart showing a third example of the dot measurement processing. As shown in FIG. 34, firstly, the sample chart is read in at a prescribed oblique angle and electronic image data is acquired (step S510).

Thereupon, the procedure advances to step S512, and it is judged whether or not block processing 1 (the sub-routine processing shown in FIG. 31) has been completed in respect of all of the line pattern blocks in the sample chart. If the verdict is NO at step S512, then the procedure advances to step S514, and the block processing 1 is carried out in respect of the blocks that have not been processed.

When the block processing has been completed for all of the blocks in the sample chart, then a YES verdict is obtained at step S512 and the procedure then advances to step S516. At step S516, the straight line CBL which serves as a reference for all of the blocks is determined, as the straight line which is perpendicular to the average gradient value $\theta_0$ of the gradients of the respective least-square straight lines of the reference block (5*m* nozzles), and which passes through the central coordinates P0 of the reference block (5*m* nozzles).

Next, the procedure advances to step S518, and the coordinates of the points of intersection between the reference straight line CBL of the block and the two edge approximation lines (i.e., a right edge approximation line and left edge approximation line) for each of the line patterns of the reference block (5*m* nozzles) are calculated. Furthermore, the coordinates of the respective points of intersection between the reference straight line CBL of the block and the peak approximation line for each of the line patterns belonging to the reference block (5*m* nozzles) are calculated (step S518).

Thereupon, the coordinates of the points of intersection obtained by the calculation in step S518 are converted into one-dimensional coordinates on the reference straight line CBL (step S520).

Thereupon, the procedure advances to step S522, and it is judged whether or not block processing 3 (the sub-routine processing shown in FIG. 35) has been completed in respect of all of the line pattern blocks in the sample chart. If the verdict is NO at step S522, then the procedure advances to step S524, and the block processing 3 is carried out in respect of the blocks that have not been processed.

Figure 35:
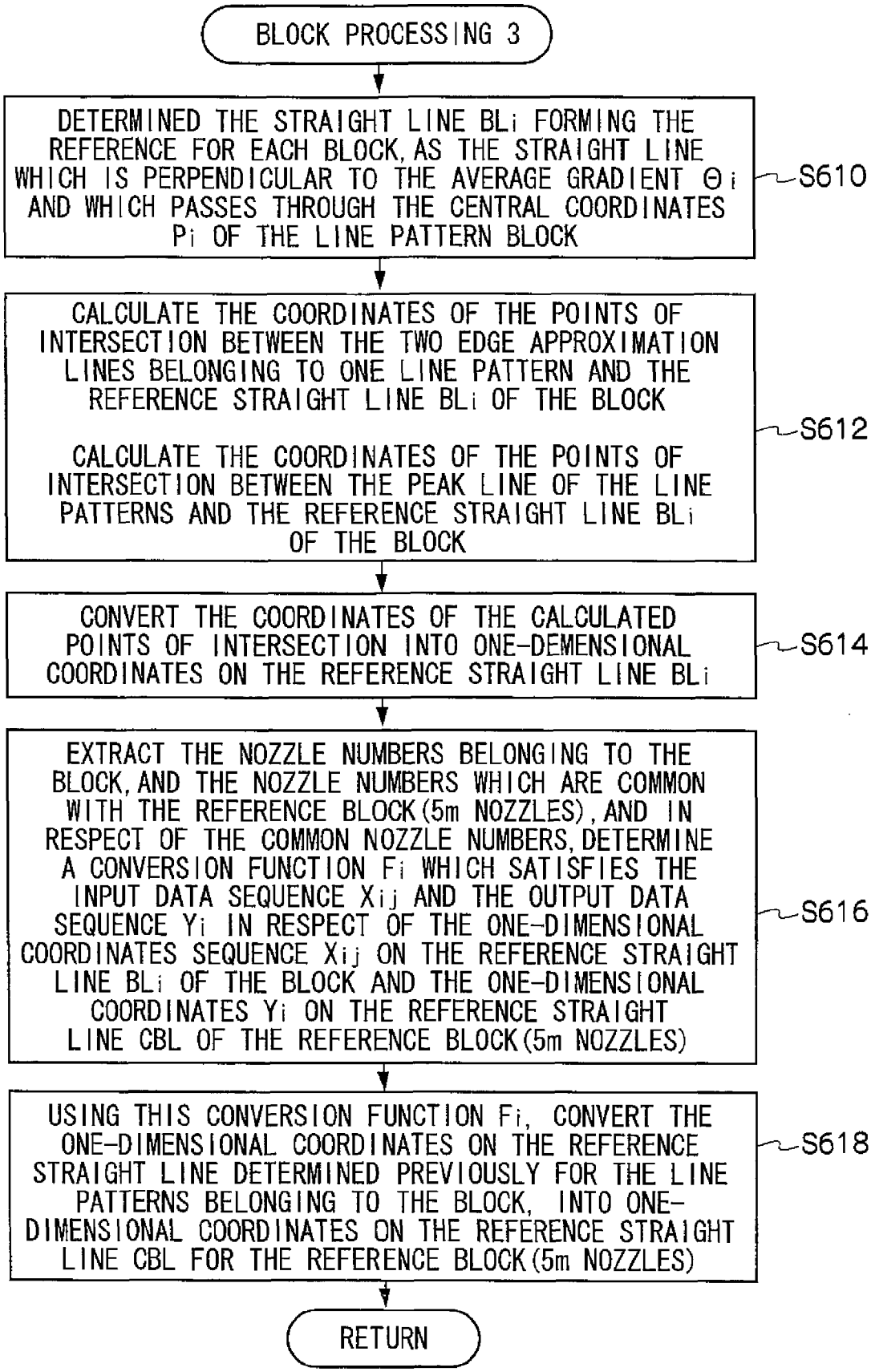
FIG. 35 is a flowchart showing the contents of block processing 3 in FIG. 34.

FIG. 35 is a flowchart showing the contents of the sub-routine of the block processing 3. When the processing shown in FIG. 35 is started, the straight line $BL_i$ serving as a reference for the respective blocks is determined as a straight line which is perpendicular to the average gradient value $\theta_i$ and which passes through the central coordinates $P_i$ of the respective line pattern block (step S610).

Next, the procedure advances to step S612, and the coordinates of the points of intersection between the reference straight line $BL_i$ of the block and the two edge approximation lines for each of the line patterns are calculated. Furthermore, the coordinates of the respective points of intersection between the peak approximation lines of the line patterns and the reference straight line $BL_i$ of the block in question are calculated (step S612).

Thereupon, the coordinates of the points of intersection calculated by this process are converted into one-dimensional coordinates on the reference straight line $BL_i$ (step S614).

Subsequently, the nozzle numbers belonging to this block and the nozzle numbers which are common with the reference block (5*m* nozzles) are extracted, and in respect of the common nozzle numbers, a conversion function F1 satisfying the input data sequence $X_{ij}$ and the output data sequence $Y_i$ is determined for the one-dimensional coordinates sequence $X_{ij}$ on the reference straight line $BL_i$ of the block, and the one-dimensional coordinates $Y_j$ on the reference straight line CBL of the reference block (5*m* nozzles) (step S616).

The one-dimensional coordinates on the reference straight line $BL_i$ determined previously for the line patterns belonging to the block in question are converted by means of the conversion function F1 into one-dimensional coordinates on the reference straight line CBL of the reference block (5*m* nozzles) (step S618).

Figure 36:
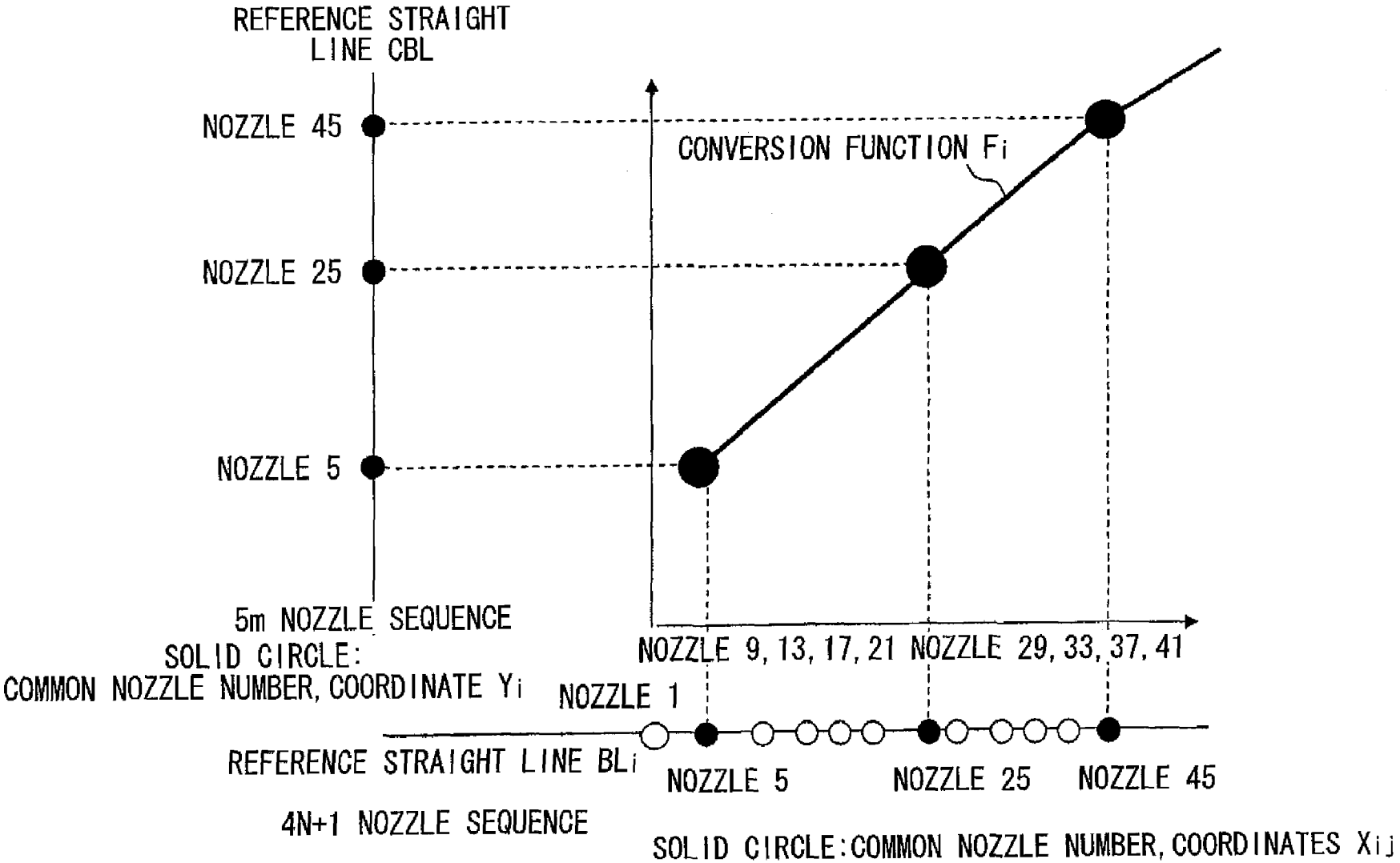
FIG. 36 is an illustrative diagram of conversion function $F_i$.

FIG. 36 is a diagram showing the conversion function F1 for the block i. The nozzles 5, 25 and 45 belonging to the block (4N+1 nozzles) are in common with the reference block (5*m* nozzles).

The conversion function F1 has conversion characteristics whereby the one-dimensional coordinates of these common nozzles on the reference straight line $BL_i$ are taken as an input, and one-dimensional coordinates $Y_j$ on the reference straight line CBL of all of the blocks are output accordingly.

These characteristics may be achieved by linear interpolation, or alternatively, it is possible to use Lagrange interpolation or spline interpolation.

It is also possible to use an interpolation function which has characteristics for converting from $X_{ij}$ to $Y_j$ and which maps all of the other points smoothly.

Using this conversion function F1 and interpolation processing, the coordinates (i.e., the coordinates of the nozzles 5, 9, 13, . . . ) on the straight line $BL_i$ are converted into coordinates on the reference straight line CBL which is common to all of the blocks.

If the interpolation processing uses linear interpolation, then the coordinates of the nozzle 1 on the reference straight line $BL_i$ are converted into coordinates on the reference straight line CBL which is common to all of the blocks, using interpolation characteristics similar to the most proximate interpolation processing.

In this way, when the processing in step S618 in FIG. 35 has been completed, the procedure leaves the sub-routine in FIG. 35 and returns to the procedure in FIG. 34 (step S522).

When the block processing 3 has been completed for all of the blocks in the sample chart, then a YES verdict is obtained at step S522 in FIG. 34 and the procedure then advances to step S526. At step S526, the calculated coordinates on the reference straight line CBL of the reference blocks of the nozzles are rearranged in nozzle order.

The distance between the two edge approximation lines and the coordinates on the straight line CBL is calculated, in respective of each of the rearranged nozzles, and this distance is set as the line width. The distance between the peak approximation line of the line pattern and the coordinates on the straight line CBL is calculated, in respect of each of the rearranged nozzles, and this distance is set as the line width.

Thereupon, processing is carried out for converting the information about the line width into dot diameter information or ink volume information, or both, on the basis of a previously established relationship between the line width and the dot diameter (and/or ink volume) (step S528).

As described above, according to the dot measurement method of the present embodiment, beneficial effects of the following kind are obtained.

(1) It is possible to measure both the dot deposition positions and the dot diameters (and/or ink volume), simultaneously and with good accuracy, from the electronic image data obtained by capturing (reading in) the sample chart once. Therefore, it is possible to minimize the number of times that a sample chart needs to be created and captured as an image.

(2) It is possible to read in the sample chart at a lower resolution than that used in the reading method of the related art, which does not adopt obliquely reading method (i.e., reading in the image at an oblique angle) when reading in the image, and measurement can be made at a higher accuracy than the imaging resolution. Therefore, it is possible to achieve reduction in the image size, increased processing speed, and shorter image reading time.

(3) The presence of dirt/dust is judged on the basis of a color channel image which is different to the absorption peak of the ink that is being measured, and peak positions and edge positions corresponding to dirt/dust positions are excluded from the calculation process accordingly. Therefore, it is possible to suppress the effects of dirt and dust.

(4) By adopting a composition in which an image of the line patterns is captured by applying an oblique angle when using the line sensor, then it is possible to reduce the effects caused by differences in the characteristics of the respective photoreceptor elements of the line sensor (error in the aperture, tonal graduation characteristics and element intervals).

More specifically, if there are differences in characteristics (errors in aperture size, tonal graduation characteristics, element intervals, and so on) between the photoreceptor elements of the imaging apparatus (line sensor), then when a reading scan is performed in the line direction without applying an angle to the scanning action (namely, by aligning the row of photoreceptor elements in a perpendicular direction to the line direction of the line pattern), the peak position and the edge positions of a particular line pattern are imaged by means of one photoreceptor element only, and therefore the dot position and dot diameter calculated as a result are significantly affected by the differences in the properties of the photoreceptor element in question.

If, in contrast to this, the reading action is performed by applying an oblique angle as shown in FIG. 9, then the plurality of photoreceptor elements traverse the line patterns, and therefore the peak position and the edge positions of the line patterns are captured by a plurality of photoreceptor elements. Consequently, the difference in the characteristics of the photoreceptor elements are averaged out, and hence the effects of the characteristics of the photoreceptor elements on the dot positions and the dot diameters calculated as a result are reduced.

Figure 37:
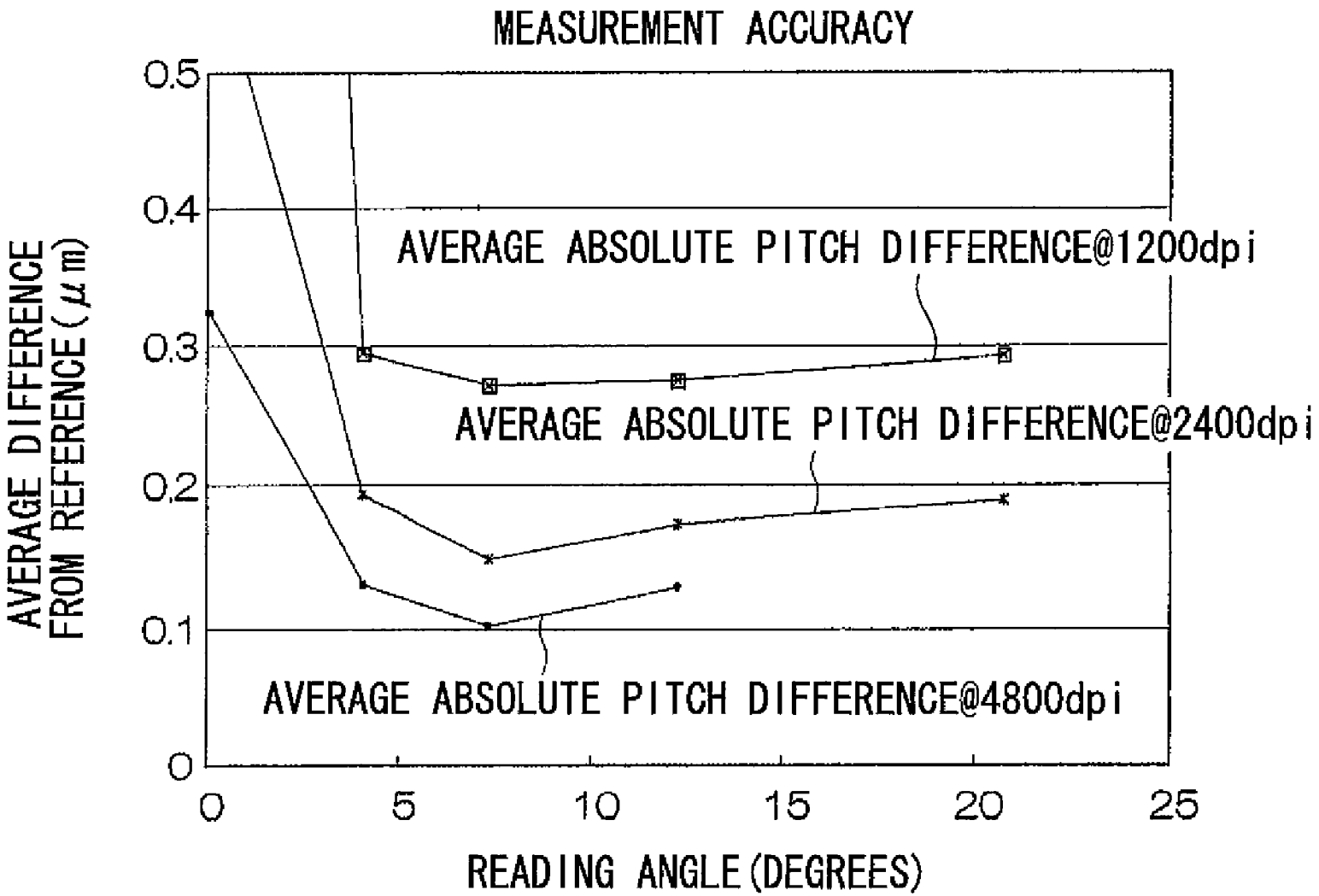
FIG. 37 is a graph showing the relationship between the reading angle and the measurement accuracy for respective resolutions.

Observations on the Angle of Inclination, the Resolution and the Measurement Accuracy During Image Reading FIG. 37 is a diagram showing the results of measuring line patterns at different resolutions (4800 dpi, 2400 dpi, 1200 dpi) and different reading angles.

The Y axis in FIG. 37 indicates the average of the absolute value of the difference between a reference measurement value and the line pitch measurement value under the respective conditions. It can be seen that the measurement accuracy is best when the reading angle is approximately 8 degrees.

It can be seen that the results of measuring at a resolution of 2400 dpi and a reading angle of approximately 8 degrees are better than the measurement results achieved at a resolution of 4800 dpi and a reading angle of 0 degrees, and hence the measurement accuracy is improved by means of the reading angle.

Embodiment of Composition of Dot Measurement Apparatus

Next, an embodiment of the composition of a dot measurement apparatus used in the dot measurement method described above will be explained. A program (dot measurement processing program) is created which causes a computer to execute the image analysis processing algorithm used in the dot measurement according to the present embodiment, and by running a computer on the basis of this program, it is possible to cause the computer to function as a calculating apparatus for the dot measurement apparatus.

Figure 38:
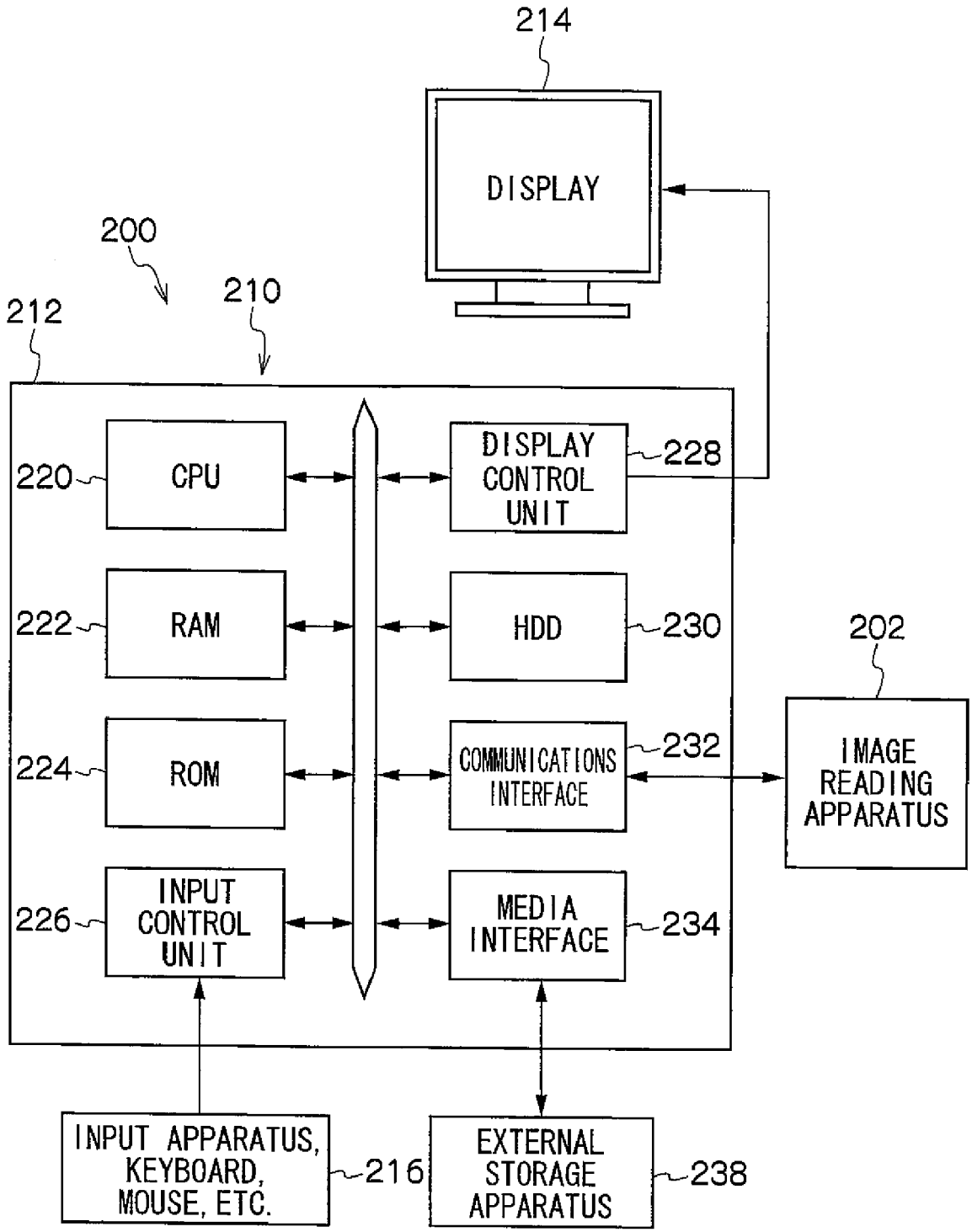
FIG. 38 is a block diagram showing an example of the composition of a dot measurement apparatus.

FIG. 38 is a block diagram showing an example of the composition of a dot measurement apparatus. The dot measurement apparatus 200 shown in FIG. 38 comprises a flat head scanner, which serves as an image reading apparatus 202, and a computer 210 which performs calculations, and other operations, for image analysis.

The image reading apparatus 202 is provided with an RGB line sensor which reads in the line patterns on the sample chart in an oblique direction, as shown in FIG. 9, and also comprises a scanning mechanism (a movement mechanism) which moves this line sensor in the reading scanning direction (the Y direction in FIG. 9), a drive circuit of the line sensor, and a signal processing circuit, or the like, which converts the output signal from the sensor (image capture signal), from analog to digital, to obtain a digital image data of a prescribed format.

The computer 210 comprises a main body 212, a display (display device) 214, and input apparatuses, such as a keyboard and mouse (input devices for inputting various commands) 216. The main body 212 houses a central processing unit (CPU) 220, a RAM 222, a ROM 224, an input control unit 226 which controls the input of signals from the input apparatuses 216, a display control unit 228 which outputs display signals to the display 214, a hard disk apparatus 230, a communications interface 232, a media interface 234, and the like, and these respective circuits are mutually connected by means of a bus 236.

The CPU 220 functions as a general control apparatus and computing apparatus (computing device). The RAM 222 is used as a temporary data storage region, and as a work area during execution of the program by the CPU 220. The ROM 224 is a rewriteable non-volatile storage device which stores a boot program for operating the CPU 220, various settings values and network connection information, and the like. An operating system (OS) and various applicational software programs and data, and the like, are stored in the hard disk apparatus 230.

The communications interface 232 is a device for connecting to an external device or communications network, on the basis of a prescribed communications system, such as USB (Universal Serial Bus), LAN, Bluetooth (registered trademark), or the like. The media interface 234 is a device which controls the reading and writing of the external storage apparatus 238, which is typically a memory card, a magnetic disk, a magneto-optical disk, or an optical disk.

In the present embodiment, the image reading apparatus 202 and the computer 210 are connected via a communications interface 232, and the data of a captured image which is read in by the image reading apparatus 202 is input to the computer 210. A composition can be adopted in which the data of the captured image acquired by the image reading apparatus 202 is stored temporarily in the external storage apparatus 238, and the captured image data is input to the computer 210 via this external storage apparatus 238.

The image analysis processing program for the dot measurement method according to the present embodiment of the present invention is stored in the hard disk apparatus 230 or the external storage apparatus 238, and the program is read out, developed in the RAM 222 and executed, according to requirements. Alternatively, it is also possible to adopt a mode in which a program is supplied by a server situated on a network (not shown) which is connected via the communications interface 232, or a mode in which a computation processing service based on the program is supplied by a server based on the Internet.

The operator is able to input various initial values, by operating the input apparatus 216 while observing the application window (not shown) displayed on the display monitor 214, as well as being able to confirm the calculation results on the monitor 214.

Furthermore, the data resulting from the calculation operations (measurement results) can be stored in the external storage apparatus 238 or output externally via the communications interface 232. The information resulting from the measurement process is input to the inkjet recording apparatus via the communications interface 232 or the external storage apparatus 238.

Modification Embodiment

In the embodiments described above, a line sensor is used as the imaging apparatus of the image reading apparatus, but instead of the line sensor, it is also possible to use an area sensor (surface imaging device). It is also possible to adopt a composition in which the whole of the sample chart can be imaged by means of one area sensor, or a composition in which the imaging area is divided up into separate regions, imaging is carried out for each region, and the data for the whole of the sample chart is acquired by joining together the respective regions.

Figure 39:
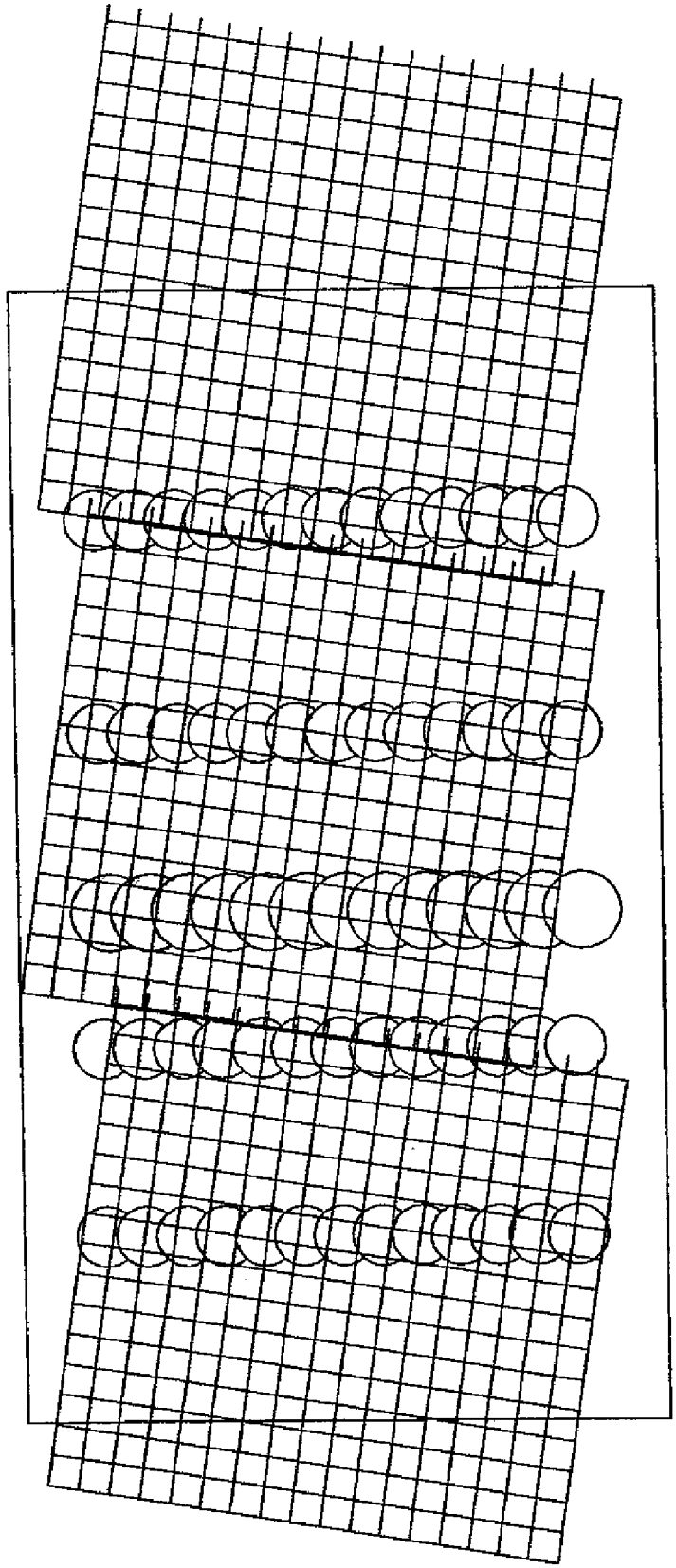
FIG. 39 is an illustrative diagram of an example where a line pattern is read in by means of an area sensor.

FIG. 39 is a diagram showing an example in which the imaging area is divided up into a plurality of regions, and images of each of the regions are captured by means of an area sensor. More specifically, a plurality of area sensors are arranged in the paper width direction, and the direction of arrangement of the photoreceptor elements of the respective area sensors has an oblique angle with respect to the line patterns. The boundary regions of the imaging regions corresponding to the respective area sensors are made to overlap with each other by a prescribed number of pixels, and by joining together the captured image data obtained from the respective area sensors, it is possible to obtain captured image data which includes all of the line patterns of the sample chart.

The calculation processing may be carried out for each divided region, respectively and independently, or it may be carried out on the basis of the whole image data after it has been joined together.

According to this mode, it is possible to adopt a composition in which an image reading apparatus is incorporated into the inkjet recording apparatus, and the sequence of operations from creating a sample chart (printing line patterns), reading in the sample chart, and then performing measurement by image analysis, can be carried out in a continuous fashion by means of the control program of the inkjet recording apparatus (in other words, online measurement is possible).

In the embodiments described above, an inkjet recording apparatus using a page-wide full line type head having a nozzle row of a length corresponding to the entire width of the recording medium was described, but the scope of application of the present invention is not limited to this, and the present invention may also be applied to an inkjet recording apparatus which performs image recording by means of a plurality of head scanning actions which move a short recording head, such as a serial head (shuttle scanning head), or the like.

Furthermore, in the description given above, an inkjet recording apparatus was described as one example of an image forming apparatus, but the scope of the present invention is not limited to this, and it may also be applied to various types of apparatuses which spray various types of liquids such as functional liquids, onto an ejection receiving medium, by means of a liquid ejection head (for instance, an application apparatus, a coating apparatus, a wiring printing apparatus, a very fine structure forming apparatus, or the like). In other words, the present invention can be applied widely as measurement technology for measuring dot deposition positions and dot diameters (droplet volumes) in various types of liquid ejection apparatuses which eject (spray) liquid, such as commercial fine application apparatuses, resist printing apparatuses, wiring printing apparatuses for electronic circuit boards, dye processing apparatuses, coating apparatuses, and the like.

APPENDIX

As has become evident from the detailed description of the embodiments of the present invention given above, the present specification includes disclosure of various technical ideas including the embodiments described below.

(1) The present invention is directed to a dot measurement method of measuring at least one of a diameter of dots and an ejection volume of droplets of liquid ejected through nozzles arranged in a liquid ejection head, the ejected droplets being deposited on an ejection receiving medium to form the dots on the ejection receiving medium, the method comprising: a line pattern forming step of forming line patterns on the ejection receiving medium by ejecting and depositing the droplets on the ejection receiving medium through the nozzles while the liquid ejection head and the ejection receiving medium are being moved relatively to each other, each of the line patterns being parallel with a line direction and constituted of a row of the dots corresponding to one of the nozzles; a pattern reading step of capturing an image of the line patterns by means of an imaging apparatus including photoreceptors to acquire electronic image data representing the image of the line patterns, the photoreceptors of the imaging apparatus being aligned in a row that obliquely intersects with the line direction of the line patterns at a prescribed angle, the electronic image data being constituted of a plurality of pixels arranged in a two-dimensional lattice of which a lattice direction obliquely intersects with the line direction of the line patterns; a profile graph acquiring step of acquiring a plurality of profile graphs for each of the line patterns from the electronic image data, each of the profile graphs representing variations in an image signal value on a one-dimensional pixel row including pixels of the plurality of pixels aligned in a one-dimensional row, the one-dimensional pixel row being parallel with the lattice direction that obliquely intersects with the line direction of the line patterns; a characteristic position calculating step of calculating extreme value positions, first edge positions and second edge positions for each of the line patterns in accordance with the plurality of profile graphs acquired for said each of the line patterns, the extreme value positions indicating density centers of said each of the line patterns, the first edge positions indicating left-hand edges of said each of the line patterns, the second edge positions indicating right-hand edges of said each of the line patterns; an approximation line calculating step of calculating a line-center approximation line, a first edge approximation line and a second edge approximation line for each of the line patterns by applying a least-square method on the extreme value positions, the first edge positions and the second edge positions calculated for each of the line patterns in the characteristic position calculating step, the line-center approximation line corresponding to the extreme value positions, the first edge approximation line corresponding to the first edge positions, the second edge approximation line corresponding to the second edge positions; a deposition position calculating step of calculating positions of the dots deposited on the ejection receiving medium in accordance with a perpendicular distance between two of the line-center approximation lines corresponding to adjacent two of the line patterns; a line width calculating step of calculating a line width of each of the line patterns by calculating a perpendicular distance between the first edge approximation line and the second edge approximation line corresponding to said each of the line patterns; a correlation information acquiring step of beforehand acquiring at least one of a first relationship between the line width of the line pattern and the diameter of the dots on the ejection receiving medium, and a second relationship between the line width of the line pattern and the ejection volume of the droplets, the at least one of the first and second relationships being acquired beforehand for a combination of the liquid and the ejection receiving medium; and a measurement value calculating step of calculating at least one of the diameter of the dots and the ejection volume of the droplets of the liquid in accordance with the line width of each of the line patterns acquired in the line width calculation step and the at least one of the first and second relationships acquired in the correlation information acquiring step.

The shape of the profile graph of the image signal value of the captured image varies depending on what value is plotted on the vertical axis. If the optical density of the line pattern is plotted on the vertical axis, then the signal value of the line pattern section is high and the signal value of the non-line pattern section is low. Therefore, the "extreme value position corresponding to the density center of the line pattern" is the position of the maximum value in the profile graph. On the other hand, if the luminosity signal or the brightness signal of the image data is plotted on the vertical axis, then the signal value in the line pattern section is low and the signal value in the non-line pattern section is high. Therefore, the "extreme value position corresponding to the density center of the line pattern" is the position of the minimum value in the profile graph.

Desirably, an interpolation method based on a quadratic function, or the like, is used for calculating the extreme value position. Furthermore, in calculating the first edge position and the second edge position, it is desirable to use linear interpolation in order to specify the positions with a greater degree of accuracy than the reading resolution.

The correspondence between the positional information of a pixel in the electronic image data and the physical distance on the actual ejection receiving medium can be calculated on the basis of the reading resolution. Since the conversion from the coordinates system of the pixels in the image data to the coordinates system on the actual ejection receiving medium is defined by a conversion formula, then it is an arbitrary decision which coordinates system is to be used for developing the calculation, and at which stage of the calculation the coordinates are to be converted.

One compositional example of a liquid ejection head according to the present invention is a full line type head in which a plurality of nozzles are arranged through a length corresponding to the full width of the ejection receiving medium. In this case, a mode may be adopted in which a plurality of relatively short recording head modules having nozzle rows which do not reach a length corresponding to the full width of the ejection receiving medium are combined and joined together, thereby forming nozzle rows of a length that corresponds to the full width of the ejection receiving medium.

A full line type head is usually disposed in a direction that is perpendicular to the feed direction (conveyance direction) of the ejection receiving medium, but a mode may also be adopted in which the head is disposed following an oblique direction that forms a prescribed angle with respect to the direction perpendicular to the conveyance direction.

The "ejection receiving medium" is a medium which receives the deposition of liquid droplets ejected from the nozzles (ejection ports) of a liquid ejection head, and this term includes a print medium, image forming medium, recording medium, image receiving medium, ejection receiving medium, intermediate transfer body, or the like, in an inkjet printer. There are no particular restrictions on the shape or material of the medium, which may be various types of media, irrespective of material and size, such as continuous paper, cut paper, sealed paper, resin sheets, such as OHP sheets, film, cloth, a printed circuit substrate on which a wiring pattern, or the like, is formed, a rubber sheet, a metal sheet, or the like.

The conveyance device for causing the ejection receiving medium and the liquid ejection head to move relatively to each other may includes a mode where the ejection receiving medium is conveyed with respect to a stationary (fixed) head, or a mode where a head is moved with respect to a stationary ejection receiving medium, or a mode where both the head and the ejection receiving medium are moved. When forming color images by using an inkjet head, it is possible to provide recording heads for each color of a plurality of colored inks (recording liquids), or it is possible to eject inks of a plurality of colors, from one print head.

For the imaging apparatus used in the present invention, it is possible to employ a line sensor (linear image sensor), or to employ an area sensor. The reading resolution varies with the size of the dots under measurement, but for example, a resolution of 12000 dpi or above is desirable for measuring the dots in an inkjet printer which achieves photo-quality image recording.

(2) Preferably, in the pattern reading step, a color image of the line patterns is captured by means of the imaging apparatus including a color image sensor, and the electronic image data are acquired for a plurality of wavelength regions in accordance with spectral sensitivity characteristics of the color image sensor.

If the liquids subject to measurement are liquids of a plurality of types having different absorption characteristics, for instance, in the case of measuring dots formed by inks of a plurality of colors, it is desirable to use a color image sensor which is capable of separating the different colors, as the imaging apparatus. For example, an imaging device equipped with RGB primary color filters, or an imaging device equipped with CMY secondary color filters is used.

When using a color image sensor, profile graphs are obtained by taking account of the absorption spectrum of the liquid under measurement and using the signal of the color channel which produces the greatest contrast.

(3) Preferably, the above-described dot measurement method further includes: a dust judgment processing step of judging whether there are effects of dust in the captured image in accordance with profile graphs obtained from the electronic image data acquired for one of the plurality of wavelength regions that is not most sensitive to an absorption peak wavelength of the liquid; and a dust-affected data exclusion step of excluding data affected by the dust from an calculation object for which at least one of the characteristic position calculating step and the approximation line calculating step is implemented, when it is judged that there are the effects of the dust in the dust judgment processing step.

In this aspect of the present invention, it is possible to carry out calculation which reduces the effects of dust.

(4) Preferably, the above-described dot measurement method further includes: a symmetry judgment processing step of judging symmetry of the profile graphs with respect to the extreme value positions of the profile graphs; and an asymmetrical data exclusion processing step of excluding data corresponding to an asymmetrical profile graph of the profile graphs, from an calculation object for which at least one of the characteristic position calculating step and the approximation line calculating step is implemented, when the asymmetrical profile graph of the profile graphs is not judged to have the symmetry in the symmetry judgment processing step.

In this aspect of the present invention, it is possible to judge the presence or absence of satellite dots from the asymmetry of the profile graph, and to perform calculation which reduces the effects of the satellite dots.

(5) Preferably, in the line pattern forming step, a plurality of line pattern blocks are formed on a sheet of the ejection receiving medium to be arranged in the line direction of the line patterns, each of the line pattern blocks being composed of the line patterns, the plurality of line pattern blocks commonly including a reference line pattern that is formed of the dots of the droplets ejected through a common nozzle of the nozzles.

By adopting this mode, it is possible to align positions between line pattern blocks, by using the reference line patterns formed by droplets ejected from the same nozzle.

Preferably, the above-described dot measurement method further includes a block position alignment processing step of adjusting positions of the line pattern blocks in accordance with a relationship of positions of the reference line pattern at the line pattern blocks.

(6) Preferably, in the line pattern forming step, a plurality of line pattern blocks are formed on a sheet of the ejection receiving medium to be arranged in the line direction of the line patterns, each of the line pattern blocks being composed of the line patterns, at least two of the line pattern blocks commonly including a reference line pattern that is formed of the dots of the droplets ejected through a common nozzle of the nozzles.

In this aspect of the present invention, it is possible to align positions between the respective line pattern blocks, by using the line patterns which are formed by droplets ejected from the same nozzle.

Preferably, the above-described dot measurement method further includes a block position alignment processing step of adjusting positions of the line pattern blocks in accordance with a relationship of positions of the reference line pattern at the at least two of line pattern blocks (7) Preferably, in the pattern reading step, the imaging apparatus includes a line sensor composed of the photoreceptors, and the image of the line patterns is captured by moving the line sensor and the ejection receiving medium on which the line patterns have been formed, relatively to each other.

(8) The present invention is also directed to a dot measurement apparatus which measures at least one of a diameter of dots and an ejection volume of droplets of liquid ejected through nozzles arranged in a liquid ejection head, the ejected droplets being deposited on an ejection receiving medium to form the dots on the ejection receiving medium, the dot measurement apparatus including: a pattern reading device which includes an imaging apparatus capturing an image of line patterns on the ejection receiving medium to acquire electronic image data representing the image of the line patterns, the line patterns being formed by ejecting and depositing the droplets on the ejection receiving medium through the nozzles while the liquid ejection head and the ejection receiving medium are being moved relatively to each other, each of the line patterns being parallel with a line direction and constituted of a row of the dots corresponding to one of the nozzles, the imaging apparatus including photoreceptors that are aligned in a row that obliquely intersects with the line direction of the line patterns at a prescribed angle, the electronic image data being constituted of a plurality of pixels arranged in a two-dimensional lattice of which a lattice direction obliquely intersects with the line direction of the line patterns; a profile graph acquiring device which acquires a plurality of profile graphs for each of the line patterns from the electronic image data, each of the profile graphs representing variations in an image signal value on a one-dimensional pixel row including pixels of the plurality of pixels aligned in a one-dimensional row, the one-dimensional pixel row being parallel with the lattice direction that obliquely intersects with the line direction of the line patterns; a characteristic position calculating device which calculates extreme value positions, first edge positions and second edge positions for each of the line patterns in accordance with the plurality of profile graphs acquired for said each of the line patterns, the extreme value positions indicating density centers of said each of the line patterns, the first edge positions indicating left-hand edges of said each of the line patterns, the second edge positions indicating right-hand edges of said each of the line patterns; an approximation line calculating device which calculates a line-center approximation line, a first edge approximation line and a second edge approximation line for each of the line patterns by applying a least-square method on the extreme value positions, the first edge positions and the second edge positions that are calculated for each of the line patterns by the characteristic position calculating device, the line-center approximation line corresponding to the extreme value positions, the first edge approximation line corresponding to the first edge positions, the second edge approximation line corresponding to the second edge positions; a deposition position calculating device which calculates positions of the dots deposited on the ejection receiving medium in accordance with a perpendicular distance between two of the line-center approximation lines corresponding to adjacent two of the line patterns; a line width calculating device which calculates a line width of each of the line patterns by calculating a perpendicular distance between the first edge approximation line and the second edge approximation line corresponding to said each of the line patterns; a correlation information storing device which beforehand stores at least one of a first relationship between the line width of the line pattern and the diameter of the dots on the ejection receiving medium, and a second relationship between the line width of the line pattern and the ejection volume of the droplets, the at least one of the first and second relationships being stored beforehand for a combination of the liquid and the ejection receiving medium; and a measurement value calculating device which calculates at least one of the diameter of the dots and the ejection volume of the droplets of the liquid in accordance with the line width of each of the line patterns acquired by the line width calculating device and the at least one of the first and second relationships stored in the correlation information storing device.

The dot measurement apparatus of the present invention may be provided separately to the liquid droplet ejection apparatus which ejects liquid droplets (the inkjet recording apparatus, wiring printing apparatus, or the like), or the dot measurement apparatus may be incorporated into the liquid droplet ejection apparatus.

(9) The present invention is also directed to a computer readable medium storing instructions causing a computer to function as the profile graph acquiring device, the characteristic position calculating device, the approximation line calculating device, the deposition position calculating device, the line width calculating device, the correlation information storing device, and the measurement value calculating device in the above-described dot measurement apparatus.

The above-described dot measurement apparatus can be achieved by combining an image reading apparatus having the above-described imaging apparatus, and a computer which is installed with the computer readable medium according to this aspect of the present invention.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A dot measurement method of measuring at least one of a diameter of dots and an ejection volume of droplets of liquid ejected through nozzles arranged in a liquid ejection head, the ejected droplets being deposited on an ejection receiving medium to form the dots on the ejection receiving medium, the method comprising:

a line pattern forming step of forming line patterns on the ejection receiving medium by ejecting and depositing the droplets on the ejection receiving medium through the nozzles while the liquid ejection head and the ejection receiving medium are being moved relatively to each other, each of the line patterns being parallel with a line direction and constituted of a row of the dots corresponding to one of the nozzles;

a pattern reading step of capturing an image of the line patterns by means of an imaging apparatus including photoreceptors to acquire electronic image data representing the image of the line patterns, the photoreceptors of the imaging apparatus being aligned in a row that obliquely intersects with the line direction of the line patterns at a prescribed angle, the electronic image data being constituted of a plurality of pixels arranged in a two-dimensional lattice of which a lattice direction obliquely intersects with the line direction of the line patterns;

a profile graph acquiring step of acquiring a plurality of profile graphs for each of the line patterns from the electronic image data, each of the profile graphs representing variations in an image signal value on a one-dimensional pixel row including pixels of the plurality of pixels aligned in a one-dimensional row, the one-dimensional pixel row being parallel with the lattice direction that obliquely intersects with the line direction of the line patterns;

a characteristic position calculating step of calculating extreme value positions, first edge positions and second edge positions for each of the line patterns in accordance with the plurality of profile graphs acquired for said each of the line patterns, the extreme value positions indicating density centers of said each of the line patterns, the first edge positions indicating left-hand edges of said each of the line patterns, the second edge positions indicating right-hand edges of said each of the line patterns;

an approximation line calculating step of calculating a line-center approximation line, a first edge approximation line and a second edge approximation line for each of the line patterns by applying a least-square method on the extreme value positions, the first edge positions and the second edge positions calculated for each of the line patterns in the characteristic position calculating step, the line-center approximation line corresponding to the extreme value positions, the first edge approximation line corresponding to the first edge positions, the second edge approximation line corresponding to the second edge positions;

a deposition position calculating step of calculating positions of the dots deposited on the ejection receiving medium in accordance with a perpendicular distance between two of the line-center approximation lines corresponding to adjacent two of the line patterns;

a line width calculating step of calculating a line width of each of the line patterns by calculating a perpendicular distance between the first edge approximation line and the second edge approximation line corresponding to said each of the line patterns;

a correlation information acquiring step of beforehand acquiring at least one of a first relationship between the line width of the line pattern and the diameter of the dots on the ejection receiving medium, and a second relationship between the line width of the line pattern and the ejection volume of the droplets, the at least one of the first and second relationships being acquired beforehand for a combination of the liquid and the ejection receiving medium; and a measurement value calculating step of calculating at least one of the diameter of the dots and the ejection volume of the droplets of the liquid in accordance with the line width of each of the line patterns acquired in the line width calculation step and the at least one of the first and second relationships acquired in the correlation information acquiring step.

2. The dot measurement method as defined in claim 1, wherein in the pattern reading step, a color image of the line patterns is captured by means of the imaging apparatus including a color image sensor, and the electronic image data are acquired for a plurality of wavelength regions in accordance with spectral sensitivity characteristics of the color image sensor.

3. The dot measurement method as defined in claim 2, further comprising:

a dust judgment processing step of judging whether there are effects of dust in the captured image in accordance with profile graphs obtained from the electronic image data acquired for one of the plurality of wavelength regions that is not most sensitive to an absorption peak wavelength of the liquid; and a dust-affected data exclusion step of excluding data affected by the dust from an calculation object for which at least one of the characteristic position calculating step and the approximation line calculating step is implemented, when it is judged that there are the effects of the dust in the dust judgment processing step.

4. The dot measurement method as defined in claim 1, further comprising:

a symmetry judgment processing step of judging symmetry of the profile graphs with respect to the extreme value positions of the profile graphs; and an asymmetrical data exclusion processing step of excluding data corresponding to an asymmetrical profile graph of the profile graphs, from an calculation object for which at least one of the characteristic position calculating step and the approximation line calculating step is implemented, when the asymmetrical profile graph of the profile graphs is not judged to have the symmetry in the symmetry judgment processing step.

5. The dot measurement method as defined in claim 1, wherein, in the line pattern forming step, a plurality of line pattern blocks are formed on a sheet of the ejection receiving medium to be arranged in the line direction of the line patterns, each of the line pattern blocks being composed of the line patterns, the plurality of line pattern blocks commonly including a reference line pattern that is formed of the dots of the droplets ejected through a common nozzle of the nozzles.

6. The dot measurement method as defined in claim 1, wherein, in the line pattern forming step, a plurality of line pattern blocks are formed on a sheet of the ejection receiving medium to be arranged in the line direction of the line patterns, each of the line pattern blocks being composed of the line patterns, at least two of the line pattern blocks commonly including a reference line pattern that is formed of the dots of the droplets ejected through a common nozzle of the nozzles.

7. The dot measurement method as defined in claim 5, further comprising a block position alignment processing step of adjusting positions of the line pattern blocks in accordance with a relationship of positions of the reference line pattern at the line pattern blocks.

8. The dot measurement method as defined in claim 6, further comprising a block position alignment processing step of adjusting positions of the line pattern blocks in accordance with a relationship of positions of the reference line pattern at the at least two of line pattern blocks.

9. The dot measurement method as defined in claim 1, wherein, in the pattern reading step, the imaging apparatus includes a line sensor composed of the photoreceptors, and the image of the line patterns is captured by moving the line sensor and the ejection receiving medium on which the line patterns have been formed, relatively to each other.

10. A dot measurement apparatus which measures at least one of a diameter of dots and an ejection volume of droplets of liquid ejected through nozzles arranged in a liquid ejection head, the ejected droplets being deposited on an ejection receiving medium to form the dots on the ejection receiving medium, the dot measurement apparatus comprising:

a pattern reading device which includes an imaging apparatus capturing an image of line patterns on the ejection receiving medium to acquire electronic image data representing the image of the line patterns, the line patterns being formed by ejecting and depositing the droplets on the ejection receiving medium through the nozzles while the liquid ejection head and the ejection receiving medium are being moved relatively to each other, each of the line patterns being parallel with a line direction and constituted of a row of the dots corresponding to one of the nozzles, the imaging apparatus including photoreceptors that are aligned in a row that obliquely intersects with the line direction of the line patterns at a prescribed angle, the electronic image data being constituted of a plurality of pixels arranged in a two-dimensional lattice of which a lattice direction obliquely intersects with the line direction of the line patterns;

a profile graph acquiring device which acquires a plurality of profile graphs for each of the line patterns from the electronic image data, each of the profile graphs representing variations in an image signal value on a one-dimensional pixel row including pixels of the plurality of pixels aligned in a one-dimensional row, the one-dimensional pixel row being parallel with the lattice direction that obliquely intersects with the line direction of the line patterns;

a characteristic position calculating device which calculates extreme value positions, first edge positions and second edge positions for each of the line patterns in accordance with the plurality of profile graphs acquired for said each of the line patterns, the extreme value positions indicating density centers of said each of the line patterns, the first edge positions indicating left-hand edges of said each of the line patterns, the second edge positions indicating right-hand edges of said each of the line patterns;

an approximation line calculating device which calculates a line-center approximation line, a first edge approximation line and a second edge approximation line for each of the line patterns by applying a least-square method on the extreme value positions, the first edge positions and the second edge positions that are calculated for each of the line patterns by the characteristic position calculating device, the line-center approximation line corresponding to the extreme value positions, the first edge approximation line corresponding to the first edge positions, the second edge approximation line corresponding to the second edge positions;

a deposition position calculating device which calculates positions of the dots deposited on the ejection receiving medium in accordance with a perpendicular distance between two of the line-center approximation lines corresponding to adjacent two of the line patterns;

a line width calculating device which calculates a line width of each of the line patterns by calculating a perpendicular distance between the first edge approximation line and the second edge approximation line corresponding to said each of the line patterns;

a correlation information storing device which beforehand stores at least one of a first relationship between the line width of the line pattern and the diameter of the dots on the ejection receiving medium, and a second relationship between the line width of the line pattern and the ejection volume of the droplets, the at least one of the first and second relationships being stored beforehand for a combination of the liquid and the ejection receiving medium; and a measurement value calculating device which calculates at least one of the diameter of the dots and the ejection volume of the droplets of the liquid in accordance with the line width of each of the line patterns acquired by the line width calculating device and the at least one of the first and second relationships stored in the correlation information storing device.

11. A computer readable medium storing instructions causing a computer to function as the profile graph acquiring device, the characteristic position calculating device, the approximation line calculating device, the deposition position calculating device, the line width calculating device, the correlation information storing device, and the measurement value calculating device in the dot measurement apparatus as defined in claim 10.

* * * * *